US005517204A

United States Patent [19]

Murakoshi et al.

[11] Patent Number: 5,517,204

[45] Date of Patent: May 14, 1996

[54] ANTENNA DIRECTING APPARATUS

[75] Inventors: Takao Murakoshi; Takeshi Hojo; Kanshi Yamamoto; Kazuteru Sato; Koichi Umeno; Yoshinori Kamiya; Kazuya Arai; Mutumi Takahashi; Yasuke Kosai, all of Tokyo, Japan

[73] Assignee: Tokimec Inc., Tokyo, Japan

[21] Appl. No.: 27,224

[22] Filed: Mar. 5, 1993

[51] Int. Cl.[6] ..... H01Q 3/00

[52] U.S. Cl. ..... 343/765; 343/766; 343/878; 74/5.34; 248/183.1

[58] Field of Search ..... 343/765, 766, 343/878, 882, 709; 248/183, 184; 74/5.22, 5.34; 318/560, 685

[56] References Cited

U.S. PATENT DOCUMENTS

| | | | |
|---|---|---|---|
| 3,664,200 | 5/1972 | Ter Brugge | 74/5.22 |
| 4,020,491 | 4/1977 | Bieser et al. | 343/765 |
| 4,193,308 | 3/1980 | Stuhler et al. | 343/765 |
| 4,399,714 | 8/1983 | Barker | 74/5.22 |
| 4,696,196 | 9/1987 | Vucevic | 343/765 |
| 4,833,932 | 5/1989 | Rogers | 74/5.1 |

*Primary Examiner*—Donald T. Hajec
*Assistant Examiner*—Tan Ho
*Attorney, Agent, or Firm*—Bauer & Schaffer

[57] ABSTRACT

An antenna having a central axis is supported on a supporting member which in turn is supported on an azimuth gimbal. The antenna and the supporting member are rotatable around an elevation axis perpendicular to the central axis gimbal is supported on a base and is rotatable around an azimuth axis perpendicular to the elevation axis. A first gyro having an input axis parallel to the elevation axis is secured to the supporting member, and a second gyro having an input axis perpendicular to both the central axis and the elevation angle axis is secured to the supporting member. An accelerometer is provided for outputting a signal representative of an inclination angle of the central axis relative to a horizontal plane. An azimuth transmitter is provided for outputting a signal representative of a rotation angle of the azimuth gimbal around the azimuth axis. The difference between a signal corresponding to the altitude angle of the satellite and the signal of the accelerometer is fed to the torquer of the first gyro, while the output signal of the azimuth transmitter and the signals corresponding to the ship's heading azimuth and a satellite azimuth angle are fed to a torquer of the second gyro to thereby direct the central axis of the antenna to the satellite.

22 Claims, 30 Drawing Sheets

ANTENNA DIRECTING APPARATUS

BACKGROUND OF THE INVENTION

1. Field of the Invention

The present invention relates to an antenna directing apparatus suitable for use with marine satellite communication systems or the like to direct an antenna to a satellite and to an antenna directing apparatus having a rewind function.

2. Description of the Prior Art

FIG. 1 shows an example of a conventional antenna directing apparatus. This antenna directing apparatus is what might be called an azimuth-elevation system. The antenna directing apparatus generally comprises a base 3, an azimuth gimbal 40 mounted on the base 3, an attachment 41 mounted on a U-letter-shaped member 40-2 secured to an upper end portion of the azimuth gimbal 40 and a metal antenna 14 attached to an attachment 41.

The base 3 includes a bridge portion 3-1 that has a cylindrical portion 11 projected upwardly therefrom. A pair of bearings 21-1, 21-2 are provided within the cylindrical portion 11. An azimuth shaft 20 is fitted into the inner rings of the bearings 21-1 and 21-2 and the azimuth gimbal 40 is coupled to the upper end portion of the azimuth shaft 20 through an arm 13.

Thus, under the condition that the azimuth shaft 20 is supported by the bearings 21-1 and 21-2, the azimuth gimbal 40 can be rotated about an axis that passes through the azimuth shaft 20. The azimuth gimbal 40 comprises a lower supporting shaft portion 40-1 and an upper U-shaped portion 40-2. The central axis of the support shaft portion 40-1, i.e., the azimuth axis Z-z is displaced from the axis that passes through the azimuth shaft 20 as shown in FIG. 1. The support shaft portion 40-1 need not be displaced and may be matched with the axis that passes through the azimuth shaft 20.

The U-shaped portion 40-2 of the azimuth gimbal 40 supports therein an attachment 41 of smaller U-letter configuration. The attachment 41 includes elevation shafts 30-1, 30-2 attached to two leg portions 41-1, 41-2, respectively. Proper bearings are respectively mounted on two leg portions of the U-shaped portion 40-2 of the azimuth gimbal 40 and the elevation shafts 30-1 and 30-2 are supported by these bearings so as to be rotatable.

The central axes of the elevation shafts 30-1, 30-2 constitute an elevation axis Y—Y. In this way, the attachment 41 is supported between the two leg portions of the U-shaped portion 40-2 of the azimuth gimbal 40 so as to become rotatable about the elevation axis Y—Y. The elevation axis Y—Y is disposed at a right angle to the azimuth axis Z—Z, and accordingly, is disposed substantially horizontally.

The antenna 14 is mounted on the leg portions 41-1, 41-2 of the attachment 41 of the U-shaped configuration, whereby the antenna 14 can be rotated about the elevation angle line Y—Y together with the attachment 41. The antenna 14 includes the central axis X—X and the central axis X—X is perpendicular to the elevation axis Y—Y.

The attachment 41 has an elevation gyro 44, an azimuth gyro 45, a first accelerometer 46 and a second accelerometer 47. The elevation gyro 44 detects a rotational angular velocity of the antenna 14 rotating around the elevation axis Y—Y. The azimuth gyro 45 detects a rotational angular velocity of the antenna 14 around an axis which is perpendicular both to the elevation axis Y—Y and the central axis X—X of the antenna 14. The first accelerometer 46 detects an inclination angle of the central axis X—X of the antenna 14 about the elevation axis Y—Y. The second accelerometer 47 detects an inclination angle of the elevation axis Y—Y relative to the horizontal plane.

The elevation gyro 44 and the azimuth gyro 45 are not limited, for example, to an integrating type gyro such as a mechanical gyro, an optical gyro or the like and may be an angular velocity detection type gyro such as a vibratory gyro, a rate gyro, an optical fiber gyro or the like.

On one leg of the attachment 41, there is mounted an elevation gear 32 so as to be coaxial with the elevation axis Y—Y. The elevation gear 32 has a pinion 35 meshed therewith and the pinion 35 is attached to a rotary shaft of an elevation servo motor 33 mounted on one leg portion of the U-shaped portion 40-2 of the azimuth gimbal 40.

On the other leg portion of the U-shaped portion 40-2 of the azimuth gimbal 40, there is mounted an elevation angle transmitter 34. The elevation angle transmitter 34 detects a rotational angle θ of the antenna 14 around the elevation axis Y—Y and outputs a signal representative of the detected rotational angle.

The azimuth shaft 20 has on its lower end portion an azimuth gear 22. An azimuth servo motor 23 and an azimuth transmitter 24 are attached on the bridge portion 3-1 of the base 3 and pinions (not shown) that are attached to the rotary shafts of the azimuth servo motor 23 and the azimuth transmitter 24 are meshed with the azimuth gear 22.

As shown in FIG. 1, there are provided an elevation angle control loop and an azimuth angle control loop in order to control the antenna directing apparatus. An elevation angle $\theta_A$ assumes an angle formed by the central axis X—X of the antenna 14 and a meridian N on the horizontal plane.

The elevation control loop controls the antenna 14 to rotate about the elevation axis Y—Y so that the elevation angle $\theta_A$ coincides with the satellite altitude angle $\theta_S$. The elevation angle control loop includes first and second loops. In the first loop, the output of the elevation angle gyro 44 is fed through an integrator 54 and an amplifier 55 back to the elevation angle servo motor 33 so that, even when the ship body rolls and pitches, the angular velocity of the antenna 14 about the elevation axis Y—Y relative to an inertial space is constantly kept zero.

In the second loop, the output signal from the first accelerometer 46 is supplied through an arc sine calculator 57, subtracted by a signal representative of the satellite altitude $\theta_S$ manually set in an adder 57A and then input through an attenuator 56 to the integrator 56 and the amplifier 55. The second loop has a proper time constant so that the elevation $\theta_A$ of the antenna 14 coincides with the satellite altitude angle $\theta_S$. The attenuator 56 may have an integrating characteristic for compensating for a drift fluctuation of the elevation angle gyro 44.

The azimuth angle control loop has a function to control the azimuth of the azimuth gimbal 40 so that the azimuth angle $\phi_A$ of the antenna 14 coincides with the satellite azimuth angle $\phi_S$. An output of the azimuth gyro 45 is fed through an integrator 58 and an amplifier 59 back to the azimuth servo motor 23, whereby the antenna 14 can be stabilized when the ship body is turned around the axis Z—Z perpendicular to the central axis X—X of the antenna 14 and the elevation axis Y—Y.

A rotational angle signal providing a rotational angle $\phi$ of the azimuth gimbal 40 is output from the azimuth transmitter and the rotational angle signal is supplied to an adder 61. In the adder 61, the rotational angle $\phi$ and a ship's heading azimuth angle $\phi_C$ supplied thereto from a magnetic compass, for example, or gyro compass are added and the satellite azimuth angle $\phi_S$ is subtracted from the sum (i.e., antenna azimuth angle $\phi_A$). An output signal from the adder 61 is input through an attenuator 60 to the integrator 58. When the sum of the rotational angle $\phi$ around the azimuth axis Z—Z of the antenna 14 and the ship's heading azimuth angle $\phi_C$ becomes equal to the satellite azimuth angle $\phi_S$, the azimuth (rotation about the axis Z—Z) of the antenna 14 is settled.

This loop has a proper time constant so that the azimuth angle $\phi_A$ of the antenna 14 coincides with the satellite azimuth angle $\phi_S$. The attenuator 60 may have an integrating characteristic compensating for the drift fluctuation of the azimuth gyro 45, i.e., the output of the attenuators 56, 60 are equivalent to the output of an integrating type gyro torquer.

In this way, the elevation control loop and the azimuth angle control loop, the central axis X—X of the antenna 14 is directed to the satellite.

In the conventional antenna directing apparatus constructed as above, the signal that is indicative of inclination angle of the central axis X—X of the antenna 14 relative to the horizontal plane from the first accelerometer 46 is supplied to the arc sine calculator 57 and the arc sine is calculated by the arc sine calculator 57 to thereby obtain the elevation angle $\theta_A$ of the antenna 14.

When the satellite altitude angle $\theta_S$ is small, the arc since is calculated at the straight line portion of sine wave so that the elevation angle $\theta_A$ of the antenna 14 can be obtained with relatively high accuracy. However, when the satellite altitude angle $\theta_S$ is large, the arc sine is calculated at the top portion of sine wave so that the calculated result of the elevation angle $\theta_A$ of the antenna 14 is obtained with low accuracy.

Further, since the arc sine of the signal obtained from the first accelerometer 46 is calculated to obtain the elevation angle $\theta_A$ of the antenna 14, it cannot be determined whether or not the elevation angle $\theta_A$ of the antenna 14 exceeds 90°. Therefore, when the elevation angle $\theta_A$ of the antenna 14 exceeds 90°, the elevation angle $\theta_A$ of the antenna 14 cannot be controlled accurately.

Consider a transfer function of the azimuth control loop. K assumes a gain of the amplifier 59 and $K_T$ assumes a gain of the attenuator 60. For simplicity, a gain of a driver unit including the azimuth servo motor and a scale factor of the gyro are set to 1 and pitching and inclination of ship body are neglected. The transfer function of the azimuth angle $\phi$ provided after Laplace transform is expressed by the following equation (1):

$$\phi = \frac{KK_T(\phi_s - \phi_c)}{S^2 + K\cos\theta \cdot s + KK_T} \quad (1)$$

where $\phi$ represents the azimuth angle of the antenna 14, $\phi_s$ represents the satellite azimuth angle, $\phi_c$ represents the gyro compass azimuth angle (ship's heading azimuth angle) and $_s$ represents the Laplace variable. If $\phi_C=\phi'_C/S$, $\phi_S=\phi'/S$ and a final value is calculated, then $\phi-\phi_X'-\phi'_C$. Thus, the azimuth angle $\phi=\phi+\phi_C$ of the antenna is directed at the satellite azimuth angle $\phi_S$.

In the conventional antenna directing apparatus, however, the directed altitude angle of the satellite is changed with latitude or rolling and pitching of ship's body and therefore the elevation angle $\theta$ of the antenna is also changed. Since the equation (1) includes a term in which a denominator has coefficient $K\cos\theta$, the frequency characteristic of the azimuth control loop system is changed with the elevation angle $\theta$ of the antenna. In particular, when the elevation angle $\theta$ of the antenna is large, the frequency characteristic is deteriorated and a control accuracy of the system is lowered. There is then the drawback that a directing error of the antenna relative to the satellite is increased.

When the elevation angle $\theta$ of the antenna becomes substantially 90° and the central axis X—X of antenna coincides with the azimuth axis, the azimuth gyro 45 cannot detect the rotational angular velocity of the antenna around the azimuth axis. Consequently, the azimuth control loop cannot function as the servo system and the antenna cannot direct the satellite. This phenomenon is what might be called a gimbal lock.

As shown in FIG. 2, there are provided four servo loops in order to control the antenna directing apparatus. An elevation angle $\theta_A$ of antenna assumes an angle formed by the central axis X—X of antenna 14 relative to the horizontal plane and an azimuth angle $\phi$ of antenna assumes an angle formed by the central axis X—X of the antenna 14 and the meridian on the horizontal plane.

In the first loop, the output of the elevation gyro 44 is fed through the integrator 54 and the amplifier 55 back to the elevation angle servo motor 33. Thus, even when the ship body is rolled and pitched, the angular velocity of the antenna 14 around the elevation axis X—X can constantly be held at zero.

In the second loop, the output signal from the first accelerometer 46 is supplied through the arc sine calculator 57, subtracted by the signal that instructs the satellite altitude angle $\theta_S$ manually set, for example, and then input through the attenuator 56 to the integrator 54 and the amplifier 55. The second loop has a proper time constant so that the elevation angle $\theta_A$ of the antenna 14 coincides with the satellite altitude angle $\theta_S$. The attenuator 56 has an integrating characteristic for compensating for a drift fluctuation of the elevation gyro 44. The elevation control loop is formed of the first and second loops.

In a third loop, on the basis of the elevation angle signal $\theta$ supplied thereto from the elevation angle transmitter 34, $1/\cos\theta$ calculator 76 calculates $1/\cos\theta$. A value which results from multiplying the calculated result with a signal $\phi\cos\theta$ of the azimuth gyro 45 is fed through the integrator 58 and the amplifier 59 to the azimuth servo motor 23 so that when the ship is turned around the axis Z—Z perpendicular to both the central axis X—X and the elevation axis Y—Y of the antenna 14, the antenna 14 can be stabilized. Also, the frequency characteristic of the azimuth control loop can be made constant regardless of the elevation angle—of the antenna 14.

In a fourth loop, the signal that instructs the rotation angle $\phi$ of the azimuth gimbal 40 is output from the azimuth transmitter 24. The output signal $\phi$ is calculated with a satellite azimuth angle $\phi_S$ and the ship's heading azimuth angle $\phi$ supplied from the magnetic compass or gyro compass, for example, to thereby generate an azimuth error or displacement signal. This azimuth error signal is input through the attenuator 60 to the integrator 58. As a result, at a point where the azimuth angle $\phi_A$ (sum of the rotational angle $\phi$ of the azimuth gimbal 40 and the ship's heading azimuth angle $\phi_C$) of the antenna 14 becomes equal to the satellite azimuth angle $\phi_S$, the azimuth of the antenna 14 is settled.

This loop includes a time constant so that the azimuth angle $\phi_A$ of the antenna 14 coincides with the satellite azimuth angle $\phi_S$. The attenuator 60 has an integrating characteristic for compensating for the drift fluctuation of the azimuth gyro 45, i.e., the outputs of the attenuators 56, 60 are equivalent to the output of the integrating type torquer. The third and fourth loops constitute an azimuth control loop.

As described above, according to the antenna directing apparatus, under the control of the two control loops formed of four servo loops, the central axis X—X of the antenna 14 can be directed to the satellite direction.

Consider the transfer function of the azimuth control loop. K assumes a gain of the amplifier 59, $K_T$ assumes a proportional gain of the attenuator 60 and $K_T$/TiS assumes an integrating gain. For simplicity, a gain of the driver unit including the azimuth servo motor 23 and the azimuth gear 22 and the scale factor of the gyro are set to 1 and the pitching of ship body is neglected. The transfer function of the rotational angle $\phi$ of the antenna after Laplace transform is expressed by the following equations (2) and (3):

$$\phi = \frac{1}{\left(\frac{Ti}{KK_T}\right)S^3 + \left(\frac{Ti}{K_T}\right)S^2 + TiS + 1}\left[(TiS+1)(\phi_s - \phi_c)\frac{Tis}{K_T}\left(\frac{U_z}{\cos\theta]} + V_I\right)\right] \quad (2)$$

$$V_1 = \frac{1}{\left(\frac{Ti}{KK_T}\right)S^3 + \left(\frac{Ti}{K_T}\right)S^2 + TiS + 1}\left[\frac{U_z}{\cos\theta} + \frac{1}{K}S + 1\right)S(\phi_s - \phi_c)\right] \quad (3)$$

where $\phi$ represents the rotation angle of the antenna 14 around the azimuth axis, $\phi_S$ represents the satellite azimuth angle, $\phi_C$ represents the ship's heading azimuth angle, $\theta$ represents the rotation angle of antenna 14 about the elevation axis, $U_Z$ represents a fixed error of azimuth gyro, $V_I$ represents the output signal of the integrator 60-2 and S represents the Laplace operator. For example, if $\phi_C=\phi_C'/S$, $\phi_S=\phi_S'/S$, $U_Z=U_Z=U_Z/S$ and a final value is calculated, from the equation (3), by substituting the following equation into the equation (1).

$$V_1 = -\frac{U_z'}{\cos\theta}$$

we have:

$$\phi = \phi_s' - \phi_c\frac{TiS}{K_T}\left\{\frac{U_z'U_z'}{\cos\theta\cos\theta}\right\} = \phi_s'\phi_c'$$

Thus, the fixed error $U_Z$ of the azimuth gyro is compensated for by the integrator 60-2 and the azimuth angle $\phi_A$ ($=\phi+\phi_C$) of the antenna becomes equal to the given satellite azimuth angle $\phi_S$.

In the above conventional antenna directing apparatus, however, since the altitude angle of the satellite to which the antenna is directed is changed with latitude or inclination and also changed largely with rolling or pitching of ship body, the antenna elevation angle $\theta$ also is changed. In the equation (2), the coefficient $1/\cos\theta$ is multiplied to the fixed error $U_Z$ of the azimuth gyro so that when the antenna elevation angle $\theta$ is changed to $\theta'$, the integrator 60-2 cannot readily follow such change. As a consequence, the rotation angle $\phi$ generates a transient angle error expressed by substantially $U_Z/K_T$ $(1/\cos\theta'-1/\cos\theta)$. There is then the drawback that the directing error relative to the satellite is increased.

FIG. 3 shows another example of the conventional antenna directing apparatus. In FIG. 3, like parts corresponding to those of FIG. 1 are marked with the same references and therefore need not be described in detail.

In the example of FIG. 3, the elevation angle transmitter 34 is mounted on one leg portion of the U-shaped portion 40-2 of the azimuth gimbal 40. The elevation angle transmitter 34 detects the rotation angle $\theta$ of the antenna 14 around the elevation axis Y—Y and outputs a signal that corresponds to the detected rotation angle $\theta$.

In this example, a cable is connected to the antenna directing apparatus. This cable includes a coaxial cable 70 connected to the antenna 14, and lead wires connected to parts mounted on the attachment 41 and the U-shaped portion 40-2. A transmission signal is transmitted to the antenna 14 by means of the coaxial cable 70 and a reception signal is obtained from the antenna 14 through the coaxial cable 70. As shown by a dashed line in FIG. 3, the coaxial cable 70 is extended from the antenna 14 through the attachment 41 the U-shaped portion 40-2 of the azimuth gimbal 40, the support shaft portion 40-1, the arm 13 and along the azimuth shaft 20 to the base 3, from which it is led to the outside.

The cable 70 is made of a flexible material and has a length a little longer than the route extending from the antenna 14 to the base 3. Therefore, when the antenna 14 is rotated about the elevation axis Y—Y and further rotated about the azimuth axis Z—Z, the rotation of the antenna 14 can be prevented from being hindered by the twisting and winding of the cable 70.

However, when the ship body turns or yaws and hence the antenna 14 is rotated about the azimuth axis Z—Z by a large rotational angle, it is frequently observed that the twisting and wrapping of the cable 70 hinder the rotation of the antenna 14. In such case, the antenna directing apparatus includes a rewind mechanism in order to avoid the twisting and wrapping of the cable 70.

As shown in FIG. 3, the rewind mechanism includes a loop formed of the azimuth transmitter 24, a rewind controller 71, a switching circuit 73 and the azimuth servo motor 23. The rewind controller 71 is supplied with the signal that indicates the rotation angle $\phi$ of the azimuth gimbal 40 output from the azimuth transmitter 24 and supplies a control signal to the switching circuit 73 so that when the antenna 14 is rotated more than 270° from a predetermined reference azimuth, the antenna 14 is rotated 360° in the opposite direction. As described above, the servo motor 23 rotates the azimuth gimbal 40 360° in the opposite direction to thereby untie the twisting of the cable 70.

According to the conventional antenna directing apparatus, when the satellite altitude angle $\theta_S$ is relatively small, even if the ship's body is rolled and pitched, the directing accuracy of the antenna is satisfactory. However, if the ship's body rolls or pitches when the satellite altitude $\theta_S$ is large, the central axis X—X of the antenna 14 and the azimuth axis Z—Z become parallel which causes the so-called gimbal lock phenomenon. If the gimbal lock phenomenon occurs, then the directing accuracy of the antenna is lowered.

Further, in the conventional antenna directing apparatus, if the ship body is in the inclined state such as when the satellite altitude angle $\theta_S$ is large and the ship body is pitched and rolled, when a side wind acts on the ship body, when the cargo is displaced or when a fishing boat draws up a net, then the antenna azimuth angle $\phi_A$ output from the azimuth transmitter 24 contains an error corresponding to the inclination angle of the ship body and finally a large error occurs in the directing azimuth of the antenna 14. Such error becomes remarkable when the inclination of ship body is continued.

FIG. 4 shows an error generating mechanism. The surface 102 (deck) of the ship body rotates at a rotation angle $\xi$ around the elevation axis Y—Y relative to a horizontal plane 100 (circle having a radius of 1) to form a $\xi$ inclined surface 101 and also rotates by a rotation angle $\eta$ around the stern axis OS' of ship body to form a $\xi+\eta$ inclined plane 102. An arrow A in FIG. 4 represents a direction vector that directs a satellite 105. This line OS" (length 1) is matched with the central axis X—X of the antenna 14.

Since an angle that is formed by the direction vector A and the horizontal plane 100 is the satellite altitude angle $\theta_S$ (command angle), an angle formed by the direction vector A and the $\xi$ inclined plane 101 is express as $\xi_0=\angle$"OS'$=\theta_S-\xi$. The output of the elevation angle transmitter 34 represents the satellite elevation angle $\theta$ relative to the $\xi+\eta$ inclined plane 102. This angle is an angle that is formed by the direction vector A and the ship body plane, i.e., the $\xi+\eta$ inclined plane 102. If a perpendicular is extended from the point S" to the $\xi=\eta$ inclined plane 102 and the foot of perpendicular is taken as H, the output of the elevation angle transmitter 34 is expressed as $\theta=\angle$S"OH–S"H.

The angle that the direction vector A forms on the horizontal plane 100 with respect to the meridian N is the satellite azimuth angle $\phi_S$. A point B on the surface of ship's body which also corresponds to the elevation angle axis OB under the condition that the ship body is in the horizontal state is moved to a point B' which satisfies the condition of $\angle$S'OB'= 90° after inclined $\xi+\eta$.

However, since the elevation axis Y—Y passes the point B not the point B' on the surface (deck) 102 of ship body, the angle $\angle$S"OB" formed by the elevation axis OB" and the central axis X—X of the antenna 14 is 90°.

Accordingly, in the antenna azimuth angle $\phi_A$ detected by the azimuth transmitter 24, there occurs an error B'B"$=\Delta\phi_{AE}$ when the ship body surface (deck) 102 is inclined relative to the horizontal plane 100.

If the ship body surface (deck) 102 is inclined, the inclination angle $\eta$ relative to the horizontal plane 100, the satellite elevation angle relative to the $\xi$ inclined plane 101 is expressed as $\xi_0=\theta_S-\xi$. This angle is an angle $\xi_0=\angle$S"OS' that is formed by the direction vector A and the ship body surface, i.e., $\xi$ inclined plane 102. Accordingly, a transmission error $\Delta\phi_{AE}$ of the antenna azimuth angle $\phi_A$ detected by the azimuth transmitter 24 is expressed by the following equation (4):

$$\Delta\phi_{AE}=\tan^{-1}\{\tan\xi_0\cdot\sin\eta\} \quad (4)$$

However, the ship body surface (deck) 102 is inclined not only at the inclination angle $\eta$ but also at $\eta+\xi$ relative to the horizontal plane 100. Therefore, as described above, the output of the elevation angle transmitter 34 is the satellite elevation angle $\theta$ relative to the $\xi+\eta$ inclined plane 102. This elevation angle $\theta$ is the angle formed by the direction vector A and the ship body surface, i.e., the $\xi+\eta$ inclined plane 102. At that time, the output of the second accelerometer 47 is not $\eta$=BB' but x=$B_1$B". Accordingly, the error $\Delta\phi_{AE}$ of the antenna azimuth angle $\phi_A$ detected by the azimuth transmitter 24 is calculated by the following equation (5) by using detection amounts $\theta$ and x instead of $\xi_0$, $\eta$ in the equation (2):

$$\Delta\phi_{AE}=\sin^{-1}\{\sin\theta\cdot\sin s\cdot(\cos^2\theta s-\sin^2 x\cdot\cos^2\theta)^{-1/2}\} \quad (5)$$

where $\theta$ represents the rotation angle of the antenna around the elevation axis relative to the azimuth gimbal, x represents the inclination angle of the elevation axis relative to the horizontal plane and $\theta_S$ represents the satellite altitude angle.

OBJECTS AND SUMMARY OF THE INVENTION

In view of the above aspects, it is an object of the present invention to provide an antenna directing apparatus which is prevented from being disabled, and therefore not capable of following a satellite, due to the gimbal lock phenomenon, even when an antenna elevation angle reaches substantially 90°. It is also an object of this invention to provide apparatus which includes a servo system having a satisfactory frequency characteristic whereby the antenna can be directed to the satellite satisfactorily.

It is another object of the present invention to provide an antenna directing apparatus in which the fixed error of an azimuth gyro can be compensated for independently of the elevation angle value of the antenna and in which the responsiveness of the system can be made constant.

It is still another object of the present invention to provide an antenna directing apparatus which can accurately calculate the value of the antenna elevation angle even when a satellite altitude angle is large whereby the antenna can be directed to the satellite satisfactorily.

It is still another object of the present invention to provide an antenna directing apparatus in which the antenna can be directed to a satellite satisfactorily even when a satellite altitude angle is larger and even under the conditions that a ship body is pitched, rolled or inclined at a constant inclination angle during navigation.

It is a further object of the present invention to provide an antenna directing apparatus in which the antenna can be satisfactorily directed to a satellite even when the ship body is pitched, rolled, vibrated or inclined a constant inclination angle during navigation.

It is a still further object of the present invention to provide an antenna directing apparatus in which the gimbal lock phenomenon is avoided and in which an antenna can be satisfactorily directed to a satellite even when the satellite altitude angle is substantially 90°.

It is a still further object of the present invention to provide an antenna directing apparatus in which the control of an azimuth gimbal is suppressed when the satellite altitude angle is substantially 90° and when the pitching and rolling of a ship body is small whereby the antenna can be directed to the satellite satisfactorily.

It is a yet further object of the present invention to provide an antenna directing apparatus in which $\Delta\phi_I=\eta/\xi$ is calculated by a division of an inclination axis azimuth calculator even if an inclination angle $\xi$ of a ship body, around an elevation angle axis Y—Y is substantially zero, when a satellite altitude angle is substantially 90° and the elevation angle axis Y—Y is controlled to be matched with an inclination axis of the ship body whereby the elevation angle axis Y—Y can be matched with the inclination axis of the ship body.

It is yet a further object of the present invention to provide an antenna directing apparatus in which $\Delta\phi_I=\eta/\xi$ is calculated by a division of an inclination axis azimuth calculator even if an inclination angle $\xi$ of a ship body, around an elevation angle axis Y—Y is substantially zero when a satellite altitude angle is substantially 90° and the elevation angle axis Y—Y is controlled to be matched with an inclination axis of the ship body whereby the elevation angle axis Y—Y can be matched with the inclination axis of the ship body.

It is yet a further object of the present invention to provide an antenna directing apparatus in which the antenna direction can be returned to a satellite direction again without error after an azimuth gimbal has been rotated once in the direction in which a twisting of a coaxial cable is returned.

It is yet a further object of the present invention to provide an antenna directing apparatus in which an antenna can be satisfactorily directed to a satellite without the gimbal lock phenomenon if a satellite altitude angle is large when a ship body is pitched, rolled or inclined a constant inclination angle.

According to a first aspect of the present invention, there is provided an antenna directing apparatus which comprises an antenna having a central axis and being supported on a supporting member, an azimuth gimbal for supporting the antenna and the supporting member so that the antenna and the supporting member become rotatable around an elevation axis perpendicular to the central axis. A base is provided for supporting the azimuth gimbal so that the azimuth gimbal becomes rotatable around an azimuth axis perpendicular to the elevation axis. A first gyro is provided having an input axis parallel to the elevation axis and is secured to the supporting member. A second gyro having an input axis perpendicular to both the central axis and the elevation angle axis is secured to the supporting member. An accelerometer for outputting a signal representative of an inclination angle of the central axis relative to a horizontal plane, and an azimuth transmitter for outputting a signal representative of a rotation angle of the azimuth gimbal around the azimuth axis are provided produces a signal which results from subtracting a value corresponding to a satellite altitude angle from the output signal of the accelerometer which signal is fed back to a substantial torquer of the first gyro. The output signal of the azimuth transmitter and signals corresponding to a ship's heading azimuth and a satellite azimuth angle are added by an adder and an output signal of the adder is fed back to a substantial torquer of the second gyro to thereby direct the central axis of the antenna to the satellite. This antenna directing apparatus further comprises an elevation transmitter for outputting a rotation angle signal representative of a rotation angle θ of the antenna around the elevation angle axis relative to the azimuth gimbal, and a calculating unit for calculating a value of 1/cosθ from the rotation angle signal output from the elevation angle transmitter, wherein the output signal of the second gyro and an output signal from the 1/cosθ calculating unit are multiplied with each other and the multiplied value is input to an integrator, thereby a frequency characteristic of the servo system is made invariable in all elevation angles θ.

According to a second aspect of the present invention, there is provided an antenna directing apparatus which comprises an antenna having a central axis and being supported to a supporting member, an azimuth gimbal for supporting the antenna and the supporting member so that the antenna and the supporting member becomes rotatable around an elevation axis perpendicular to the central axis. A base is provided for supporting said azimuth gimbal so that the azimuth gimbal becomes rotatable around an azimuth axis perpendicular to the elevation axis. A first gyro having an input axis parallel to the elevation axis is secured to the supporting member and a second gyro having an input axis perpendicular to both the central axis and the elevation axis is secured to the supporting member. An accelerometer for outputting a signal representative of an inclination angle of the central axis relative to a horizontal plane, and an azimuth transmitter for outputting a signal representative of a rotation angle of the azimuth gimbal around the azimuth axis, produces a signal which results from subtracting a value corresponding to a satellite altitude angle from the output signal of the accelerometer which signal is fed back to a substantial torquer of the first gyro, the output signal of the azimuth transmitter and signals corresponding to a ship's heading azimuth and a satellite azimuth are added by an adder and an output signal of the adder is fed back to a substantial torquer of the second gyro to thereby direct the central axis of the antenna to the satellite. This antenna directing apparatus further comprises an elevation angle transmitter for outputting a rotation angle signal representative of a rotation angle θ of the antenna around the elevation axis relative to the azimuth gimbal, and an ON/OFF device for interrupting an output signal from the second gyro, wherein the output signal of the second gyro is interrupted by the ON/OFF device when a central value provided when the central axis of the antenna and the azimuth axis become parallel to each other falls within a predetermined angle range.

According to a third aspect of the present invention, there is provided an antenna directing apparatus which comprises an antenna, having a central axis, supported on a supporting member. An azimuth gimbal for supporting the antenna and the supporting member so that the antenna and the supporting member are rotatable around an elevation angle axis perpendicular to the central axis, a base for supporting the azimuth gimbal so that the azimuth gimbal is rotatable around an azimuth axis perpendicular to the elevation axis, a first gyro having an input axis parallel to the elevation and being secured to the supporting member, a second gyro having an input axis perpendicular to both the central axis and the elevation axis and being secured to the supporting member. An accelerometer provides an output signal representative of the angle of inclination angle of the central axis relative to a horizontal plane, and an azimuth transmitter provides an output signal representative of the angle of rotation of the azimuth gimbal around the azimuth axis. The signal obtained from subtracting the value corresponding to the satellite altitude angle from the output signal of the accelerometer is fed through an attenuator back to a substantial torquer of the first gyro. The output signal of the azimuth transmitter and the signals corresponding to a ship's heading azimuth and the satellite azimuth are calculated by an adder to produce an azimuth deviation signal which is then fed through an attenuator back to a substantial torquer of the second gyro to thereby direct the central axis of the antenna to the satellite. An elevation angle transmitter four outputting a signal representative of the rotation angle θ of the antenna around the elevation axis relative to the azimuth gimbal, and a 1/cosθ calculating unit for calculating a value of 1/cosθ from the rotation angle signal output from the elevation angle transmitter are provided so that the output signal of the second gyro and an output signal from the 1/cosθ calculating unit are multiplied with each other and a multiplied value is input to an integrator. As a result, a frequency characteristic of a servo system is made invariable in all elevation angles θ. This antenna directing apparatus further comprises a cosθ calculating unit for calculating a value of cosθ from the rotation angle signal output from the elevation angle transmitter. As a result the azimuth deviation signal and an output signal from the cosθ calculating unit are multiplied with each other and the multiplied result is input to a gyro drift compensating integrator and the output signal of the integrator is fed back to an input of the 1/cosθ calculating unit.

According to a fourth aspect of the present invention, there is provided an antenna directing apparatus which comprises an antenna, having a central axis, supported on a supporting member. An azimuth gimbal supports the antenna and the supporting member so that the antenna and the supporting member are rotatable around an elevation axis perpendicular to the central axis. The azimuth gimbal is supported on a base so that the azimuth gimbal is rotatable around an azimuth axis perpendicular to the elevation angle axis. A first gyro having an input axis parallel to the elevation angle axis is secured to the supporting member and a second gyro having an input axis perpendicular to both the central axis and the elevation axis is secured to the supporting member. A first accelerometer for outputting a signal representative of the angle of inclination of the central axis relative to a horizontal plane and a second accelerometer for outputting a signal representative of the angle of inclination angle of the elevation axis relative to the horizontal plane are provided. An azimuth transmitter for outputting a signal representative of the angle of rotation of the azimuth gimbal around the azimuth axis and an elevation angle transmitter for outputting the angle of rotation of the antenna transmitter around the elevation axis relative to the azimuth gimbal thereby the central axis of the antenna is directed to the satellite. This antenna directing apparatus further comprises a third accelerometer having an input axis perpendicular to both the central axis and the elevation axis of the antenna, and an antenna elevation calculating unit supplied with output signals of the first, second and third accelerometers, wherein the antenna elevation calculating unit calculates the elevation angle of the antenna from the output signals of the first, second and third accelerometers.

According to a fifth aspect of the present invention, there is provided an antenna directing apparatus which comprises an antenna having a central axis and being supported on a supporting member. The antenna and the supporting member are supported on an azimuth gimbal so that the antenna and the supporting member are rotatable around an elevation axis perpendicular to the central axis. The azimuth gimbal is supported on a base so that the azimuth gimbal is rotatable around an azimuth axis perpendicular to the elevation axis. Also provided are a first gyro having an input axis parallel to the elevation axis and secured to the supporting member, a second gyro having an input axis perpendicular to both the central axis and the elevation axis and secured to the supporting member, a first accelerometer for outputting a signal representative of the angle of inclination of the central axis relative to a horizontal plane, a second accelerometer for outputting a signal representative of the angle of inclination of the elevation axis relative to the horizontal plane, and a third accelerometer having an input axis perpendicular to both the central axis and the elevation axis of the antenna, an azimuth transmitter for outputting a signal representative of a rotation of the azimuth gimbal around the azimuth axis, and an elevation transmitter for outputting a signal indicative of a rotation angle $\theta$ of the antenna around the elevation axis relative to the azimuth gimbal. The resultant signal from subtracting the value corresponding to a satellite altitude from the output signal of the accelerometer is fed back to a substantial torquer of the first gyro, the output signal of the azimuth transmitter and signals corresponding to a ship's heading azimuth and a satellite azimuth angle are calculated by an adder and an output signal of the adder is fed back to a substantial torquer of the second gyro to thereby direct the central axis of the antenna to the satellite. This antenna directing apparatus further comprises an inclination correction calculating unit supplied with an output signal from the second accelerometer, an output signal from the third accelerometer and an output signal of the elevation angle transmitter. The inclination correction calculating unit calculates an inclination correction value $\Delta\phi_A$ by the following equation and outputs a signal representative of the inclination correction value $\Delta\phi_A$ to the adder:

$$\Delta\phi_A=\tan^{-1}(\sin\theta\cdot\sin x/\sin\theta_P)$$

where $\theta$ is the angle of the rotation of the antenna around the elevation axis relative to the azimuth gimbal, x is the angle of the elevation axis relative to the horizontal plane and $\theta_P$ is the angle of inclination of an axis perpendicular to the central axis and the elevation axis of the antenna relative to the horizontal plane.

According to a sixth aspect of the present invention, there is provided an antenna directing apparatus which comprises an antenna having a central axis and being supported on a supporting member, an azimuth gimbal supports the antenna and the supporting member so that the antenna and the supporting member are rotatable around an elevation axis perpendicular to the central axis. The azimuth gimbal is supported on a base so that the azimuth gimbal is rotatable around an azimuth axis perpendicular to the elevation axis. A first gyro having an input axis parallel to the elevation angle axis is secured to the supporting member, and a second gyro having an input axis perpendicular to both the central axis and the elevation axis is secured to the supporting member. A first accelerometer outputting a signal representative of an inclination angle of the central axis relative to a horizontal plane, and an azimuth transmitter outputting a signal representative of the angle of rotation of the azimuth gimbal around the azimuth axis are provided. The signal which results from subtracting a value corresponding to a satellite altitude angle from the output signal of the first accelerometer is fed back to a substantial torquer of the first gyro, and the output signal of the azimuth transmitter and signals corresponding to a ship's heading azimuth and a satellite azimuth are calculated by an adder. The output signal of the adder is fed back to a substantial torquer of the second gyro to thereby direct the central axis of the antenna to the satellite. This antenna directing apparatus further comprises a second accelerometer for outputting a signal representative of an inclination angle x of the elevation axis relative to the horizontal plane, an elevation angle transmitter for outputting a signal $\theta$ representative of the angle of rotation of the antenna around the elevation axis relative to the azimuth gimbal, and an azimuth error calculator supplied with the output of the second accelerometer and the output of the elevation angle transmitter so that a signal representative of an azimuth error $\Delta\phi_{AE}$ calculated by the azimuth error calculator according to the following equation is input to the adder;

$$\Delta\phi_{AE}=\sin^{-1}\{\sin\theta\cdot\sin x\cdot(\cos^2\theta_S-\sin^2 x\cdot\cos^2\theta^{-1/2}\}$$

where $\theta$ is the angle of rotation of the antenna around the elevation axis of the antenna relative to the azimuth gimbal, x is the angle of inclination of the elevation axis relative to the horizontal plane and $\theta_S$ is the altitude angle of the satellite.

According to a seventh aspect of the present invention, there is provided an antenna directing apparatus which comprises an antenna having a central axis, a supporting member attached to the antenna and an azimuth gimbal having an elevation axis perpendicular to the central axis and supporting the antenna attached to the supporting member so that the antenna is rotatable around the elevation axis.

A base supports the azimuth gimbal such that the azimuth gimbal is rotatable around an azimuth axis perpendicular to the elevation axis. The supporting member has attached thereon a first gyro having an input axis perpendicular to both the central axis and the elevation axis, a first accelerometer for outputting a signal representative of the angle of inclination of the central axis relative to a horizontal plane and a second accelerometer for outputting a signal representative of the angle of inclination of the elevation axis relative to the horizontal plane. The base has attached thereon an azimuth transmitter for outputting a signal representative of the angle of rotation of the azimuth gimbal around the azimuth axis and an elevation angle transmitter for outputting a signal representative of the angle of rotation of the antenna around the elevation axis. The azimuth angle and an altitude angle of the satellite are thereby detected so as to direct the central axis of the antenna to the satellite. This antenna directing apparatus further comprises means for controlling the azimuth of the azimuth gimbal such that when the angle of altitude of the satellite is in the vicinity of 90°, the elevation axis coincides with the axis of the azimuth inclination of the ship's body.

According to an eighth aspect of the present invention, there is provided an antenna directing apparatus which comprises an antenna having a central axis, a supporting member attached to the antenna, an azimuth gimbal having an elevation axis perpendicular to the central axis and supporting the antenna attached to the supporting member so that the antenna is rotatable around the elevation axis. A base supports the azimuth gimbal so that the azimuth gimbal is rotatable around an azimuth axis perpendicular to the elevation axis. A flexible cable is provided for feeding, transmission and reception. A first gyro having an input axis parallel to the elevation angle axis is secured to the supporting member and a second gyro having an input angle axis perpendicular to both the central axis and the elevation axis is secured to the supporting member. A first accelerometer for outputting a signal representative of the angle of inclination of the antenna around the elevation angle axis and a second accelerometer for outputting a signal representative of the angle of inclination of the central axis of the antenna are provided as are an azimuth transmitter for outputting a signal representative of the angle of rotation and of the azimuth gimbal around the azimuth axis and an elevation angle transmitter for outputting a signal representative of the angle of rotation of the antenna around the elevation axis relative to the azimuth gimbal. A rewind controller supplied with a signal output from the azimuth transmitter is provided to rotate the azimuth gimbal by predetermined angle in the opposite direction to untie the twisting of the flexible cable when the azimuth gimbal is rotated more than the predetermined angle of rotation around the azimuth axis to thereby direct the central axis of the antenna to the satellite in response to the azimuth angle and an altitude angle of the satellite. This antenna directing apparatus further comprises a roll and pitch detector device for judging the magnitude of the ship's body rolling and controlling the azimuth of the azimuth gimbal so that the elevation axis is matched with the stern axis of the ship's body when the satellite altitude angle is near 90° and it is determined by the rolling detector device that the ship's pitching and rolling is small.

According to a ninth aspect of the present invention, there is provided an antenna directing apparatus which comprises an antenna having a central axis and supported on a supporting member. An azimuth gimbal having an elevation axis perpendicular to the central axis supports the antenna attached to the supporting member so that the antenna is rotatable around the elevation axis. A base supports the azimuth gimbal so that the azimuth gimbal is around an azimuth axis perpendicular to the elevation axis. A first gyro having an input axis parallel to the elevation axis is secured to the supporting member while a second gyro having an input axis perpendicular to both the central axis and the elevation angle axis is also secured to the supporting member. A first accelerometer outputting a signal representative of the angle of inclination of the antenna around the elevation angle axis, a second accelerometer for outputting a signal representative of the angle of inclination angle of the antenna around the central axis, an azimuth transmitter for outputting a signal representative of the angle of rotation angle of the azimuth gimbal around the azimuth axis relative to the base, an elevation angle transmitter for outputting a signal representative of a rotation angle of the antenna around the elevation angle axis relative to the base, an elevation axis inclination calculator being supplied with a signal representative of the angle of inclination of the antenna around an axis perpendicular to both the central axis and the elevation angle axis output from the second gyro and a signal representative of the angle of inclination of the antenna around its central axis output from the second accelerometer and calculating the angle of inclination of the elevation axis relative to the horizontal plane, an elevation axis azimuth calculator for calculating the azimuth of the axis of inclination of the ship's body from the angle of inclination of the elevation axis output from the elevation axis inclination calculator and the angle of rotation of the ship body around the elevation axis output from the elevation angle transmitter. As a result, when the satellite altitude angle is near 90°, the azimuth of the azimuth gimbal may be controlled so that the azimuth of the elevation axis is matched with the azimuth of the axis of inclination of the ship body, and the central axis of the antenna is directed to the satellite direction. This antenna directing apparatus further comprises an angle limiter supplied with a signal, representative of a rotation angle $\xi$ of the ship body around the elevation axis, output from the elevation angle transmitter, wherein the angle limiter outputs a signal representative of a setting value $\xi_S$ having the same sign of the rotation angle $\xi$ when an absolute value of the rotation angle $\xi$ around the elevation axis is smaller than the setting value $\xi_S$ and a signal representative of the rotation angle $\xi$ when the absolute value of the rotation angle $\xi$ around the elevation angle axis is smaller than the setting value $\xi_S$.

According to a tenth aspect of the present invention, there is provided an antenna directing apparatus formed of a base, a supporting mechanism and a coaxial feeding cable which comprises an azimuth gimbal supporting the supporting mechanism so that the supporting mechanism becomes rotatable around an azimuth shaft perpendicular to the base and having on its upper portion a fork-shaped member having a bearing for an elevation shaft perpendicular to the azimuth shaft. An antenna supporting member having an elevation shaft is rotatably engaged with the elevation shaft bearing and an antenna shaft perpendicular to the elevation shaft. A first gyro is secured to the antenna supporting member and has an input axis parallel to the elevation angle shaft. A second gyro is secured to the antenna supporting member and has an input axis perpendicular to both the antenna shaft and the elevation shaft. An accelerometer is secured to the antenna supporting member for generating an output signal corresponding to an inclination of the antenna shaft relative to a horizontal plane. There is also provided an azimuth transmitter for transmitting the angle of rotation of the azimuth gimbal around the azimuth shaft relative to the base, an amplifier for feeding a signal which results from subtracting the value corresponding to a satellite altitude from an output signal of the accelerometer back to the torquer of the first gyro, feeding a signal which results from calculating the output signal of the azimuth transmitter and signals corresponding to a ship's heading azimuth angle and a satellite azimuth angle back to a substantial torquer of the second gyro. A rewind controller is supplied with the output signal of the azimuth transmitter; and a gain switching circuit is operable by an output signal of the rewind controller to switch the gain of the amplifier. Thus, when the coaxial cable is twisted over a predetermined angle, the rewind controller adds a $2\pi$ signal or $-2\pi$ signal to a signal which results from calculating the output signal of the azimuth transmitter and the signals corresponding to the ship's heading azimuth angle and the satellite azimuth angle whereby the gain switching circuit switches the gain of the amplifier to a large value.

According to an eleventh aspect of the present invention, there is provided an antenna directing apparatus which comprises an antenna having a central axis supported on a supporting member, an azimuth gimbal for supporting the antenna and the supporting member so that the antenna and the supporting member are rotatable around the elevation axis perpendicular to the central axis. A base is provided for supporting the azimuth gimbal so that the azimuth gimbal becomes rotatable around the azimuth axis perpendicular to the elevation axis. A first gyro has an input axis parallel to the elevation angle axis and is secured to the supporting member, while a second gyro having an input axis perpendicular to both the central axis and the elevation angle axis is secured to the supporting member. A first accelerometer producing a signal representative of the angle of inclination of the central axis relative to the horizontal plane, and a second accelerometer producing a signal representative of the angle of inclination of the elevation axis relative to the horizontal plane are also provided. An azimuth transmitter produces a signal representative of a rotation angle of the azimuth gimbal around the azimuth axis which elevation angle transmitter produces a signal representative of a rotation angle of the antenna around the elevation angle axis relative to the azimuth gimbal. An azimuth servo motor, attached to the base, rotates the azimuth gimbal in response to an input axis; an elevation angle servo motor, attached to the azimuth gimbal, rotates the antenna around the elevation angle axis in response to an input axis; a rewind apparatus rotates the azimuth gimbal in the opposite direction when the azimuth gimbal is over-rotated by a predetermined rotation angle relative to the base to thereby direct the central axis of the antenna to the satellite. This antenna directing apparatus further comprises a mode calculating unit including a low altitude mode calculating unit, an intermediate altitude mode calculating unit and a high altitude mode calculating unit, and a mode setting unit for outputting a mode selection signal to the mode calculating unit. The low altitude mode calculating unit is operated where the satellite altitude is low; the intermediate altitude mode calculating unit is operated where the satellite altitude is intermediate; and the high altitude mode calculating unit is operated where the satellite altitude is near zenith.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Figure 1:
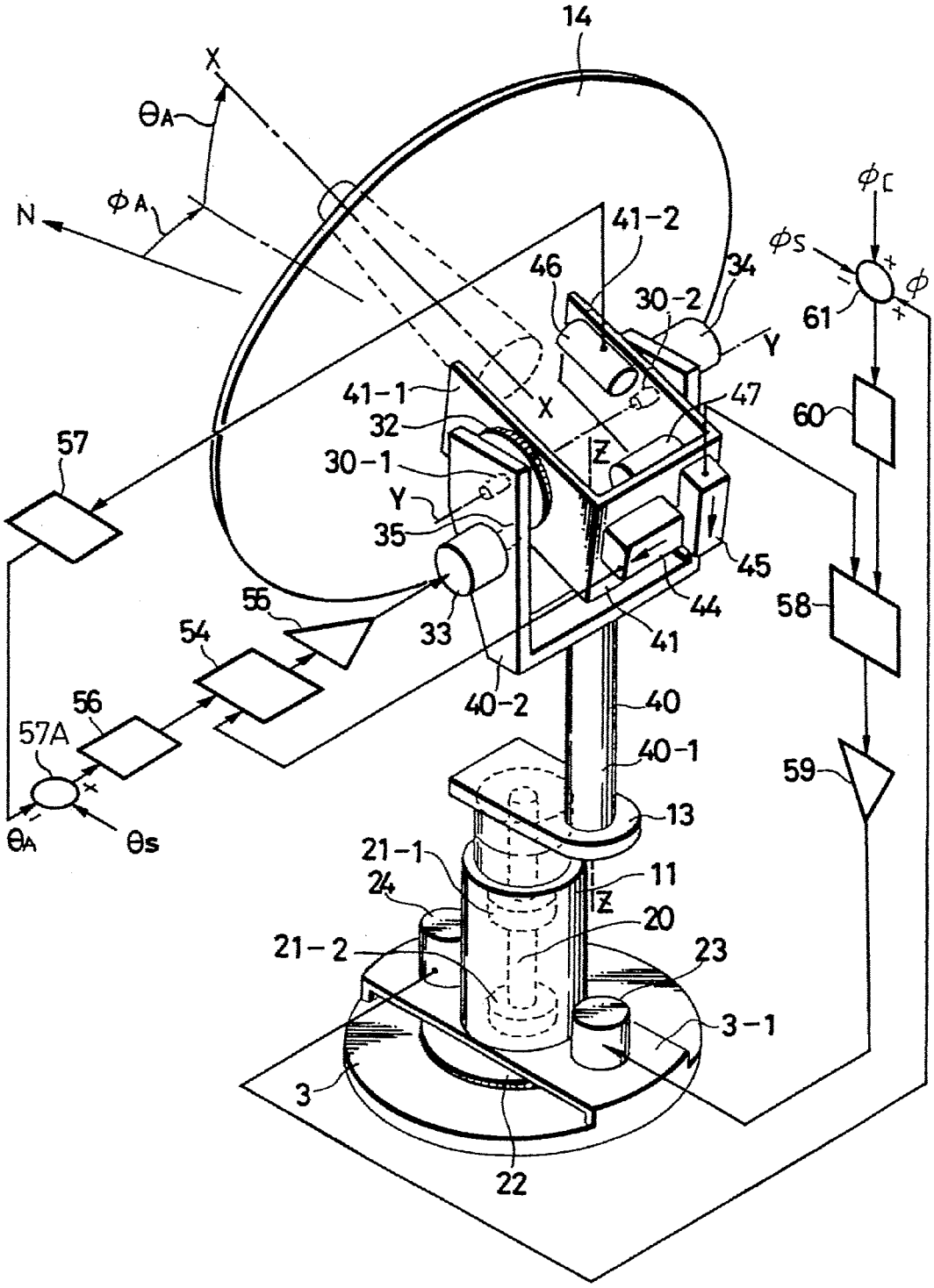
FIG. 1 (PRIOR ART)
FIG. 1 is a perspective view showing an example of a conventional antenna directing apparatus.
Figure 2:
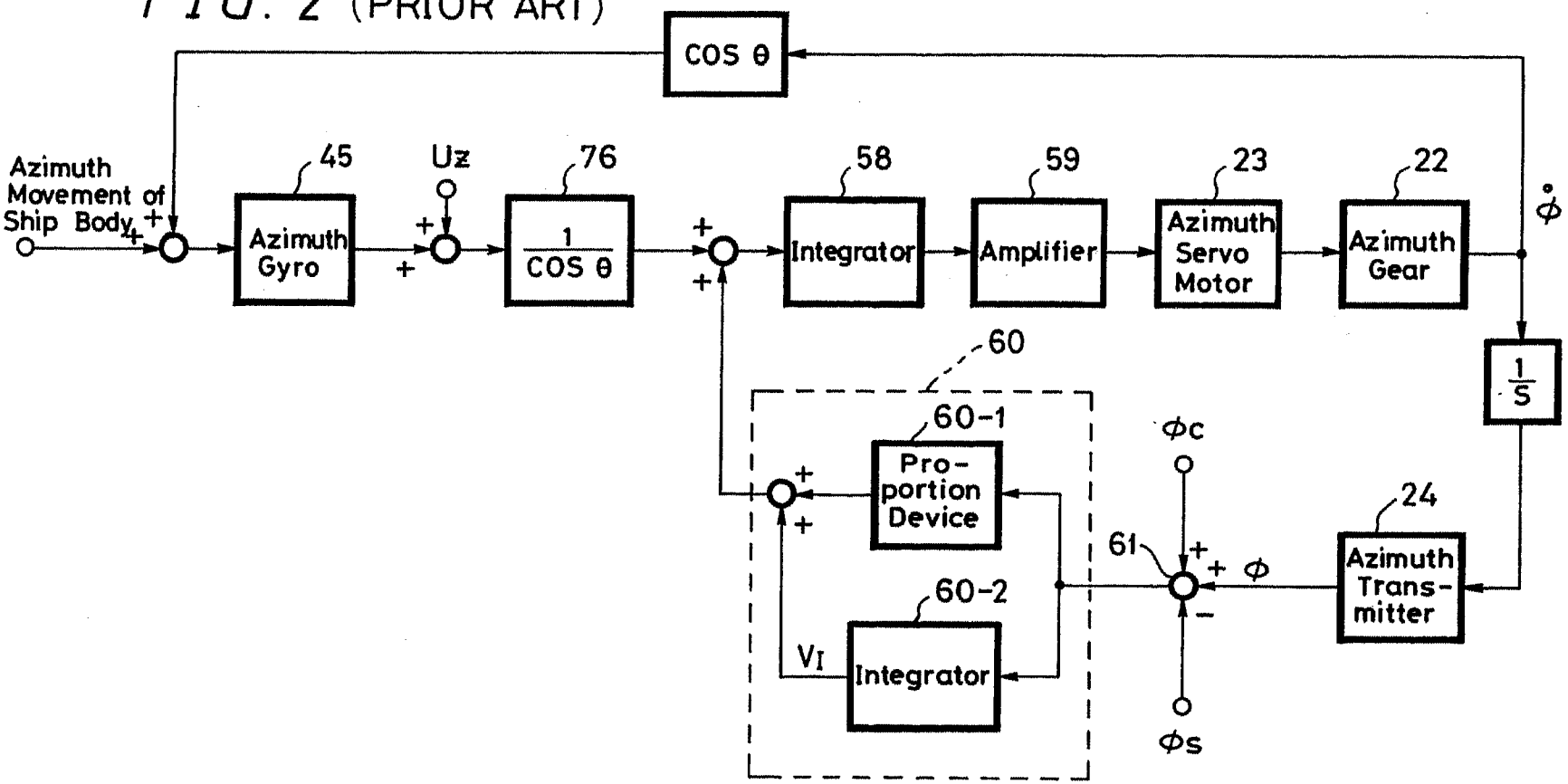
FIG. 2 (PRIOR ART)
FIG. 2 is a block diagram showing an example of the conventional antenna directing apparatus.
Figure 5:
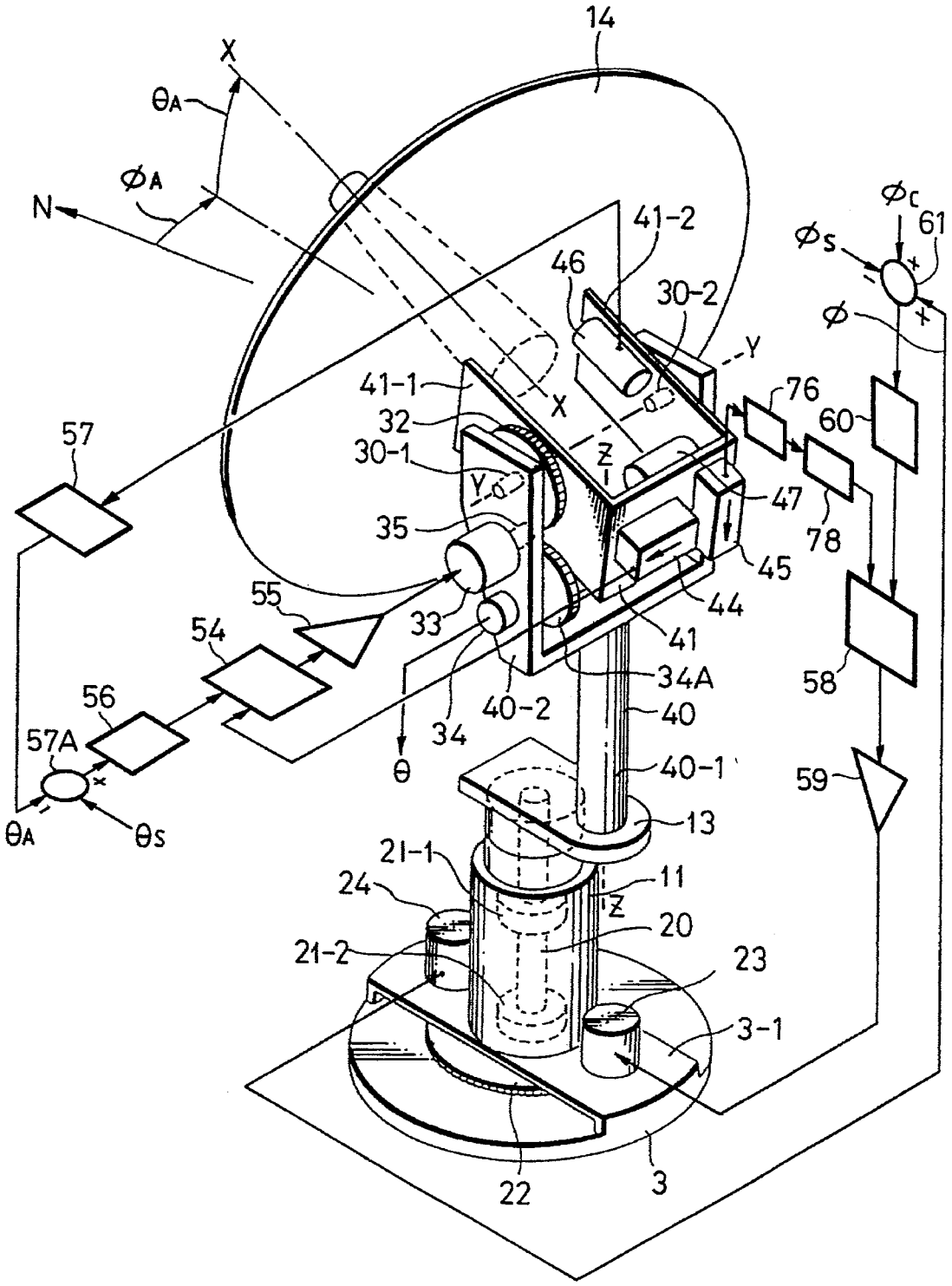
FIG. 5 is a perspective view showing a first embodiment of an antenna directing apparatus according to the present invention.

Embodiments of the present invention will hereinafter be described with reference to FIG. 5 and the following drawings. In FIG. 5, like parts corresponding to those of FIG. 1 are marked with the same references and therefore need not be further described in detail.

FIG. 5 shows the first embodiment of the antenna directing apparatus according to the present invention. As shown in FIG. 5, the antenna directing apparatus comprises the base 3, the azimuth gimbal 40 attached to the base 3, the attachment 41 to the U-shaped support 40-2 on the upper end portion of the azimuth gimbal 40 and the antenna 14 attached to the attachment 41.

On one leg of the U-shaped portion 40-2 of the azimuth gimbal 40, there is mounted the elevation transmitter 34 so as to be coaxial with or parallel to the elevation axis Y—Y. The elevation transmitter 34 includes an elevation transmitter gear 34A which is in engagement with the elevation gear 32°. A rotational displacement of the elevation axis Y—Y is detected via the elevation transmitter gear 34A. The elevation angle transmitter 34 detects the rotation angle of the antenna 14 around the elevation axis Y—Y, i.e., elevation angle θ and produces a signal indicative of such detected elevation angle θ.

To form the earlier mentioned third loop, a 1/cosθ calculating unit 76 and an ON/OFF device 78 are disposed at the output side of the azimuth gyro 45. The 1/cosθ calculating unit 76 calculates 1/cosθ by using the elevation angle θ supplied thereto from the elevation angle transmitter 34, and then multiplies the 1/cosθ to (dϕ/dt)·cosθ supplied thereto from the azimuth gyro 45. Thus, the 1/cosθ calculating unit 76 derives a signal that does not contain the elevation angle θ.

In this embodiment, if a transfer function of rotation angle ϕ of the antenna 14 after Laplace transform is calculated, then it is expressed by the following equation (6):

$$\phi = \frac{KK_T(\phi_s - \phi_c)}{S^2 + K \times S + KK_T} \tag{6}$$

In the above equation (6), the gain of the amplifier 59 is selected to be −K and the gain of the attenuator 60 is selected to be $K_T$. As described earlier, the frequency characteristic of the azimuth control loop is made constant regardless of the elevation angle of θ of the antenna by 1/cosθ calculating unit 76 so that even when the satellite altitude angle is substantially 90°, the control accuracy can be prevented from be lessened.

Further, 1/cosθ calculating unit 76 functions to prevent the servo system from diverging under the condition when the polarity of the input signal to the azimuth gyro 45 is inverted when the elevation angle θ exceeds 90°.

In the third loop of this embodiment, the output signal is fed to the integrator 58 via the ON/OFF device 78. The ON/OFF device 78 supplies the output signal from the 1/cosθ calculating unit 76 or interrupts the supply of the output signal dependent on the elevation angle θ received from the elevation angle transmitter 34, whereby the gimbal lock phenomenon,as described, can be avoided.

As shown in FIG. 5, the X-axis coincides with the central axis X—X of the antenna; the Y-axis coincides with the elevation angle axis Y—Y and the Z-axis coincides with the direction at a right angle perpendicular to both the X-axis and Y-axis. In the antenna directing apparatus having two axes, i.e., azimuth-elevation system, the angular velocity around the Z-axis, relative to the inertial space, is detected by the azimuth gyro 45 having an input axis parallel to the Z-axis. The signal, indicative of the angular velocity around the Z-axis, output from the azimuth gyro 45 is fed through the integrator 58 and the servo amplifier 59 back to the azimuth servo motor 23. As described above,the antenna 14 is stabilized relative to the inertial space so as not to rotate around the Z-axis, thereby preventing a direction error from being produced.

The above-mentioned function can be achieved for almost all of the elevation angle θ (even when θ exceed 90°) by the 1/cosθ calculating unit 76 even when there exists the elevation angle θ. However, when the satellite altitude angle $\theta_S$ is large and the ship's body rolls and pitches, it is frequently observed that the azimuth axis Z—Z and the central axis X—X of the antenna 14 become perfectly parallel to each other.

If, at that moment, an angular velocity occurs around the azimuth axis Z—Z of the antenna 14, such angular velocity is detected by the azimuth gyro 45 and the antenna 14 is rotated around the azimuth axis Z—Z by the azimuth servo motor 23. Although the azimuth control loop is constructed such that the rotation angular velocity of the azimuth servo motor 23 is normally fed back to the azimuth gyro 45 to eliminate the angular velocity around the azimuth axis Z—Z of the antenna 14, such feedback function becomes impossible at that moment. As described above, the output of the azimuth gyro 45 is maintained as input to the integrator 58 and the azimuth servo motor 23 is set in a kind of reckless running state.

According to the first embodiment of the present invention, the ON/OFF device 78 is operated by the control signal of elevation angle θ provided at the output side of the 1/cosθ calculating unit 76. Under normal operating conditions of the azimuth control loop where the elevation angle θ is in a range of from 90°±2°, the ON/OFF device 78 functions to interrupt the supply of the output signal of the 1/cosθ calculating unit 76, whereby the value of the integrator 58 is held constant.

When the elevation angle θ is in a range of from 90°±2°, the azimuth servo motor 23 is kept rotating at an angular velocity just below the level where azimuth servo motor 23 is placed in the reckless driving state. When the elevation angle θ exceeds a range of 90°±2°, the azimuth servo system is returned to the normal state and does not produce a directing error.

While the first embodiment of the present invention has been described so far, the present invention is not limited thereto and various modifications and variations could be effected therein by one skilled in the art without departing from the gist of the present invention.

While the antenna directing apparatus includes both the 1/cosθ calculator 76 and the ON/OFF device 78, the present invention is not limited thereto and may include only one of the 1/cosθ calculator 76 and the ON/OFF device 78.

The first embodiment of the present invention has the advantage that since the value of 1/cosθ is calculated from the elevation angle θ supplied from the elevation transmitter 34 and the value that results from multiplying the value 1/cosθ with the output signal supplied from the azimuth gyro 45 is supplied to the integrator 58, the frequency characteristic of the azimuth control loop formed by the azimuth gyro 45 becomes constant regardless of the elevation angle θ.

Another advantage of the first embodiment of the present invention lies in the fact that the accuracy by which the central axis X—X of the antenna 14 follows the satellite is improved and error prevented from being produced in the direction of the antenna 14.

Further, the present invention makes it possible to prevent the servo system from diverging when the polarity of the input signal to the azimuth gyro 45 is inverted because of the elevation angle θ of the antenna 14 exceeds 90°.

Since the elevation angle signal θ is supervised by the ON/OFF device 78 and the output of the 1/cosθ calculating unit is interrupted when the elevation angle signal θ is in the vicinity of 90°, it is possible to prevent the gimbal lock phenomenon.

Figure 6:
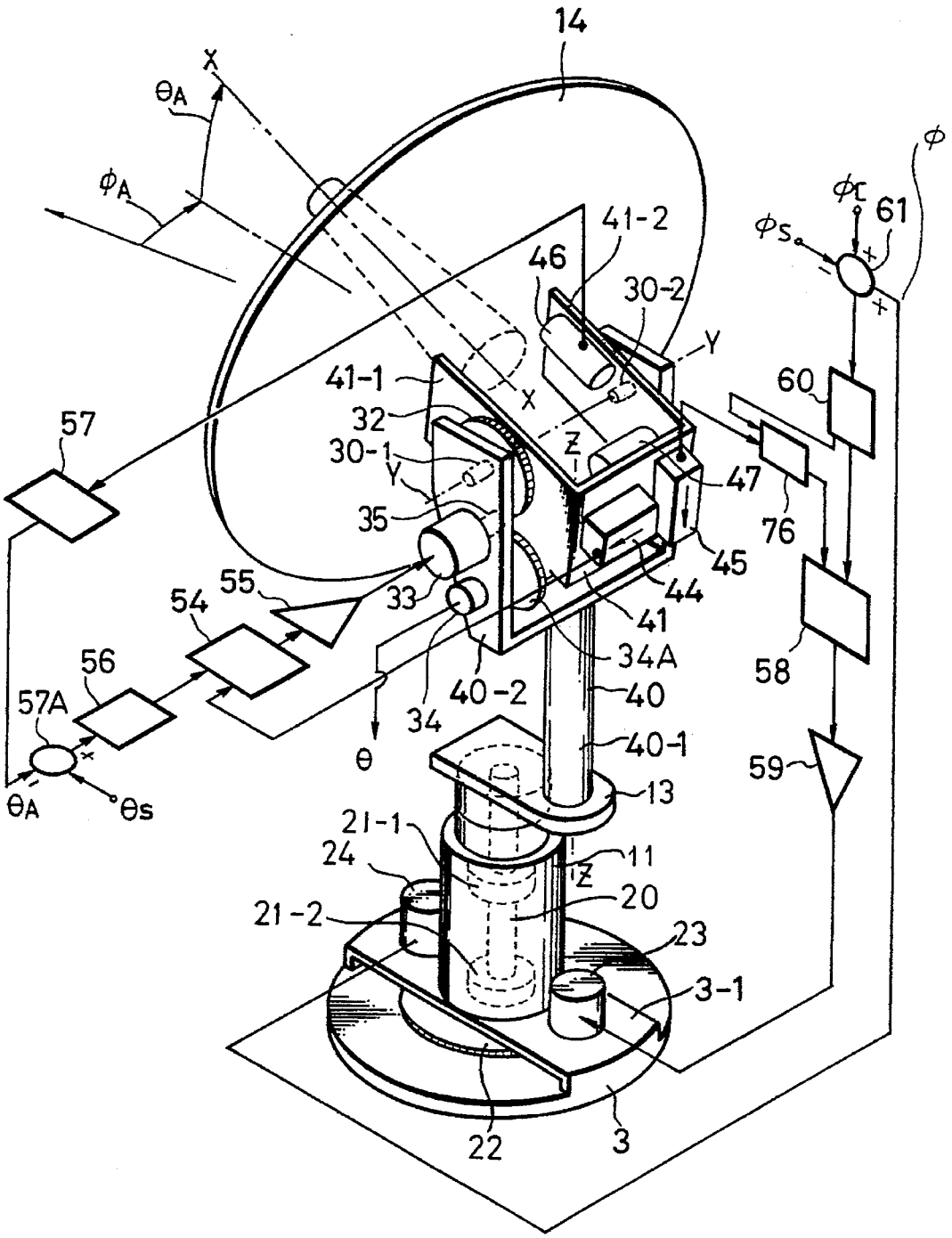
FIG. 6 is a perspective view showing a second embodiment of the antenna directing apparatus according to the present invention.
Figure 7:
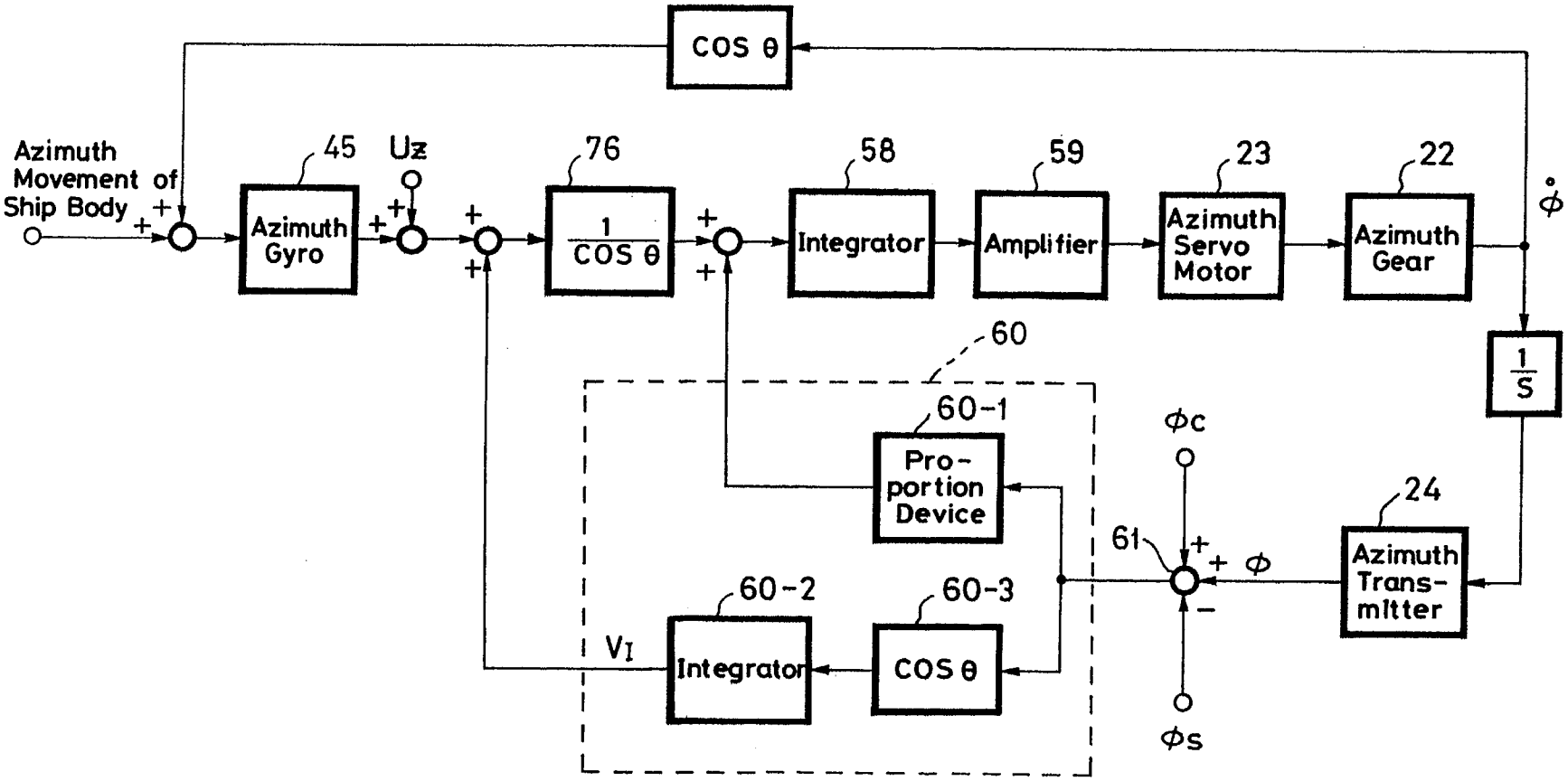
FIG. 7 is a block diagram showing the antenna directing apparatus shown in FIG. 6.

A second embodiment of the present invention will hereinafter be described with reference to FIGS. 6 and 7. In FIGS. 6 and 7, like parts corresponding to those of FIG. 5 are marked with the same references and therefore need not be described in detail.

FIG. 6 shows the second embodiment of the antenna directing apparatus according to the present invention.

In the fourth loop of the second embodiment, as shown in FIG. 7, the signal that indicates the rotation angle $\phi$ of the azimuth gimbal 40 is output from the azimuth transmitter 24. The output signal $\phi$ is supplied to the adder 62 in which it is calculated with the satellite azimuth angle $\phi_S$ and the ship's azimuth angle $\phi_C$ to thereby generate an azimuth deviation signal. This azimuth deviation signal is input through a proportion device 60-1 provided within the attenuator 60 to the integrator 58. On the basis of the elevation angle signal θ supplied from the elevation transmitter 34, the cosθ calculating unit 60-3 calculates cosθ and a value that results from multiplying cosθ and the azimuth deviation signal is supplied to a gyro drift compensation integrator 60-2. An output signal from the integrator 60-2 is fed back to the input of (1/cosθ) calculating unit 76 to thereby compensate for the fixed error of the azimuth gyro 45.

In the second embodiment, if the transfer function of the rotation angle $\phi$ of the antenna 14 after the Laplace transform is calculated, the transfer function is expressed by the following equations (7) and (8):

$$\phi = \frac{1}{\frac{Ti}{KK_T}S^3 + \frac{Ti}{K_T}S^2 + TiS + 1}\left[(Tis+1)(\phi_s - \phi SUBC) - \frac{TiS}{K_T}\cdot\frac{1}{\cos\phi}(U_z + V_l)\right] \quad (7)$$

$$V_l = \frac{1}{\frac{Ti}{KK_T}S^3 + \frac{Ti}{K_T}S^2 + TiS + 1}\left[-U_z + \left(\frac{1}{K_T}S + 1\right)\cdot\cos\phi\cdot S(\phi_s - \phi_c)\right] \quad (8)$$

If $\phi_C$, $\phi_S$, $U_Z$ are made constant and the final value is calculated wherein, then the equation (8) yields $V_l = -U_Z'$. Substituting this calculated result into the equation (7), we have:

$$\phi = \phi_S' - \phi_C - \frac{TiS}{K_T}\ \frac{1}{\cos\theta}(U_Z' - U_Z') = \phi_S' - \phi_C$$

Therefore, compensation of the fixed error $U_Z$ of the azimuth gyro 45 is made by the integrator 60-2 and the azimuth angle $\phi_A$ (=θ+$\phi_C$) of the antenna 14 becomes equal to the satellite azimuth angle $\phi_S$. Even when the elevation angle θ of the antenna 14 is changed by the rolling or time like of the ship's body, an angular error can be prevented from being generated in the rotation angle $\phi$ because the value that is multiplied with 1/cosθ is $U_Z'-U_Z'=0$. Consequently, the accuracy with which the antenna 14 is directed to the satellite is very excellent.

The reason the cosθ calculating unit 60-3 is required will be described below.

If the cosθ calculating unit 60-3 is not provided and the azimuth deviation signal, which is the output from the adder 61, is directly supplied to the gyro drift compensation integrator 60-2, then the transfer function of the rotation angle $\phi$ is expressed by the following equation (9):

$$\phi = \frac{1}{\frac{Ti\cos\theta}{KK_T}S^3 + \frac{Ti\cos\theta}{K_T}S^2 + Ti\cos\theta\cdot S + 1}\begin{bmatrix}(Ti\cos\theta\cdot S+1)(\phi_s - \phi_c) \\ -\frac{TiS}{K_T}(U_z + V_l)\end{bmatrix} \quad (9)$$

The denominator (characteristic equation) of the equation (9) contains cosθ so that the responsiveness of the system is changed with the value of cosθ becomes negative with the result that the coefficient of the above characteristic equation becomes negative, thereby the system is made unstable.

The above shortcoming can be eliminated as follows. That is, if the cosθ calculating unit 60-3 is provided, then the characteristic equation will contain no cosθ so that the response characteristic of the azimuth control loop can be made constant regardless of the elevation angle θ of the antenna 14.

While the second embodiment of the present invention has been described so far, it is apparent that the present invention is not limited thereto and that various changes and modifications could be effected therein by one skilled in the art without departing from the gist of the present invention.

According to the second embodiment of the present invention, since the value of cosθ is calculated from the elevation angle $\phi$ supplied from the elevation angle transmitter 34, the value that results from multiplying the value of cosθ with the azimuth deviation signal from the adder 61 is supplied to the gyro drift compensation integrator 60-2. The output signal of the integrator 60-2 is fed back to the input of the (1/cosθ) calculating unit 76, regardless of the elevation angle θ, and the fixed error of the azimuth gyro 45 can be compensated for and the response characteristic of the azimuth servo system can be made constant. Therefore, the accuracy with which the antenna 14 is directed to the satellite can be improved. Further, according to the second embodiment of the present invention, since the fixed error of the gyro can be compensated for, there can be utilized an angular velocity detection type gyro such as inexpensive vibratory gyro, rate gyro or the like.

A third embodiment of the present invention will be described with reference to FIGS. 8 to 10 where parts corresponding to those of FIG. 1 are marked with the same references and therefore need not be described in detail.

In the third embodiment of the present invention, the elevation control loop is arranged such that the antenna 14 is rotated around the elevation axis Y—Y so that the antenna elevation angle $\theta_A$ coincides with the satellite altitude angle $\theta_S$. This elevation angle control loop is different from the conventional elevation angle control loop shown in FIG. 1 in that this control loop includes a third accelerometer 48 attached to the attachment 41 and an antenna elevation angle calculating unit 81.

The antenna elevation calculating unit 81 is supplied with an output signal from an orthogonal-three-axis accelerometer formed of the first, second and third accelerometers 46, 47 and 48 and calculates the elevation angle $\theta_A$ of the antenna 14, i.e., an inclination angle of the central axis X—X of the antenna 14 relative to the horizontal plane. Such calculation requires that an arc tangent calculation be carried out from a tangent of the elevation angle $\theta_A$ of the antenna 14 to thereby calculate the value and the quadrant of the elevation angle $\theta_A$ of the antenna 14.

A function and operation of the antenna elevation angle calculating unit 81 will be described with reference to FIG. 9 which showing diagrammatically the relationship among a unit spherical surface having a radius 1, the central axis X—X of the antenna 14 (segment OX in FIG. 9), the elevation axis Y—Y (segments OY, OY' in FIG. 9) and the azimuth axis Z—Z (segments OZ. OZ' in FIG. 9).

Assuming that the ship's body surface (attaching surface of the apparatus) is rotated by the rotation angle $\xi$ around the elevation angle axis Y—Y (OY) relative to the horizontal plane and that it is further rotated by the rotation angle $\eta$ around another axis, e.g., ship's stern axis OE. The azimuth axis Z—Z perpendicular to the ship body surface (attaching surface) is moved from the segment OZ to the segment OZ' and the elevation angle axis Y—Y is moved from the segment OY to the segment OD. In this case, $\angle XOD=90°$.

Although the central axis X—X of the antenna 14 is also moved by the movement of the ship body surface, the central axis X—X of the antenna 14 is directed to the satellite under the control of the control loop. That is, the central axis X—X of the antenna 14 is moved to the position displaced from the segment OX and then moved to the segment OX again.

At that time, the elevation axis Y—Y is rotated around the azimuth axis OZ' by rotation angle $\Delta\phi$ and then moved from the segment OD to the segment OY'. In this case, $\angle XOY'=90°$. A segment OP that is perpendicular to both the central axis X—X and the elevation angle axis Y—Y of the antenna 14 is moved to the segment OP'.

The segments OX, OY and OP are segments which are perpendicular to each other having a length 1, and a triangle XYP becomes an equilateral spherical surface whose one side is $\pi/2$. Further, the segments OX, OY' and OP' are perpendicular to each other and each having a length 1. A triangle XY'P' becomes an equilateral spherical surface triangle whose one side is $\pi/2$. On the unit spherical surface, point X is connected to points P and P' with straight lines. An arc XP becomes perpendicular to the horizontal plane at point A and becomes perpendicular to a plane OY'P' at point P. An arc XP' becomes perpendicular to the ship's body surface (attaching surface) at point C and further becomes perpendicular to the plane OY'P' at point P'. A' becomes the foot of the perpendicular extending from point P to the horizontal plane and B' becomes the foot of the perpendicular extending from point Y' to the horizontal plane.

When the ship's body surface is in the horizontal plane, the first accelerometer 46 detects $\sin\angle XOA$, the second accelerometer 47 detects $\sin\angle YOB$ and the third accelerometer 48 detects $\sin\angle POA$. Since the elevation angle $\theta_A$ of the antenna 14 is equal to the satellite altitude angle $\theta_S$ and is the satellite elevation angle relative to the horizontal plane, $\angle XOA=\theta_A-90°$. Further, since $\angle XOP=90°$, $\angle POA=\angle XOA-\angle XOP=\theta_A$. In this case, a positive angle is represented in the direction of the satellite altitude angle $\theta_S$ relative to the horizontal plane and a negative angle is represented in the opposite direction. Accordingly, $\sin\theta_A$ is detected by the first accelerometer 46, $\sin\theta=0$ is detected by the second accelerometer 47 and $\sin(\theta_A-90°=-\cos\theta_A$ is detected by the third accelerometer 48.

The relationship between the value $\sin\theta_A$ detected by the first accelerometer 46 and the value $\sin(\theta_A-90°)=-\cos\theta_A$ detected by the third accelerometer 48 is expressed by the following equation (10):

$$\begin{aligned}\tan\theta_A &= \sin\theta_A/\cos\theta_A \\ &= \sin\theta_A/\sin(\theta_A-90°) \\ &= \sin\theta_A/\sin\angle POA\end{aligned} \tag{10}$$

When the ship's body surface is rotated by rotation angle $\xi$ around the elevation angle axis Y—Y (OY) relative to the horizontal plane and further rotated by rotation angle $\eta$ around the ship's body stern axis OE, $\sin\angle XOA$ is detected by the first accelerometer 46, $\sin\angle Y'OB'$ is detected by the second accelerometer 47 and $\sin\angle P'OA'$ is detected by the third accelerometer 48. Since the satellite altitude angle $\theta_A$ $(=\theta_A)$ is not related to the movement of the ship body surface, the value detected by the first accelerometer 46 is $\sin\angle XOA=\sin\theta_A$ and is not changed.

$\epsilon$ represents an angle formed by the segment OP and the segment OP', i.e., $\angle POP'=\angle Y'OY=\epsilon$ where $$\tan\epsilon=\sin\angle Y'OB'/\sin\angle P'OA' \tag{11}$$

Applying sine rule of spherical trigonometry to $\Delta A'$, YP' and $\Delta B'$ YY' we have:

$$\begin{aligned}\sin\angle AYP &= \sin\angle Y'OB'\sin\epsilon \\ &= \sin\angle P'OA'\cos\epsilon \\ &= \sin\angle POA\end{aligned} \tag{12}$$

Therefore, the following two equations are established:

$$\sin\angle Y'OB'=\sin\angle POA\cdot\sin\epsilon \tag{13}$$

$$\sin\angle P'OA'=\sin\angle POA\cdot\cos\epsilon \tag{14}$$

The above equations (13) and (14) are substituted as:

$$g_1=\sin\theta_A$$

$$g_2=\sin\angle Y'OB'$$

$$g_3=\sin\angle P'OA' \tag{15}$$

That is, $g_1$ assumes the output signal of the first accelerometer 46, $g_2$ assumes the output signal of the second accelerometer 47, and $g_3$ assumes the output signal of the third accelerometer 48. Substituting these output signals $g_1$, $g_2$ and $g_3$ into the equations (13), (14), multiplying $\sin\epsilon$ and $\cos\epsilon$ to them and solving $\sin\angle POA$, then we have:

$$\sin\angle POA=g_2\sin\epsilon+g_3\cos\epsilon \tag{16}$$

If the above equation (16) is substituted into the denominator of the equation (1), then we have the following equation (17):

$$\tan \theta_A = -g_1/(g_2 \sin \epsilon + g_3 \cos \epsilon \quad (17)$$

$$\tan \epsilon = g_2/g_3 \quad (18)$$

As described above, in the third embodiment, the value of the tangent of the elevation angle $\theta_A$ of the antenna 14 is obtained by the equations (17) and (18) and the elevation angle $\theta_A$ of antenna 14 is obtained by calculating the value of arc tangent of the calculated value of the tangent. Since the right side of the equation (17) takes positive and negative values, the quadrant of the elevation angle $\theta_A$ can be judged up to the fourth quadrant.

Figure 10:
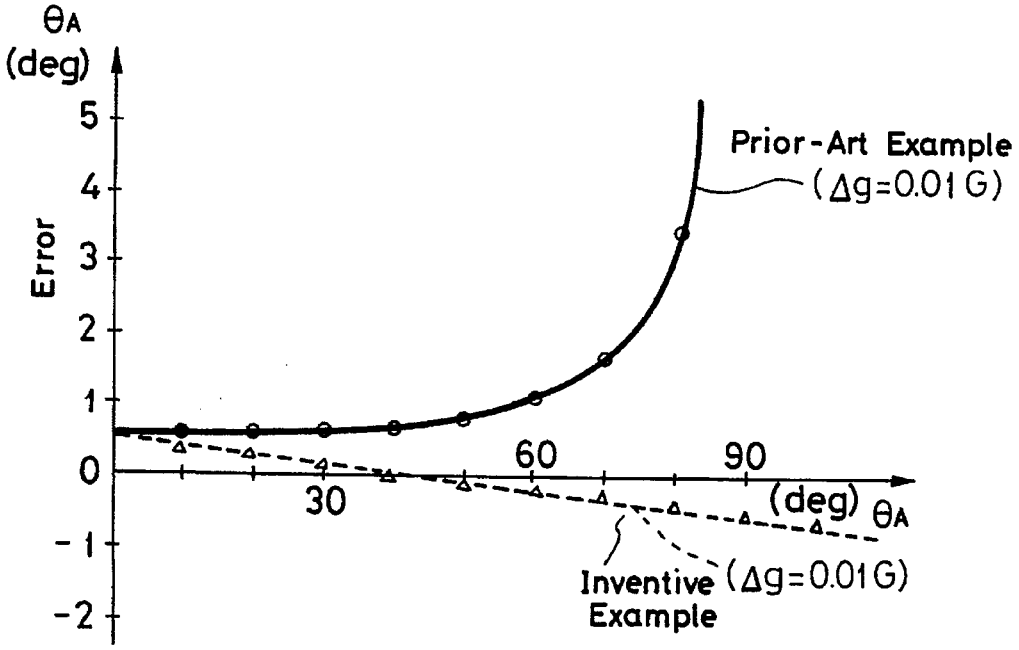
FIG. 10 is a diagram exemplifying how an error in the elevation angle of the antenna according to the third embodiment shown in FIG. 8 is calculated.

The accuracy of the elevation angle $\theta_A$ of the antenna 14 will be examined with reference to FIG. 10. Let it be assumed that an error $\Delta g$is contained in each of the outputs $g_1$, $g_2$ and $g_3$ of the three accelerometers 46, 47 and 48. In this case, $\epsilon=0$ for simplicity. This is equivalent to the fact that the ship's body surface is rotated by the rotation angle $\xi$ around the elevation angle axis Y—Y relative to the horizontal plane but is not rotated around the ship's stern axis OE. Substituting $\epsilon=0$ into the above equation (17), we have:

$$\tan \theta_A = -(g_1+\Delta g)/(g_3+\Delta g) \quad (19)$$

On the other hand, the example of the prior art yields:

$$\sin \theta_A = -g_1+\Delta g \quad (20)$$

FIG. 10 is a graph showing the measured results of the error in the elevation angle $\theta_A$ of the antenna 14 where $\Delta g=0.01$ (G). In FIG. 10, a solid line represents the error value of the elevation angle $\theta_A$ of the antenna 14 calculated by the equation (20) of the conventional example. The broken line represents the error value of the elevation angle $\theta_A$ of the antenna 14 calculated by the equation (19) of this embodiment. When the elevation angle $\theta_A$ of the antenna 14 reaches substantially 90°, the error value is increased in the prior art. However, according to the third embodiment, when the elevation angle $\theta_A$ of the antenna 14 reaches substantially 90°, the error value is small and less than 1. Further, according to the example of the prior art, if the elevation angle $\theta_A$ of the antenna 14 exceeds 80°, when the output of the first accelerometer 46 exceeds 1 G, the calculation frequently becomes impossible. However, according to the third embodiment of the present invention, regardless of the elevation angle $\theta_A$ of the antenna 14, the calculation is prevented from becoming impossible.

According to the conventional antenna directing apparatus, when the elevation angle $\theta_A$ of the antenna 14 is increased and changed from the first quadrant to the second quadrant, the arc sine calculator 57 cannot judge the quadrant so that the elevation angle $\theta_A$ of the antenna 14 cannot be directed to the satellite altitude angle $\theta_S$ by the second loop, thereby the directing error being increased. However, according to the third embodiment of the present invention, the elevation angle $\theta_A$ of the antenna 14 can be calculated accurately by the antenna elevation angle calculating unit 81 and the quadrant thereof can also be judged thereby so that when the elevation angle $\theta_A$ is increased and changed from the first quadrant to the second quadrant, the elevation angle $\theta_A$ of the antenna 14 can be directed to the satellite altitude angle $\theta_S$ with high accuracy.

While the third embodiment of the present invention has been described so far, it is apparent that the present invention is not limited thereto and that various changes and modifications could be effected therein by one skilled in the art without departing from the gist of the invention.

According to the third embodiment of the present invention, high accuracy in determining the elevation angle $\theta_A$ of antenna 4 is obtained since the antenna directing apparatus includes the third accelerometer 48 in addition to the first and second accelerometers 46 and 47 and the elevation angle $\theta_A$ of the antenna 14 is calculated by the antenna elevation angle calculating unit 81 in an arc tangent calculation fashion, even when the satellite altitude angle $\theta_S$ is large. There is then the advantage that the elevation angle $\theta_A$ of antenna 14 can be directed to the satellite angle $\theta_S$.

According to the third embodiment of the present invention, the antenna directing apparatus includes the third accelerometer 48 in addition to the first and second accelerometers 46 and 47 and the elevation angle $\theta_A$ of antenna 14 is calculated by the antenna elevation angle calculating unit 81 in an arc tangent calculation fashion. Therefore, even when the elevation angle $\theta_A$ of antenna 14 is increased and changed from the first quadrant to the second quadrant, the change of quadrant is also detected. Therefore, the elevation angle $\theta_A$ of antenna 14 can be directed to the satellite altitude angle $\theta_S$ accurately.

Further, according to the third embodiment of the present invention, the antenna directing apparatus includes the third accelerometer 48 in addition to the first and second accelerometers 46 and 47 and the elevation angle $\theta_A$ of antenna 14 is calculated by the antenna elevation angle calculating unit 81 in an arc tangent calculation fashion. Consequently, even when a large error is contained in the output of the first accelerometer 46, if the error contained in the second and third accelerometers 47 and 48 is small, the elevation angle $\theta_A$ of antenna 14 will be calculated with high accuracy. There is then the advantage that the elevation angle $\theta_A$ of antenna 14 can be directed to the satellite altitude angle $\theta_S$ accurately.

Furthermore, according to the third embodiment of the present invention, when the satellite altitude angle $\theta_S$ is large, even if the output of the first accelerometer 46 exceeds 1 G, the calculation can be prevented from becoming impossible unlike the prior art and the elevation angle $\theta_A$ of antenna 14 can be calculated accurately by the antenna elevation angle calculating unit 81. There is then the advantage that the elevation angle $\theta_A$ of antenna 14 will be directed to the satellite altitude $\theta_S$ accurately.

Figure 8:
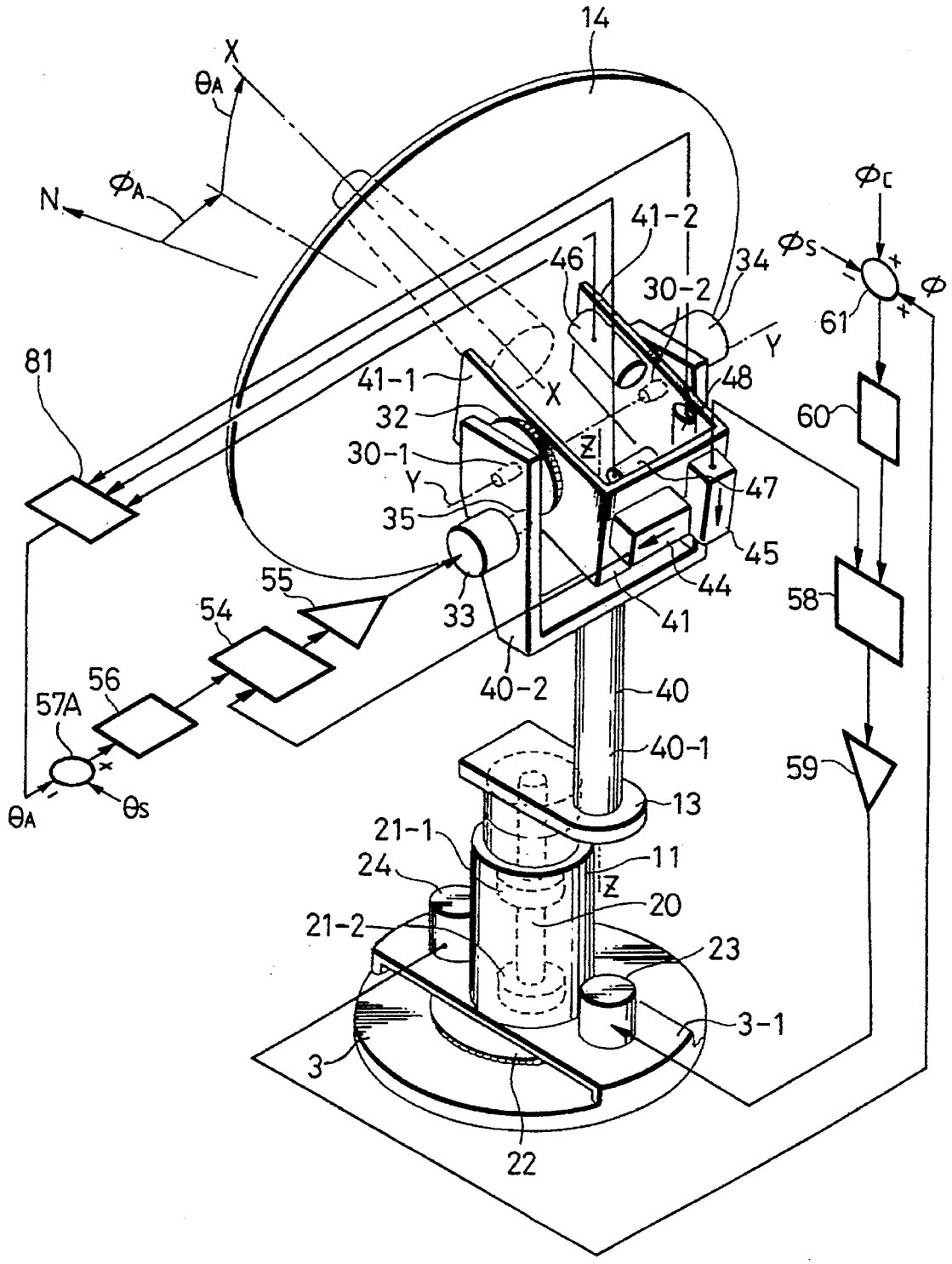
FIG. 8 is a perspective view showing a third embodiment of the antenna directing apparatus according to the present invention.
Figure 9:
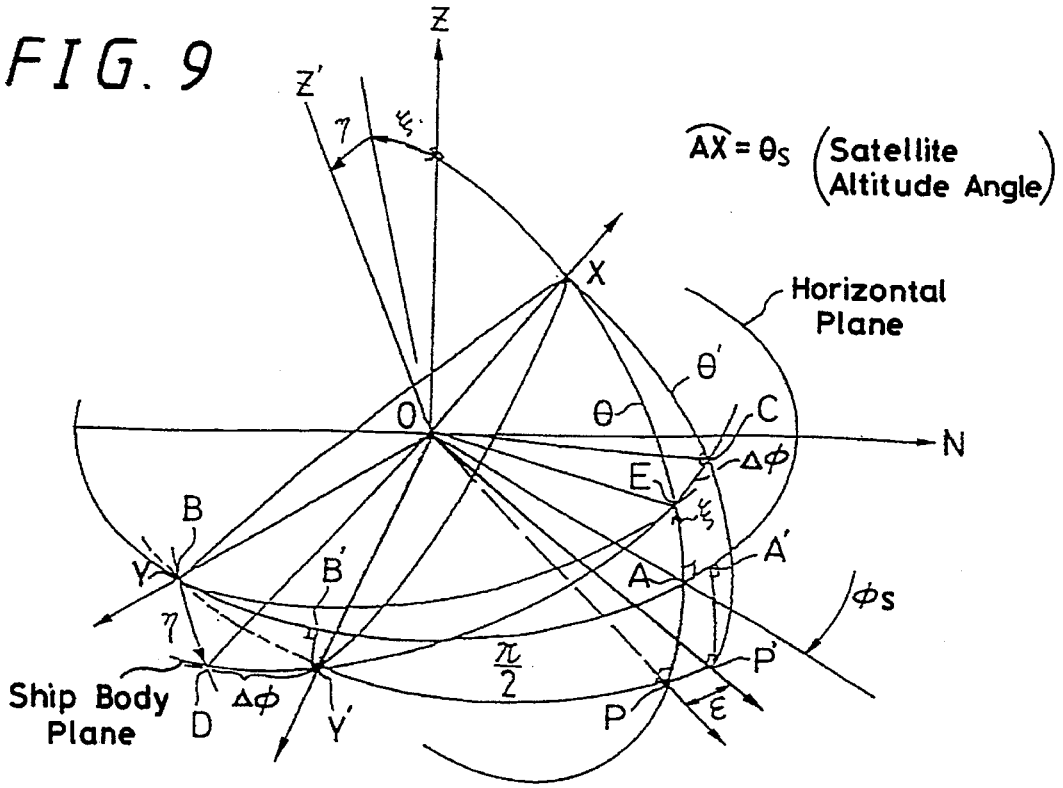
FIG. 9 is a diagram showing the outputs of the three accelerometers used in the third embodiment of the present invention.

A fourth embodiment of the present invention will hereinafter be described with reference to FIGS. 11 and 12 where again like parts corresponding to those of FIG. 8 are marked with the same references and therefore need not be described in detail.

In the fourth embodiment of the present invention, the azimuth angle control loop is arranged such that the antenna 14 is rotated around the azimuth axis Z—Z so that the azimuth angle $\phi_A$ of the antenna 14 coincides with the azimuth angle $\phi_S$ of the satellite. To this end, in addition to the third embodiment, there is provided a new inclination correction calculating unit 93.

The inclination correction calculating unit 93 is supplied with the signal representative of the rotation angle $\theta$ of the antenna 14 around the elevation axis Y—Y; the signal being output from the elevation angle transmitter 34. A signal representative of a sine value sinx of an inclination angle x of the elevation angle Y—Y relative to the horizontal plane is output from the second accelerometer 47 and a signal representative of a sine value $\sin\theta_P$ of an inclination angle $\theta_P$ of an axis perpendicular to both the central axis X—X and the elevation axis Y—Y of the antenna 14 relative to the horizontal plane is output from the third accelerometer 48. The calculating unit 93 then calculates the inclination correction value $\Delta\phi_A$.

The function and operation of the inclination correction calculating unit 93 will be described with reference to FIG. 12.

Figure 12:
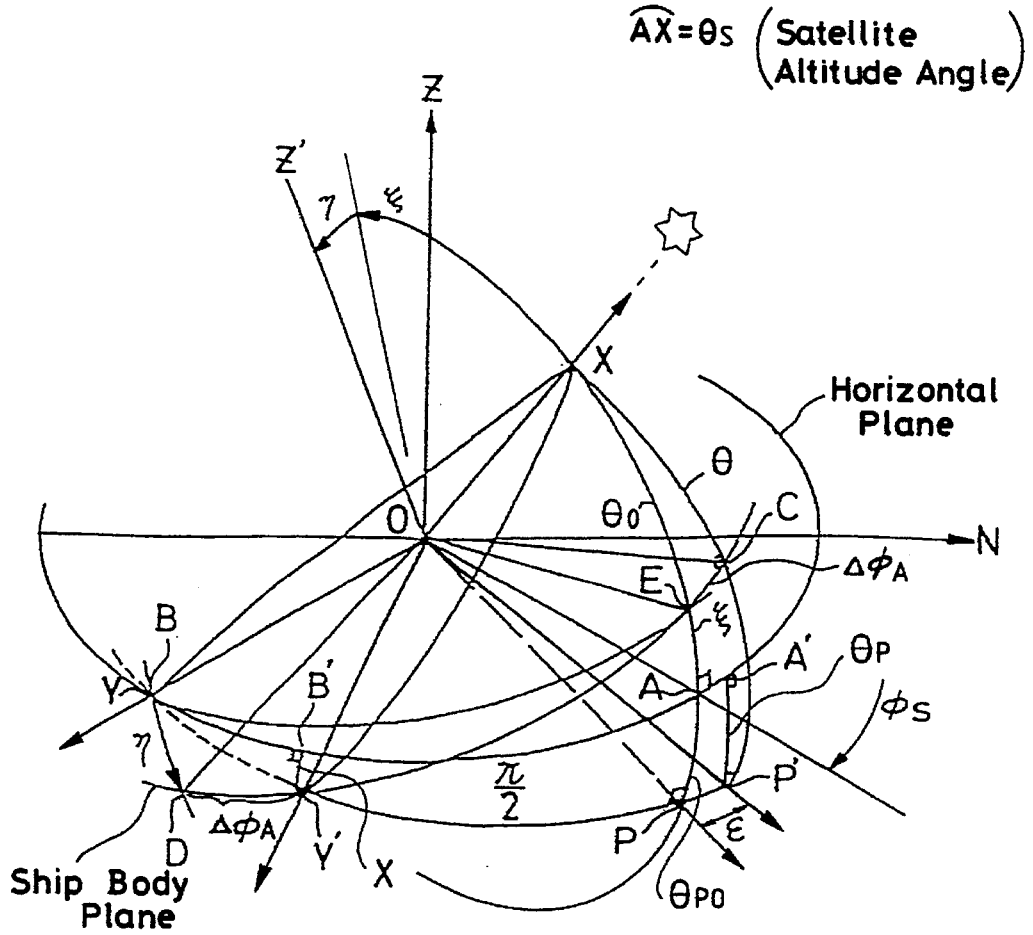
FIG. 12 is a diagram exemplifying the function of the inclination correction calculating unit in the fourth embodiment shown in FIG. 11.

FIG. 12 is a diagram showing relationship among a unit spherical surface having a radius 1, the central axis X—X of the antenna 14 (segment OX in FIG. 12), the elevation angle axis Y—Y (segments OY, OY' in FIG. 12), the azimuth axis Z—Z (segments OZ, OZ' in FIG. 12), and an axis (segments OP, OP' in FIG. 12) perpendicular to both the central axis X—X and the elevation angle axis Y—Y of the antenna 14. The azimuth axis Z—Z is constantly perpendicular to the ship's body surface (attaching surface of the antenna 14).

Let it be assumed that the ship's body surface is rotated by the rotation angle $\xi$ around the elevation angle axis Y—Y (OY) relative to the horizontal plane and that it is further rotated by the rotation angle $\eta$ around another axis, e.g., ship's stern axis OE. Then, the azimuth axis Z—Z is moved from the segment OZ to the segment OZ' and the elevation angle axis Y—Y is moved from the segment OY to the segment OD. In this case, $\angle XOD=90°$.

Although the central axis X—X of the antenna 14 is also moved by the movement of the ship's body surface, the central axis X—X of the antenna 14 remains in the satellite direction under the control of the control loop. That is, the central axis X—X of the antenna 14 is moved to the position displaced from the segment OX and then moved to the segment OX again.

Under the above control, the elevation axis Y—Y is rotated around the azimuth axis OZ' rotation angle $\Delta\phi_A$ and then moved from the segment OD to the segment OY'. In this case $\angle XOY'=90°$. A segment OP that is perpendicular to both the central axis X—X and the elevation angle axis Y—Y of the antenna 14 is moved to the segment OP'. Finally, the segment OY is moved to the segment OY' via the segment OD. Thus, $\angle POP'=\angle Y'OY$ and arc PP'=arc Y'Y.

The segments OX, OY and OP are segments which are perpendicular to each other having a length 1, and a triangle XYP becomes an equilateral spherical surface triangle whose one side is $\pi/2$.

Further, the segments OX, OY' and OP' are perpendicular to each other, each having a length 1. The triangle XY'P' becomes an equilateral spherical surface triangle whose one side is $\pi/2$. On the unit spherical surface, point X is connected to points P and P' by straight lines. An arc XP becomes perpendicular to the horizontal plane at point A and becomes perpendicular to a plane OY'P' at point P. An arc XP' becomes perpendicular to the ship's body surface (attaching surface of the antenna 14) at point C and further becomes perpendicular to the plane OY'P' at point P'. A' becomes the foot of the perpendicular extending from point P to the horizontal plane and B' becomes the foot of the perpendicular extending from point Y' to the horizontal plane. $\angle XOA-\theta_0$=arc XA, $\angle POA-\theta_{PO}$=arc PA, $\angle BOD=\eta$=arc BD, $\angle XOC=\theta$=arc XC, $\angle P'OA'=\theta_P$=arc P' A', and $\angle Y'OB'=x$=arc Y'B'.

The first accelerometer 46 is mounted along the segment OX, the second accelerometer 47 is mounted along the segment OY, and the third accelerometer 48 is mounted along the segment OP.

When the ship's body surface is in the horizontal plane, the elevation transmitter 34 outputs an inclination angle $\angle XOA=\theta_0$ of the central axis X—X of the antenna 14 relative to the ship's body surface. The second accelerometer 47 detects $\sin\angle YOB=\sin\theta=0$ and the third accelerometer 48 detects $\sin\angle POA=\sin\theta_{PO}$. The first accelerometer 46 detects $\sin\angle XOA=\sin\theta XOA=\sin\theta_0$.

When the ship's body surface is rotated the rotation angle $\xi$ around the elevation axis Y—Y (OY) relative to the horizontal plane and is further rotated the rotation angle $\eta$ around the ship's stern axis OE, the elevation angle transmitter 34 outputs an inclination angle $\angle XOC=\theta$ of the central axis X—X of the antenna 14 relative to the ship body surface. The second accelerometer 47 detects $\sin\angle Y'OB'=\sin x$ and the third accelerometer 48 detects $\sin\angle P'OA'=\sin\theta_P$.

Since the satellite altitude angle $\theta_S$ ($=\theta_A$) is not related to the movement of the ship's body surface, the value $\sin\angle XOA=\sin\theta_0$ detected by the first accelerometer 46 is not changed.

Then, the inclination correction value $\Delta\theta_A$ is calculated. $\Delta\phi_A$=arc EC–arc DY'. Applying the sine rule of spherical trigonometry yields the following equation (21):

$$\sin\Delta\phi_A=\tan\eta\cdot\tan\theta$$

$$\sin x-\sin\eta\cdot\cos\theta_S/\cos\theta$$

$$\sin^2 x+\sin^{2\theta}{}_P=\cos^{2\theta}{}_S \tag{21}$$

If $\Delta\phi_A$ is obtained from the first and second equations of the equation (21), the following equation (22) is obtained:

$$\tan\Delta\phi_A=\frac{\sin\theta\cdot\sin x}{\sqrt{(\cos^2\theta_S-\sin^2 x)}} \tag{22}$$

If the right side of the equation (22) is modified by utilizing the third equation of the equation (21), the following equation (23) is obtained.

$$\tan\Delta\phi_A=\sin\theta\cdot\sin x/\sin\theta_P \tag{23}$$

The equation (23) becomes an inclination correction equation of this embodiment.

As described above, the inclination angle $\theta$ of the central axis X—X of the antenna 14 relative to ship's body surface is obtained from the elevation angle transmitter 34. The sine value sinx of the inclination angle x of the elevation axis Y—Y relative to the horizontal plane is obtained from the second accelerometer 47. Then, the inclination angle $\theta_P$ of the axis perpendicular to both the central axis X—X and the elevation axis Y—Y of the antenna 14 relative to the horizontal plane is obtained from the third accelerometer 48.

As described above, according to the fourth embodiment of the present invention, the value of the tangent of the inclination correction value $\Delta\phi_A$ of the rotation angle $\phi$ of the azimuth gimbal 40 is obtained by calculating the value of the arc tangent thereof.

Figure 11:
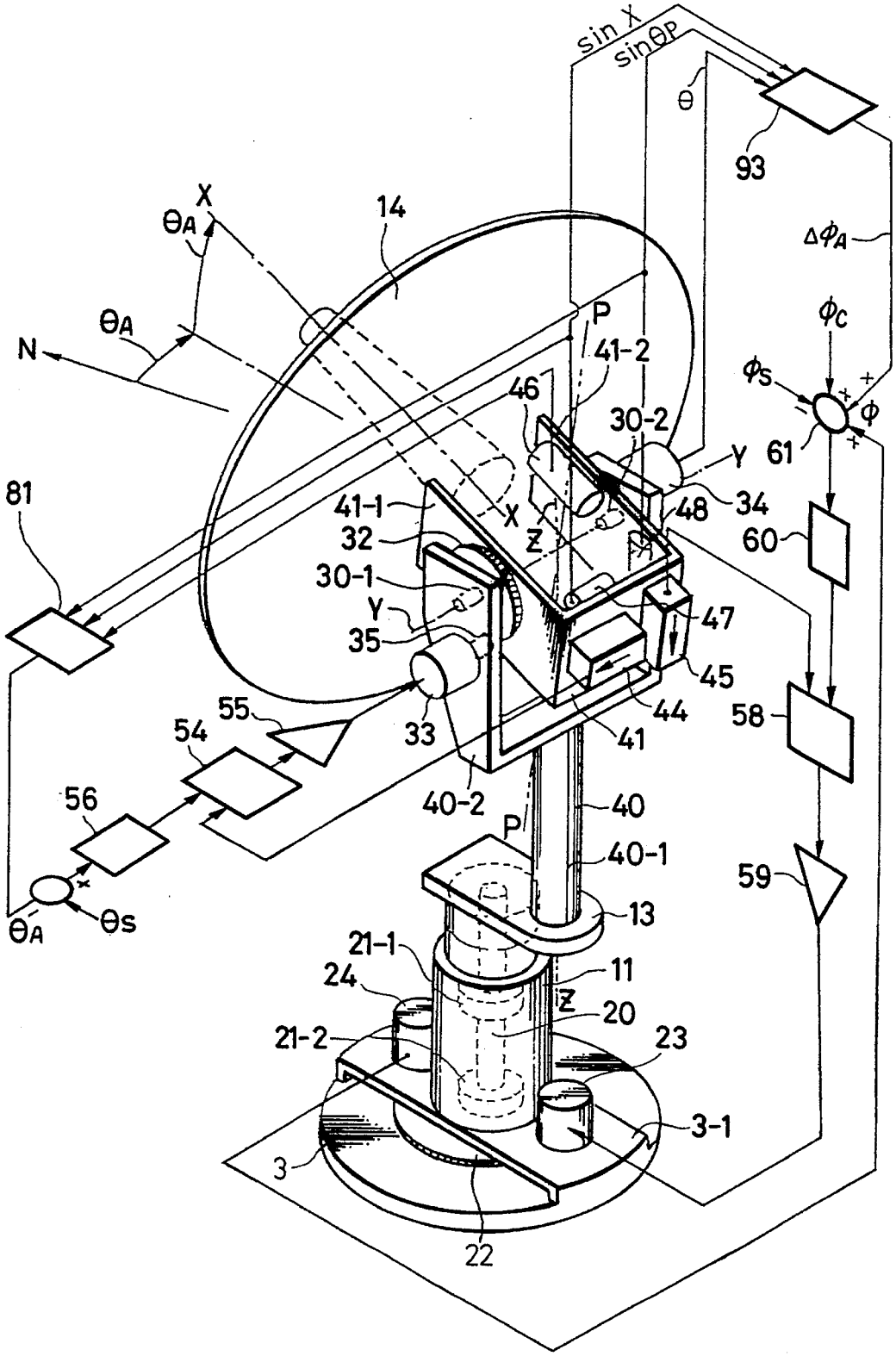
FIG. 11 is a perspective view showing a fourth embodiment of the antenna directing apparatus according to the present invention.

Referring to FIG. 11, the inclination correction value $\Delta\phi_A$ obtained by the inclination correction calculating unit 93 is supplied to the adder 61. When the output of the adder 61 becomes zero, i.e., the sum of the rotation angle $\phi$ of the antenna 14, the ship's heading azimuth angle $\phi_C$ and the inclination correction value $\Delta\phi_A$ becomes equal to the satellite azimuth angle $\phi_S$, the azimuth of the antenna 14 is settled.

The denominator of the right side in the equation (23) becomes zero when $\theta_P=0$, or when the central axis X—X of the antenna 14 is directed to the zenith. Therefore, according to the fourth embodiment, by the calculation of the inclination correction value $\Delta\phi_A$ in the inclination correction calculating unit 93, the calculation does not become impossible only when the central axis X—X of the antenna 14 is directed to the zenith. In such case, upon calculating the arc tangent in the equation (23), $\Delta\phi_A=\pm 90°$ is established.

The respective terms of the right side in the equation (23) take positive and negative values, so that the value of the left side in the equation (23) takes positive and negative values correspondingly. Thus, when the inclination correction value $\Delta\phi_A$ exceeds $\pm 90°$, the quadrant thereof can be determined.

According to the fourth embodiment of the present invention, since the inclination correction value $\Delta\phi_A$ is calculated in the equation (23) by the inclination correction calculating unit 93, the calculation of the inclination correction value $\Delta\phi_A$ can be prevented from becoming impossible. Therefore, even when the ship's body rolls or pitches rapidly, the azimuth angle $\phi_A$ of the antenna 14 can be obtained with high accuracy. Thus, the antenna 14 can be directed to the satellite direction accurately.

According to the fourth embodiment of the present invention, since the inclination correction value $\Delta\phi_A$ can be calculated in the equation (23) by the inclination correction calculating unit 93, the quadrant of the inclination correction value $\Delta\phi_A$ can be determined. Therefore, even when the ship body rolls or pitches rapidly, the azimuth angle $\phi_A$ of the antenna 14 can be obtained with high accuracy. Thus, the antenna 14 can be directed to the satellite direction accurately.

Figure 13:
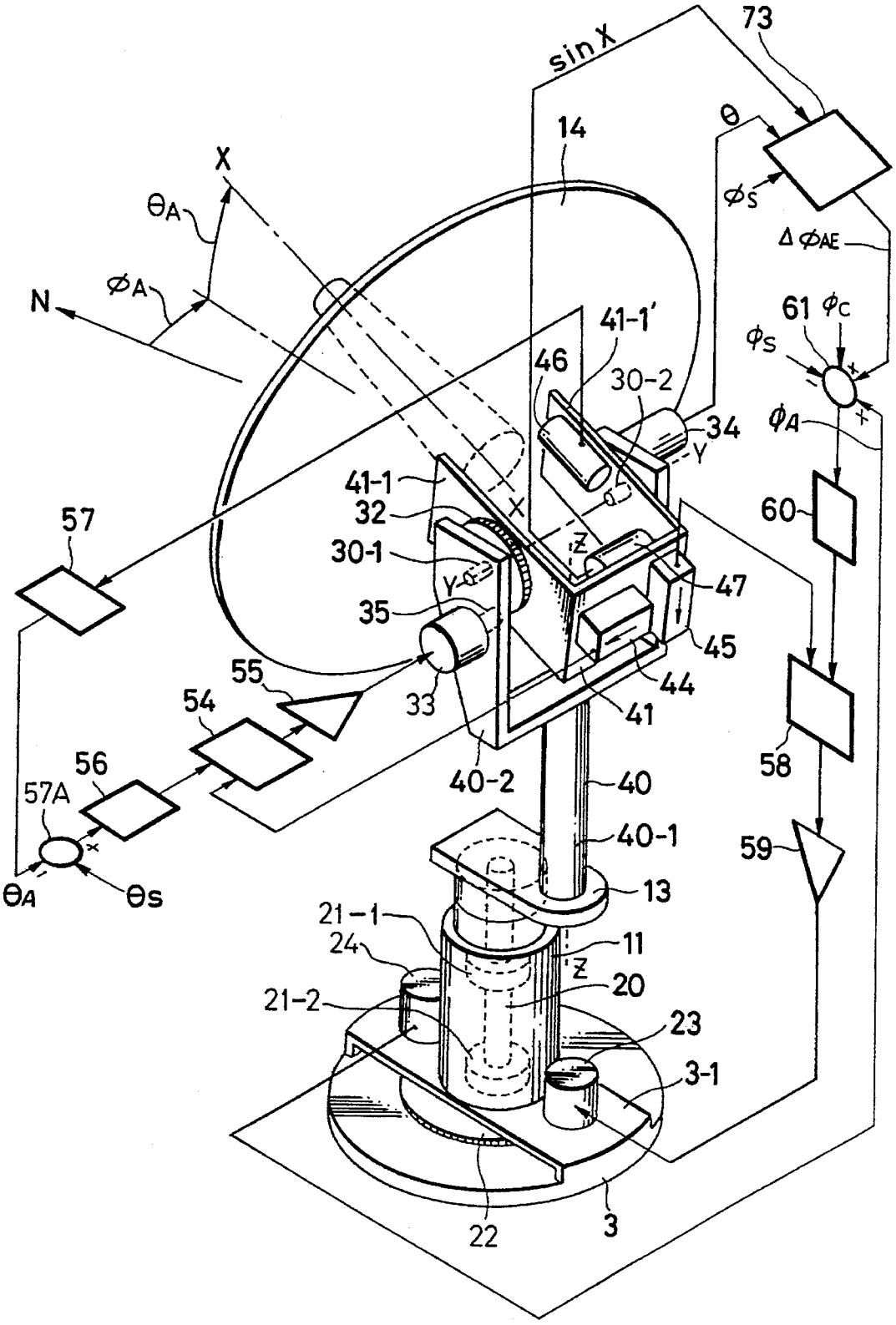
FIG. 13 is a perspective view showing a fifth embodiment of the antenna directing apparatus according to the present invention.

A fifth embodiment of the present invention will hereinafter be described with reference to FIG. 13. In FIG. 13, like parts corresponding to those of FIG. 5 are marked with the same references and therefore need not be described in detail.

The antenna directing apparatus according to the fifth embodiment includes the first to fourth loops similar to those of the first embodiment of the present invention shown in FIG. 5. This antenna directing apparatus further includes a fifth loop and the fifth loop includes an azimuth error calculator 73.

As shown in FIG. 13, the azimuth error calculator 73 is supplied with a signal representative of the inclination angle x of the elevation axis Y—Y relative to the horizontal plane from the second accelerometer 47 and a signal representative of the rotation angle θ of the antenna 14 around the elevation angle axis Y—Y from the elevation angle transmitter 34.

the azimuth error calculator 73 calculates the azimuth error $\Delta\phi_{AE}$ from the signal θ of the elevation angle transmitter 34 and the signal x or sinx from the second accelerometer 47 on the basis of the aforesaid equation (5).

The azimuth error $\Delta\phi_{AE}$ input to the adder 61 and is thereby added to the rotation angle ϕ of antenna from the azimuth transmitter 24. Therefore, the adder 61 calculates the satellite azimuth $\phi_S$, the ship's azimuth $\phi_C$, the antenna rotation angle $\phi_A$ and the azimuth error $\Delta\phi_{AE}$. Then, the azimuth of the antenna 14 is controlled so that the calculated result of four calculations becomes zero.

As described above, since the azimuth error $\Delta\phi_{AE}$ is input to the adder 61, the error contained in the rotation angle ϕ of the antenna (or azimuth gimbal) due to the ship's body inclination angle (θ, x) can be corrected and the more accurate azimuth of the antenna 14 can be obtained.

When a stepping motor is used as the elevation servo motor 35, there may be provided a counter circuit that accumulates a step angle command signal for the stepping motor, which can be utilized instead of the above elevation transmitter.

According to the fifth embodiment of the present invention, there is then the advantage that even when the satellite altitude angle is large and the ship body rolls or is in the inclined state at a predetermined inclination angle, the output from the azimuth transmitter 24 can be corrected for the error caused by the inclination angle of the ship body and then outputted.

Furthermore, according to the fifth embodiment of the present invention, there is then the advantage that even when the satellite altitude angle is large and the ship body rolls or is in the inclined state at a predetermined inclination angle, the output from the azimuth transmitter 24 can be corrected for the error caused by the inclination angle of the ship body and then outputted. Therefore, an error can be avoided from being generated in the control of the antenna 14 direction.

A sixth embodiment of the present invention will hereinafter be described with reference to FIG. 14 where like parts corresponding to those of the example of the prior art shown in FIG. 1 are marked with the same references and therefore need not be described in detail.

A fundamental principle of the sixth embodiment of the present invention lies in that even when the ship's body is set in any rolled state, such rolling movement of the ship body can always be considered as the rotation movement around one rotation axis within the horizontal plane. Accordingly, if the azimuth gimbal is controlled so that the elevation angle axis Y—Y of the azimuth gimbal is constantly marched with the rotation axis, then the central axis X—X of the antenna 14 can constantly be directed to the zenith direction.

According to the sixth embodiment of the present invention, a rotation angle θ of the antenna 14 around the elevation axis Y—Y is detected by the elevation transmitter 34 attached to one leg 41-2 of the U-shaped portion 41 of the azimuth gimbal 40. Then, the rotation angle θ and the satellite altitude angle $\theta_S$ are compared with each other by the comparator 62 and a signal that represents a rotation angle ξ ($=\theta_S-\theta$) of the ship's body around the elevation axis Y—Y is produced.

The sixth embodiment of the antenna directing apparatus according to the present invention has the first and second loops similar to those of the example of the prior art shown in FIG. 1 and is different in the arrangements of the third and fourth loops from those of the prior art shown in FIG. 1.

According to the sixth embodiment of the present invention, the third loop includes the azimuth gyro 45, second accelerometer 47, the azimuth transmitter 24, an elevation angle inclination calculator 80, an azimuth of inclination axis calculator 85, the amplifier 59 and the azimuth servo motor 23. Signals representative of the rotation angular velocity $\omega_P$ of the antenna 14 around the axis perpendicular to both the elevation axis Y—Y and the central axis X—X of the antenna 14 output from the azimuth gyro 45 and an inclination angle η of the elevation axis Y—Y output from the second accelerometer 47 are input to the elevation axis inclination calculator 80. Then, an inclination angle η of the elevation angle axis Y—Y relative to the horizontal plane is calculated by the elevation angle axis inclination calculator 80.

The inclination axis azimuth calculator 85 is supplied with signals representative of the inclination angle η of the elevation axis Y—Y relative to the horizontal plane output from the elevation axis inclination calculator 80, the rotation angle ξ of the ship's body around the elevation angle axis Y—Y produced from the elevation angle transmitter 34 and the rotation angle ϕ of the antenna 14 produced from the azimuth transmitter 24. The inclination axis azimuth calculator 85 calculates an inclination axis azimuth $\phi_T$ from the inclination angle η of the elevation axis Y—Y and the rotation angle ξ of the ship body. Such inclination axis azimuth $\phi_T$ is compared with the rotation angle ϕ of antenna 14 from the azimuth transmitter 24 to thereby calculate the azimuth deviation signal Δϕ.

The signals representative of the inclination axis azimuth $\phi_T$ and the antenna rotation angle θ are output from the inclination axis azimuth calculator 85 to the amplifier 59 and further supplied from the amplifier 59 to the azimuth servo motor 23. As described above, the azimuth gimbal 40 is controlled such that the inclination axis azimuth $\phi_T$ is matched with the azimuth of the elevation angle axis Y—Y.

Figure 14:
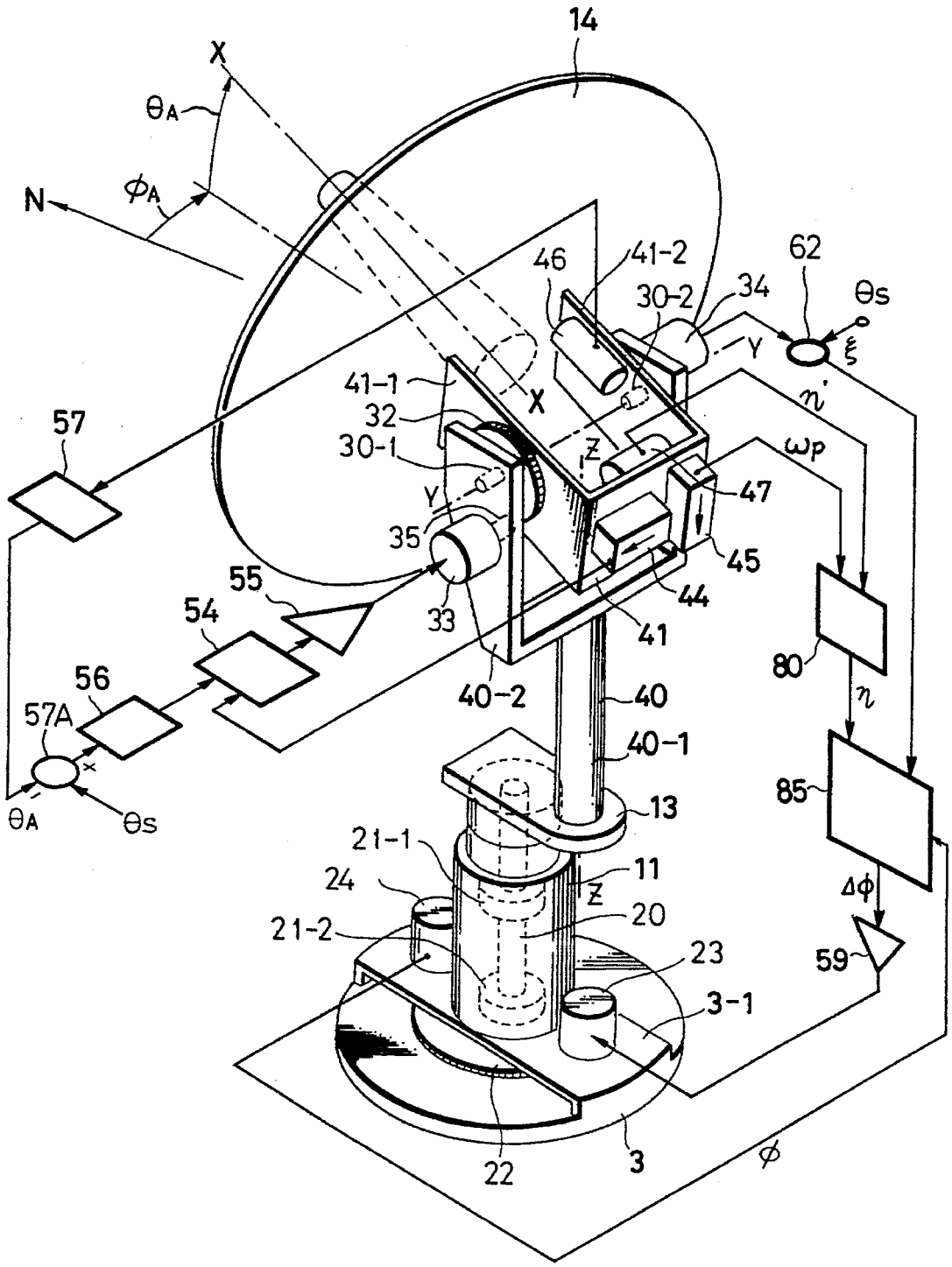
FIG. 14 is a diagram showing a sixth embodiment of the antenna directing apparatus according to the present invention.
Figure 15:
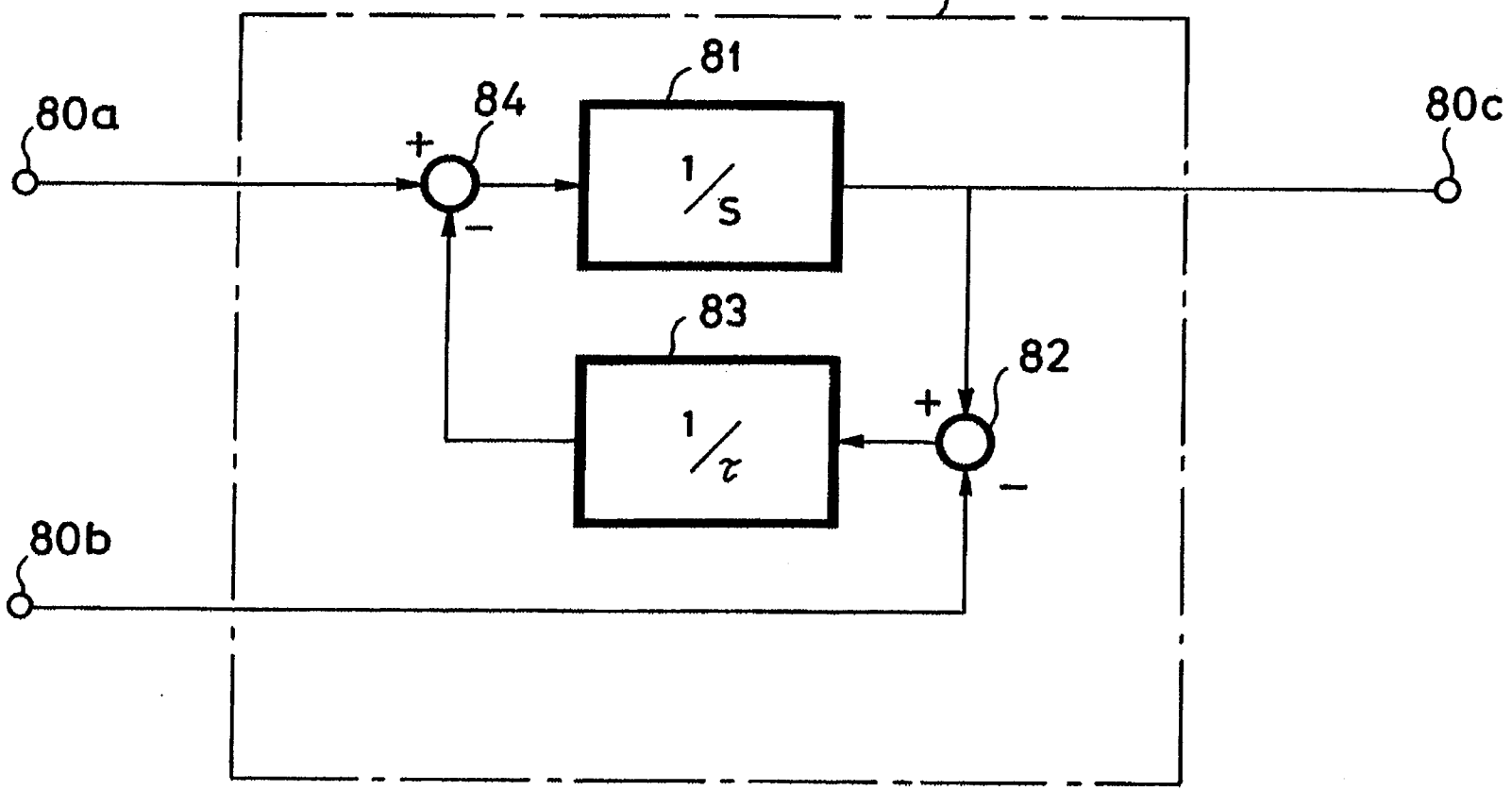
FIG. 15 is a diagram showing the structure of an elevation angle inclination calculator used in the sixth embodiment shown in FIG. 14.

FIG. 15 is a diagram showing an arrangement of the elevation axis inclination calculator 80 shown in FIG. 14. Operation of the elevation axis inclination calculator 80 of this embodiment will be described with reference to FIG. 15.

The elevation axis inclination calculator 80 includes an integrator 81, a first comparator 82, a coefficient generator 83 and a second comparator 84. The elevation axis inclination calculator 80 is supplied with the signal representative of the rotation angular velocity $\omega_P$ of the antenna 14 around the axis perpendicular to the central axis X—X of the antenna 14 from the azimuth gyro 45 through an input terminal 80*a*. Such signal is input through the comparator 84 to the integrator 81, in which it is integrated to calculate the inclination angle $\eta$ of the elevation angle axis Y—Y. The signal representative of such inclination angle $\eta$ is provided through an output terminal 80*c* to the azimuth of inclination angle axis calculator 85.

From the second accelerometer 47, there is input a signal representative of an inclination angle $\eta'$ of elevation axis Y—Y through an input terminal 80*b*. The inclination angle $\eta'$ is compared with the inclination angle $\eta$ of the elevation axis Y—Y by the comparator 82 and a displacement amount thus calculated is negatively fed through the gain $1/\tau$ coefficient generator 83 back to the comparator 84. This feedback loop is a loop of a vertical gyro. In FIG. 15, S indicates a Laplace operator and $\tau$ indicates a time constant.

Figure 16:
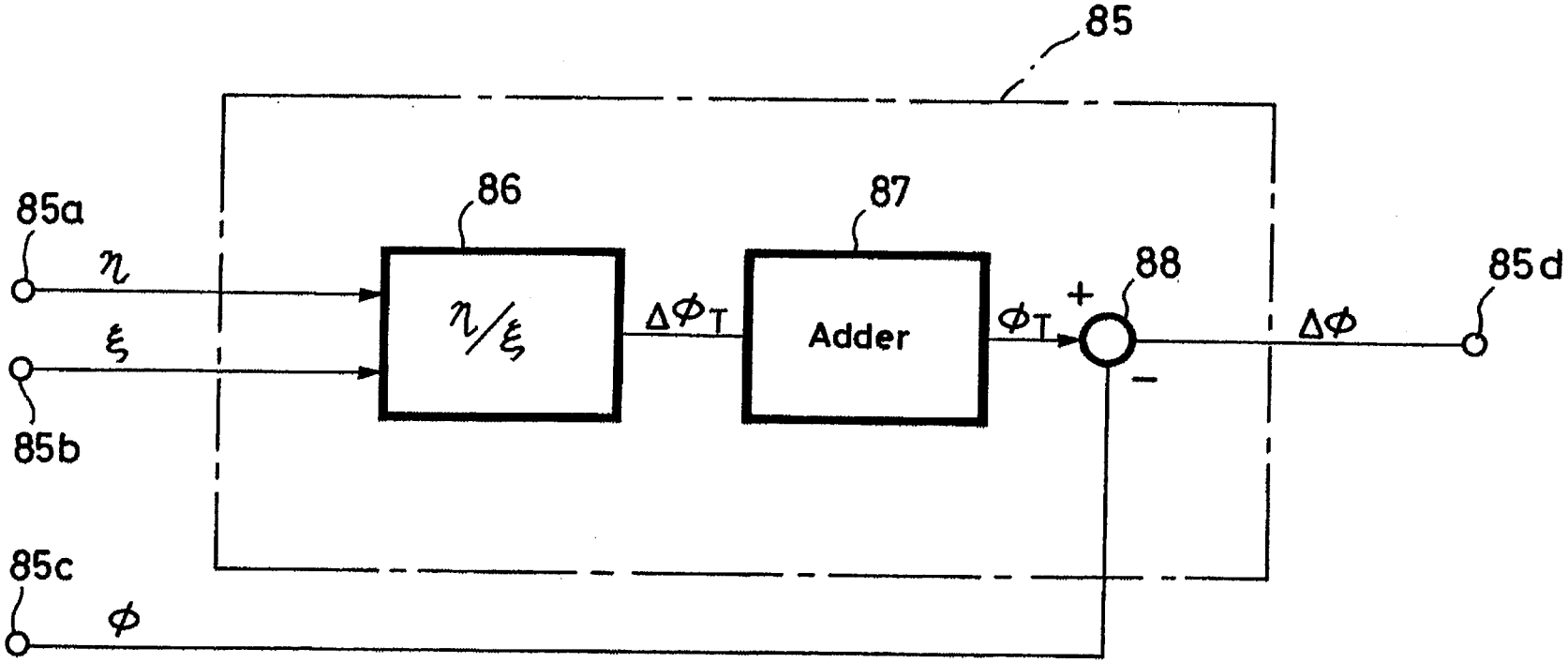
FIG. 16 is a diagram showing an example of a calculator for determining the azimuth of the inclination axis used in the present invention.

FIG. 16 shows an arrangement of the azimuth of inclination axis calculator 85 shown in FIG. 14. Operation of the azimuth of inclination axis calculator 85 of this embodiment will be described with reference to FIG. 16.

The inclination axis calculator 85 includes a divider 86, an adder 87 and a comparator 88.

The output signal from the elevation axis inclination calculator 80, i.e., the signal representative of the inclination angle $\eta$ of the elevation axis Y—Y relative to the horizontal plane is supplied through an input terminal 85*a* to the divider 86. The output signal from the comparator 61, i.e., the signal representative of the rotation angle $\xi$ of the ship body around the elevation angle axis Y—Y is supplied through an input terminal 85*b* to the divider 86. The divider 86 calculates $\Delta\phi_T=\eta/\xi$ to obtain the inclination axis azimuth deviation $\Delta\phi_T$. Then, the adder 87 accumulates the inclination axis azimuth deviation $\Delta\phi_T$ to obtain the inclination axis azimuth $\phi_T$. Then, the signal representative of the inclination axis azimuth $\phi_T$ is supplied to the comparator 88.

On the other hand, the comparator 88 is supplied with a signal representative of the rotation angle $\phi$ of the antenna 14 from the azimuth transmitter 24 through an input terminal 85*c*. The comparator 88 compares the inclination axis azimuth $\phi_T$ and the rotation angle $\phi$ of the antenna 14 to calculate a deviation therebetween. A signal representative of such deviation is supplied through an output terminal 85*d* to the amplifier 59. As described above, the azimuth gimbal 40 is controlled so that the rotation angle $\phi$ of the azimuth gimbal 40 becomes equal to the inclination axis azimuth $\phi_T$.

In the calculation $\Delta\phi_T=\eta/\xi$ executed by the divider 86, if $\xi=0$, then $\Delta\phi_T=\infty$ is established and thus the apparatus becomes uncontrollable. Accordingly, if the value of $\xi$ is smaller than a predetermined value, $\Delta\phi_T=0$ is established and the control done by the above servo loop can be avoided.

In FIG. 14, let us consider the case where the elevation angle of the antenna 14, i.e., the altitude angle $\theta_S$ is in the vicinity of 90°. In this case, the signal output from the azimuth gyro 45 represents a rotation angular velocity of the antenna 14 around the axis perpendicular to both the elevation axis Y—Y and the central axis X—X of the antenna 14 as shown by an arrow in FIG. 14. When the altitude angle $\theta$ of the antenna 14 is increased, such signal represents a rotation angular velocity $\omega_P$ of the elevation axis Y—Y around the horizontal axis relative to the horizontal plane. Such angular velocity $\omega$ may be directly integrated by the integrator 81 to obtain the inclination angle $\eta$ of the elevation axis Y—Y relative to the horizontal plane. In this case, however, an error caused by the drift of the azimuth gyro 45 is unavoidably increased. Therefore, as shown in FIG. 15, the angular velocity $\omega_P$ is compared with the output $\eta'$ of the second accelerometer 47 and then integrated by the first integrator 81.

The inclination angle $\eta$ thus obtained is removed in error caused by the draft of the azimuth gyro 45 and also removed in influence exerted by the horizontal acceleration caused when the ship body rolls and pitches.

Figure 17:
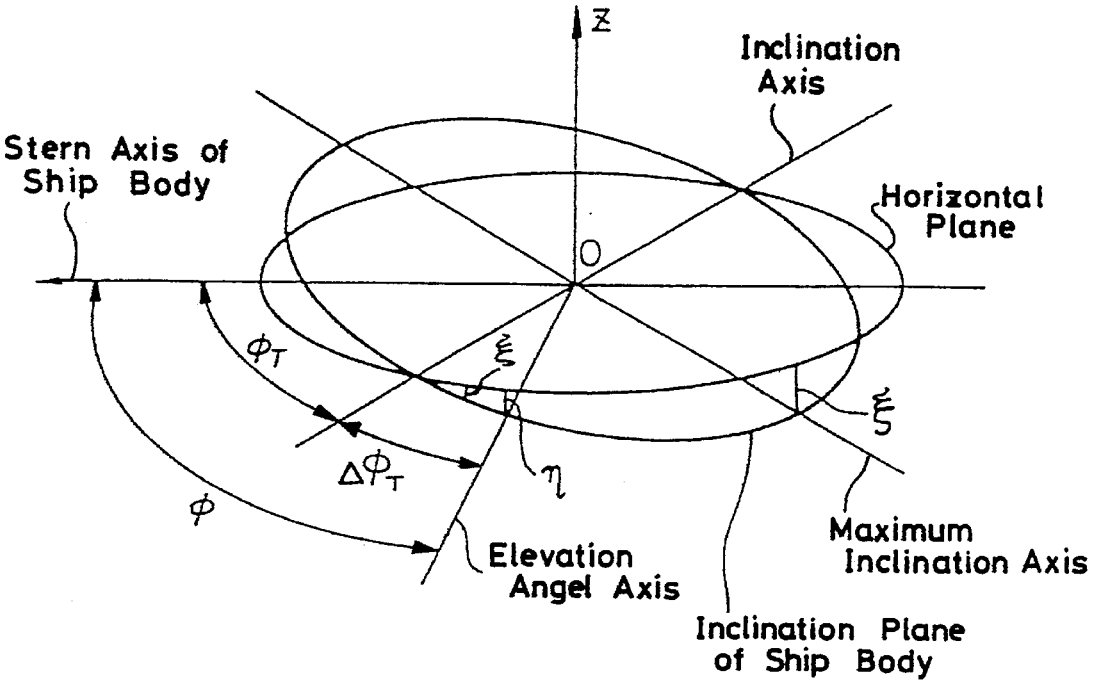
FIG. 17 is a diagram illustrating the condition by which the elevation axis Y—Y is changed in response to changes of the ship's body.

A function of the azimuth of inclination axis calculator 85 shown in FIG. 16 will be described with reference to FIG. 17. In FIG. 17, let it be assumed that if the elevation axis Y—Y is matched with the inclination axis azimuth $\phi_T$ of the ship's body, then the inclination angle $\eta$ of the elevation angle axis Y—Y is zero and that the elevation angle axis Y—Y is displaced from the inclination axis azimuth $\phi_T$ by the azimuth error $\Delta\phi_T$ in actual practice as shown in FIG. 17.

Assuming that $\xi$ is the maximum inclination angle of ship body output from the elevation angle transmitter 34 through the comparator 61, then the azimuth error $\Delta\phi_T$ is expressed approximately as $\Delta\phi_{T=\eta/\xi}$.

If the azimuth gimbal 40 is rotated about the azimuth axis Z—Z by the azimuth angle $\Delta\phi_T$, the elevation angle axis Y—Y is matched with the inclination axis azimuth $\phi_T$ of the ship body and the inclination angle $\eta$ of the elevation angle axis Y—Y becomes zero. In this case, the azimuth angle $\Delta\phi_T$ to be rotated is not only the function of the inclination angle $\eta$ of the elevation angle axis but also a function of the ship's body maximum inclination angle $\xi$.

Thus, as shown in FIG. 16, the azimuth error $\Delta\phi_T=\eta/\xi$ is calculated by the divider 86 and then accumulated to thereby obtain the ship's body inclination axis azimuth $\phi_T$. Then, the rotation angle $\phi$ that is the output of the azimuth transmitter 24 is compared with the inclination axis azimuth $\phi_T$. Thus, the inclination axis azimuth calculator 85 is controlled such that the difference, i.e., compared result therebetween becomes zero, that is, the antenna rotation angle $\phi$ becomes equal to the inclination axis azimuth $\phi_T$.

According to the sixth embodiment of the present invention, in the gimbal system of azimuth-level system, the gimbal lock phenomenon caused when the satellite altitude angle is substantially 90° can be avoided. Therefore, there is then the advantage such that the problem wherein the direction accuracy of the antenna 14 is lowered by the gimbal lock phenomenon is solved.

Also, according to the sixth embodiment of the present invention, there is then the advantage that, by the simple method in which the elevation axis Y—Y is matched with the ship's body inclination axis azimuth, the gimbal lock phenomenon can be avoided and the directing accuracy of the antenna 14 can be increased considerably.

Further, according to the sixth embodiment of the present invention, when the satellite altitude angle is nearly 90°, the azimuth gyro 45 detects the inclination angular velocity of the elevation angle axis Y—Y relative to the horizontal plane. then, by the output of the azimuth gyro 45 and the output of the second accelerometer 47 having an axis input of the elevation angle axis Y—Y direction, the elevation angle axis Y—Y is matched with the direction of the ship's body inclination axis. Therefore, the gimbal lock phenomenon that is caused when the satellite altitude is substantially 90° can be avoided and the directing accuracy of the antenna 14 can be increased considerably.

Furthermore, according to the sixth embodiment of the present invention, there is provided an inclination axis azimuth calculator that can calculate the azimuth error $\Delta\phi_T$ of the antenna 14 on the basis of the ship's body maximum inclination angle $\xi$ output from the elevation angle transmitter 34 and the inclination angle $\eta$ of the elevation angle axis.

Furthermore, since, according to the sixth embodiment of the present invention, the inclination axis azimuth calculator includes a detector that reduces the azimuth error $\Delta\phi_T$ of the antenna 14 to zero when the ship's maximum inclination angle $\xi$ is less than a predetermined value, the unnecessary movement of the azimuth gimbal can be prevented and the directing accuracy of the antenna 14 can be increased considerably.

Figure 18:
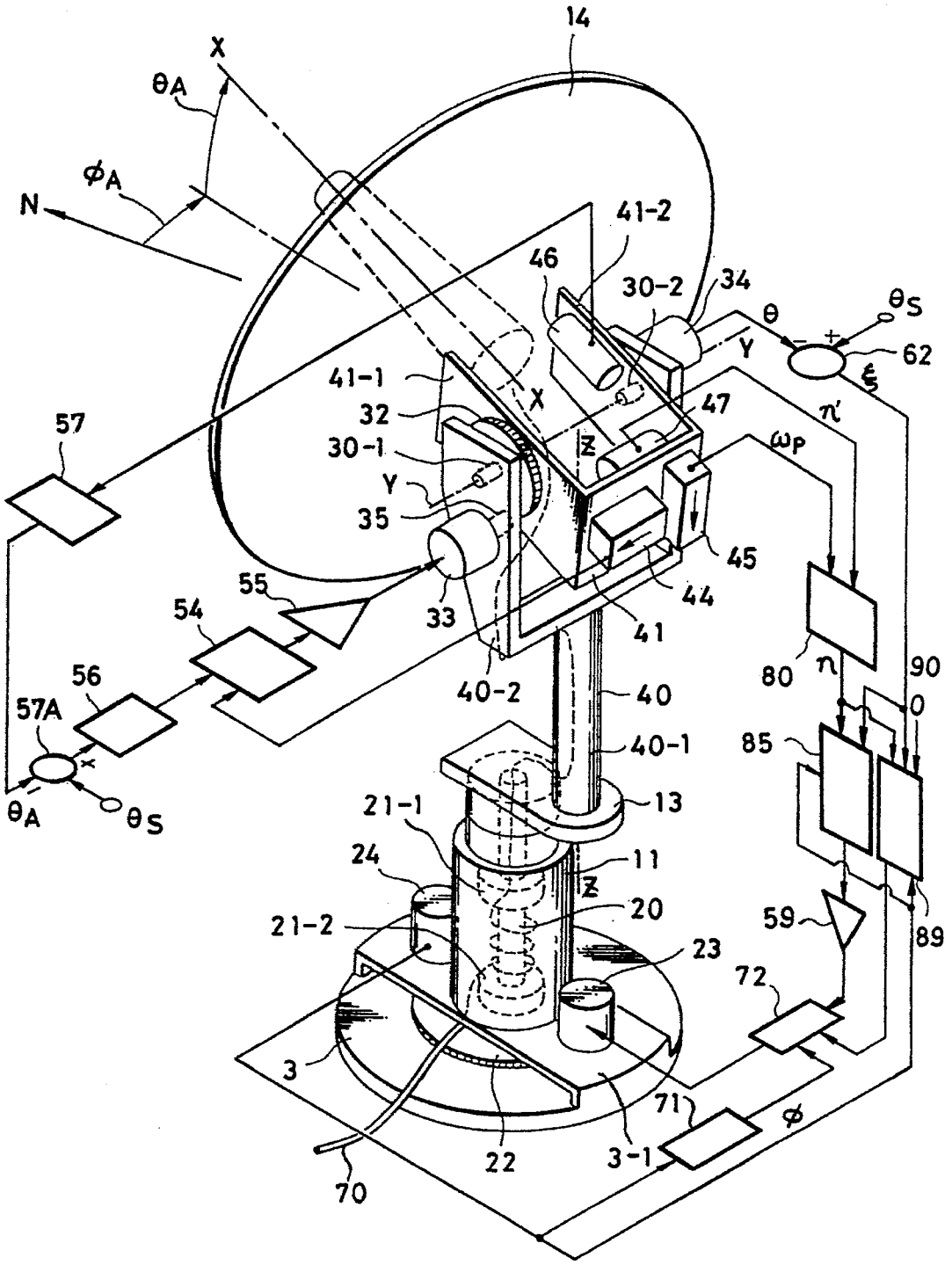
FIG. 18 is a perspective view showing a seventh embodiment of the present invention.
Figure 19:
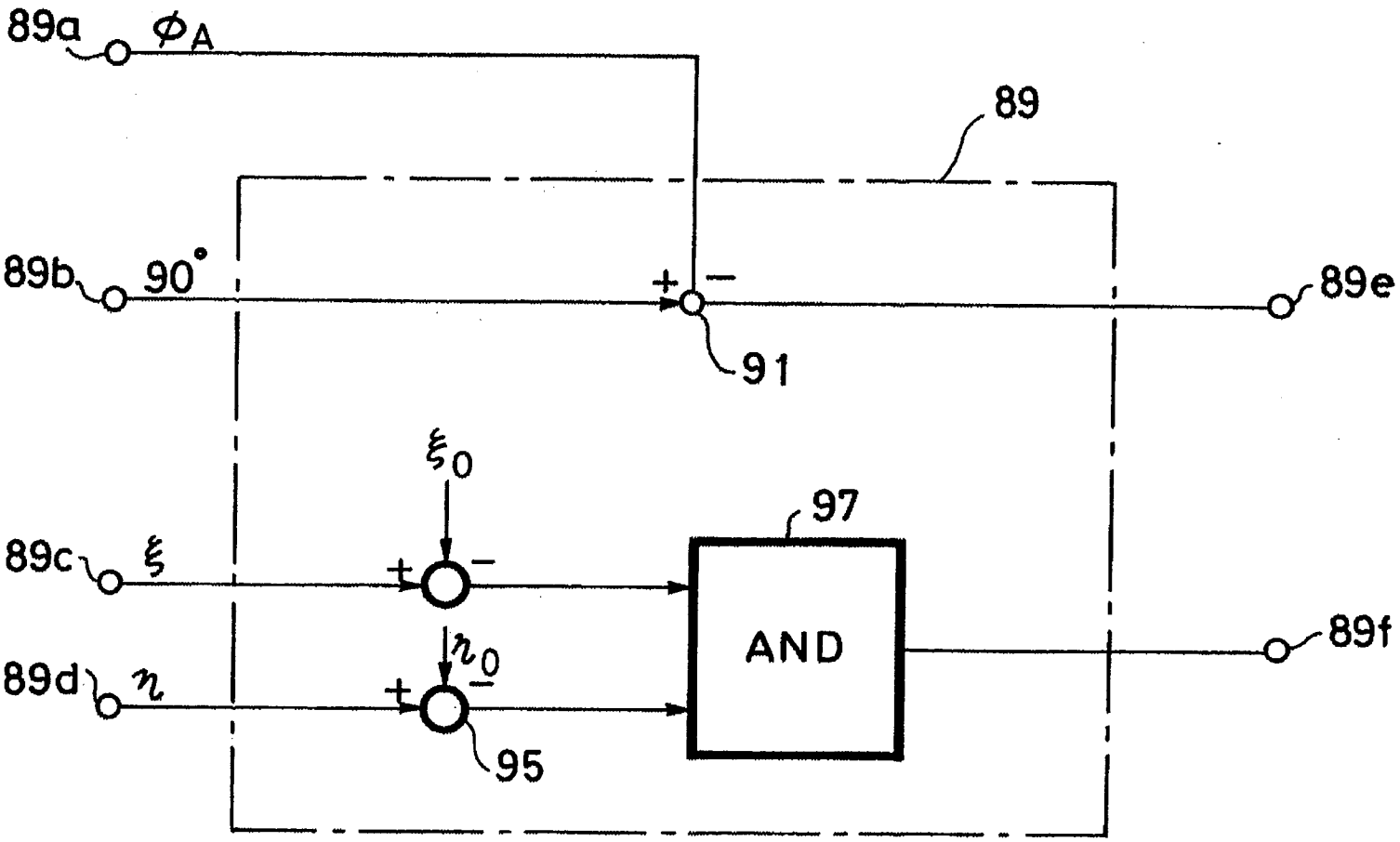
FIG. 19 is a block diagram showing an example of a discriminator used in detecting the pitch and roll embodiment shown in FIG. 18.

A seventh embodiment of the present invention will hereinafter be described with reference to FIGS. 18 and 19. In FIGS. 18 and 19, like parts corresponding to those of FIG. 14 are marked with the same references and therefore need not be described in detail.

While the antenna directing apparatus according to the seventh embodiment includes the elevation control loop and the azimuth control loop similar to those of the example of FIG. 14, the antenna directing apparatus of the seventh embodiment is different from the apparatus shown in FIG. 14 in that the azimuth control loop includes a roll and pitch detector 89.

The azimuth control loop includes the azimuth gyro 45, the second accelerometer 47, the azimuth transmitter 24, the elevation angle axis inclination calculator 80, the azimuth of inclination axis calculator 85 and the amplifier 59. Further, the azimuth control loop is provided with a rewind circuit 71, a switching circuit 72 and the roll and pitch detecting device 89.

The signal representative of the angle velocity $\omega_P$ of the antenna 14 around the axis perpendicular to both the elevation angle axis Y—Y and the central axis X—X of the antenna 14 obtained from the azimuth gyro 45 and the signal representative of the inclination angle $\eta'$ of elevation axis Y—Y relative to the horizontal plane obtained from the second accelerometer 47 are input to the elevation axis inclination calculator 80, and the inclination angle $\eta$ of the elevation axis Y—Y relative to the horizontal plane is calculated by the elevation axis inclination calculator 80.

Then, the rotation angle $\theta$ around the elevation axis Y—Y of the antenna 14 is output from the elevation angle transmitter 34. The rotation angle $\theta$ and the satellite altitude angle $\theta_S$ are compared with each other by a proper comparator to thereby obtain a rotation angle $\xi(=\theta_S-\theta)$ of the ship's body around the elevation axis Y—Y relative to the horizontal plane. The rotation angle $\xi$ of the ship body around the elevation axis Y—Y relative to the horizontal plane may be obtained by comparing the rotation angel $\theta$ of the antenna 14 around the elevation axis Y—Y and the elevation angle $\theta_A$ of the antenna 14.

The azimuth of inclination axis calculator 85 is supplied with the signal representative of the inclination angle $\eta$ of the elevation axis Y—Y relative to the horizontal plane obtained from the elevation axis inclination calculator 80, a signal representative of the rotation angle $\xi$ of the ship's body around the elevation axis Y—Y relative to the horizontal plane output from the elevation transmitter 34 and the rotation angle $\phi$ of the antenna 14 obtained from the azimuth transmitter 24.

The azimuth of inclination angle axis calculator 85 calculates the inclination axis azimuth $\phi_T$ from the inclination angle $\eta$ of the elevation angle axis Y—Y and the rotation angle $\xi$ of the ship body. Then, the inclination axis azimuth $\phi_T$ is compared with the antenna rotation angle $\phi$ obtained from the azimuth transmitter 24 to calculate the azimuth deviation $\Delta\phi_T$.

The azimuth deviation signal $\Delta\phi_T$ representative of the difference between the inclination axis azimuth $\phi_T$ and the antenna rotation angle $\phi$ is output from the azimuth of the inclination axis calculator 85 to the amplifier 59 and is further supplied from the amplifier 59 to the azimuth servo motor 23. As described above, the azimuth gimbal 40 is controlled such that the azimuth deviation $\Delta\phi_T$ becomes zero, i.e., the azimuth of the elevation angle axis Y—Y is matched with the inclination axis azimuth $\phi_T$.

The above-mentioned control is based on the following principle. That is, the rolling of the ship's body can always be considered as the rotational movement around one rotation axis (inclination axis of ship body) within the horizontal plane. Therefore, if the azimuth of the azimuth gimbal 40 is controlled so that the elevation angle axis Y—Y is constantly matched with the rotation axis azimuth $\phi_T$, then even when the satellite altitude angle is large, the central axis X—X of the antenna 14 can be constantly directed to the zenith direction.

Operation of the rolling detective device 89 will be described below. The rolling detector 89 is supplied with the signal representative of the inclination angle $\eta$ of the elevation axis Y—Y relative to the horizontal plane obtained from the elevation axis inclination calculator 80 and the signal representative of the rotation angle $\xi$ of the ship's body around the elevation axis Y—Y relative to the horizontal plane obtained from the elevation transmitter 34 and is further supplied with the signal representative of the rotation angle $\phi$ of the antenna 14 obtained from the azimuth transmitter 24.

The rolling detecting device 89 compares the inclination angle $\eta$ of the elevation angle axis Y—Y relative to the horizontal plane and the rotation angle $\xi$ of the ship body around the elevation angle axis Y—Y relative to the horizontal plane with predetermined values $\eta_0$, respectively. When the inclination angle $\eta$ and the rotation angle $\xi$ are both smaller than the predetermined values $\eta_0$ and $\xi_0$, the rolling detector 89 generates a control suppressing signal indicating that the ship rolling is small. While the control suppressing signal is generated from the rolling detecting device 89, the above-mentioned normal azimuth control loop is not actuated.

If it is determined by the rolling detecting device 89 that the rolling of the ship body is small under the condition that the satellite altitude angle is large and that the elevation axis Y—Y is matched with the inclination axis azimuth of the ship body, then the elevation axis Y—Y is not matched with the inclination axis azimuth of the ship body but is matched with the ship's stern azimuth. That is, the azimuth gimbal 14 is rotated so that the azimuth of the antenna 40 forms an angle of 90° relative to the ship's body stern azimuth.

The rewind mechanism is actuated when the azimuth of the antenna 14 is rotated by a predetermined rotation angle relative to a predetermined reference azimuth, for example, ±270°. Then, the rewind mechanism rotates the azimuth gimbal 40 by 360° in the opposite direction. As described above, the reference azimuth is set to be the azimuth of the antenna 14 when the elevation angle axis Y—Y is matched with the ship body stern azimuth, i.e., to the azimuth provided when the rotation angle $\phi$ of the antenna 14 is displaced 90° from the ship's body stern azimuth.

Therefore, the azimuth of the antenna 14 is directed when it is determined by the rolling detecting device 89 that the rolling of ship body is small coincides with the reference azimuth of the rewind mechanism. When the satellite altitude angle is large, it is determined by the rolling detecting device 89 that the rolling of ship's body is small and that the azimuth gimbal 40 is rotated such that the elevation axis Y—Y of the antenna 14 becomes matched with the ship's body stern. The rotation angle $\phi$ of the antenna 14 at that time is set in the reference azimuth so that it is located at the azimuth (azimuth displaced ±270° from the reference azimuth) farthest from the operable azimuth of the rewind mechanism. Accordingly, if the ship's body is returned to the normal operable condition where the rewind mechanism is operable, the rewind mechanism can be prevented from being actuated immediately even when the ship's body is rolling.

FIG. 19 shows an example of an arrangement of the rolling detecting device 89. The rolling detecting device 89 includes a first comparator 91 for comparing the rotation angle $\phi$ obtained from the azimuth transmitter 24 and 90° a second comparator 93 for comparing the rotation angle $\xi$ of the ship's body around the elevation axis Y—Y relative to the horizontal plane and the predetermined angle $\xi_0$, a third comparator 95 for comparing the inclination angle $\eta$ of the elevation axis Y—Y relative to the horizontal plane and the predetermined value $\eta_0$ and an AND circuit 97 which is supplied with output signals from the second and third comparators 93, 95.

The first comparator 91 generates an angle deviation signal representative of an azimuth deviation angle $\Delta\phi_A$ between the signal representative of the rotation angle $\phi$ input from an input terminal 89*a* and the signal representative of the azimuth angle 90° input from an input terminal 89*b*. This deviation angle signal is obtained from an output terminal 89*e*. The AND circuit 97 generates a control signal when the rotation angle $\xi$ is smaller than the predetermined value $\xi_0$ and the inclination angle $\eta_0$. This control signal is obtained from an output terminal 89*f* and represents that the fact that the satellite altitude angle is large and that the rolling of the ship's body is small. Then, the deviation angle signal output from the first comparator 91 and the control signal output from the AND circuit 97 are input to the switching circuit 72.

As described above, according to the seventh embodiment of the present invention, when the satellite altitude angle is large and the rolling of the ship's body is small, the deviation signal and the control signal are supplied to the switching circuit 72 by the rolling detecting device 89. The switching circuit 72 supplies a command signal representative of the azimuth angle and the rotation direction of the antenna 14 to the azimuth servo motor 23 on the basis of the deviation angle signal and the control signal, whereby the azimuth $\phi_A$ of the antenna 14 is moved to a predetermined azimuth that is displaced from the ship's body stern azimuth, for example, by 90°. That is, the azimuth of the antenna 14 is controlled such that the elevation axis Y—Y is matched with the ship body stern azimuth and the rewind mechanism is not actuated.

The inclination axis is a rotation axis provided when the ship's body rolling is regarded as the rotation around one rotation axis within the horizontal plane. Accordingly, when the ship's body is rolled, the inclination axis of the ship's body coincides with the ship's body stern axis. When the pitch component is small and the roll component is large in the rolling of the ship's body, such inclination axis azimuth is approximated to the ship's body stern azimuth. Under the condition that the azimuth of the antenna 14 is controlled such that the elevation angle axis Y—Y is matched with the ship's body stern azimuth, when the ship's body is rolling or the pitch component thereof is small and the roll component thereof is large, the directing accuracy of the antenna 14 can be obtained by rotating the antenna 14 about the elevation angle axis Y—Y.

When the satellite altitude angle is large and the rolling of the ship's body is small, the azimuth gimbal 40 is controlled so that the elevation axis Y—Y is matched with the ship's body stern azimuth, and the rewind mechanism is not actuated. However, in the normal condition, like the prior art, the azimuth gimbal 40 is controlled so that the azimuth of the elevation axis Y—Y is matched with the inclination axis azimuth $\phi_T$ and the rewind mechanism becomes operable. When the ship's body is rolled or the pitch component thereof is small and the roll component thereof is large, the ship's body inclination axis is made coincident with or approximated to the ship body stern axis. Therefore, even when the control state is returned to the ordinary control state, the azimuth of the antenna 14 is located at a position farthest from the azimuth at which the rewind mechanism is actuated. Thus, the rewind mechanism can be readily prevented from being actuated.

According to the seventh embodiment of the present invention, there is then the advantage that, in the gimbal system of the azimuth-elevation system, when the satellite altitude angle is near 90°, if the rolling of the ship's body is smaller than the predetermined value, the unnecessary rotation of the azimuth gimbal 40 can be avoided.

Further, according to the seventh embodiment of the present invention, when the satellite altitude angle is near 90°, if the rolling of ship's body is smaller than the predetermined value, then the azimuth of the elevation angle axis Y—Y is matched with the ship's body stern axis. Therefore, having considered that, in the ordinary rolling of the ship's body, the roll angle is larger than the pitch angle and that the elevation axis can be approximated to the ship's body stern axis, there is then the advantage that, when the ship's body is rolled, the directing accuracy of the antenna 14 can be increased by rotating the antenna 14 around the elevation axis Y—Y.

Furthermore, according to the seventh embodiment of the present invention, when the satellite altitude angle is near 90° and the rolling of ship body is smaller than the predetermined value, the azimuth of the elevation angle axis Y—Y is matched with the ship body stern axis. Therefore, when the ship's body is rolled considerably and the ordinary azimuth servo loop is actuated, the azimuth of the elevation axis Y—Y is located at a position distant from the azimuth at which the rewind mechanism is actuated. Accordingly, the rewind mechanism can be prevented from being actuated immediately and the number of times in which the rewind mechanism is actuated can be reduced.

Figure 20:
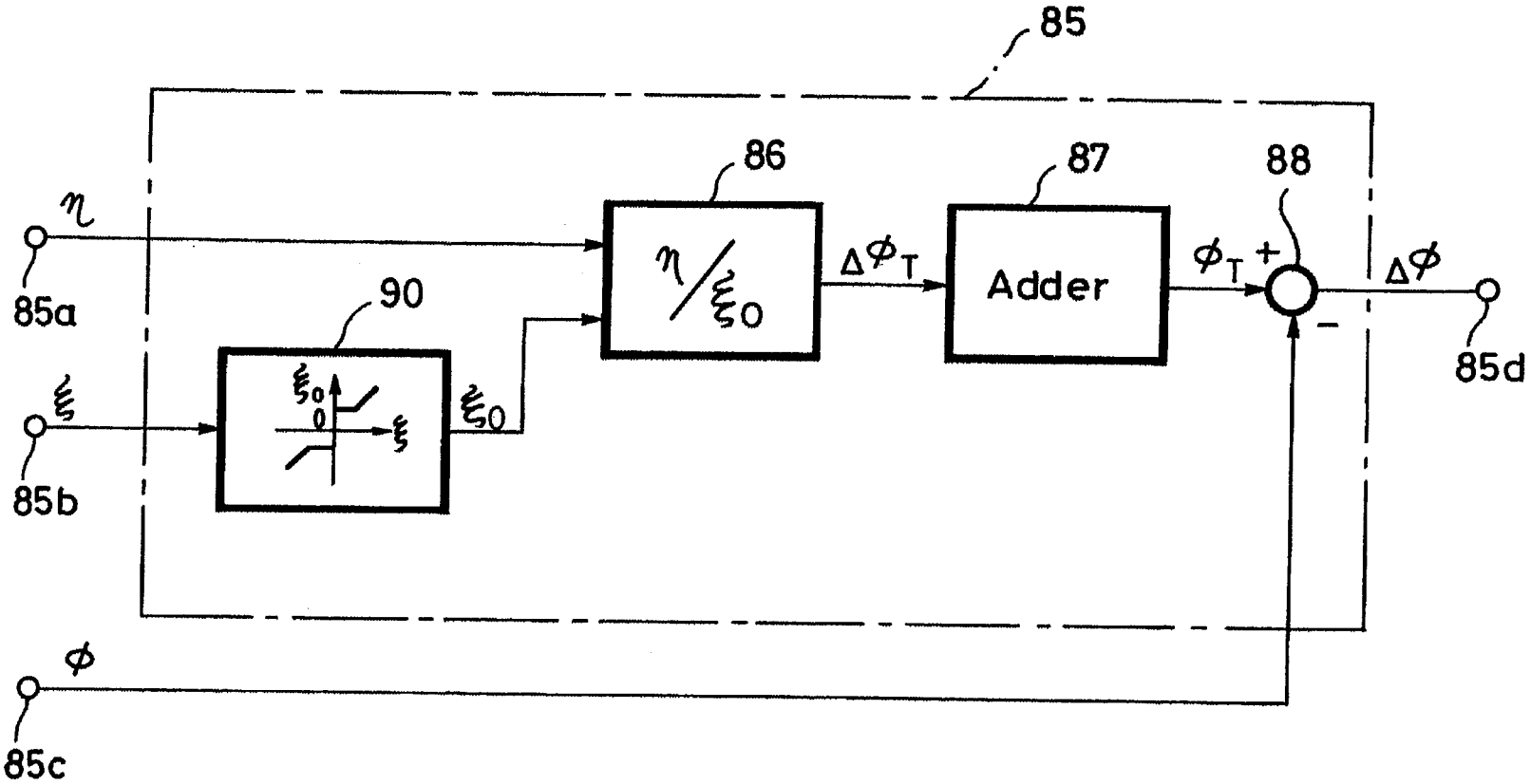
FIG. 20 is a diagram showing the structure of the inclination axis azimuth calculator according to the present invention.
Figure 21:
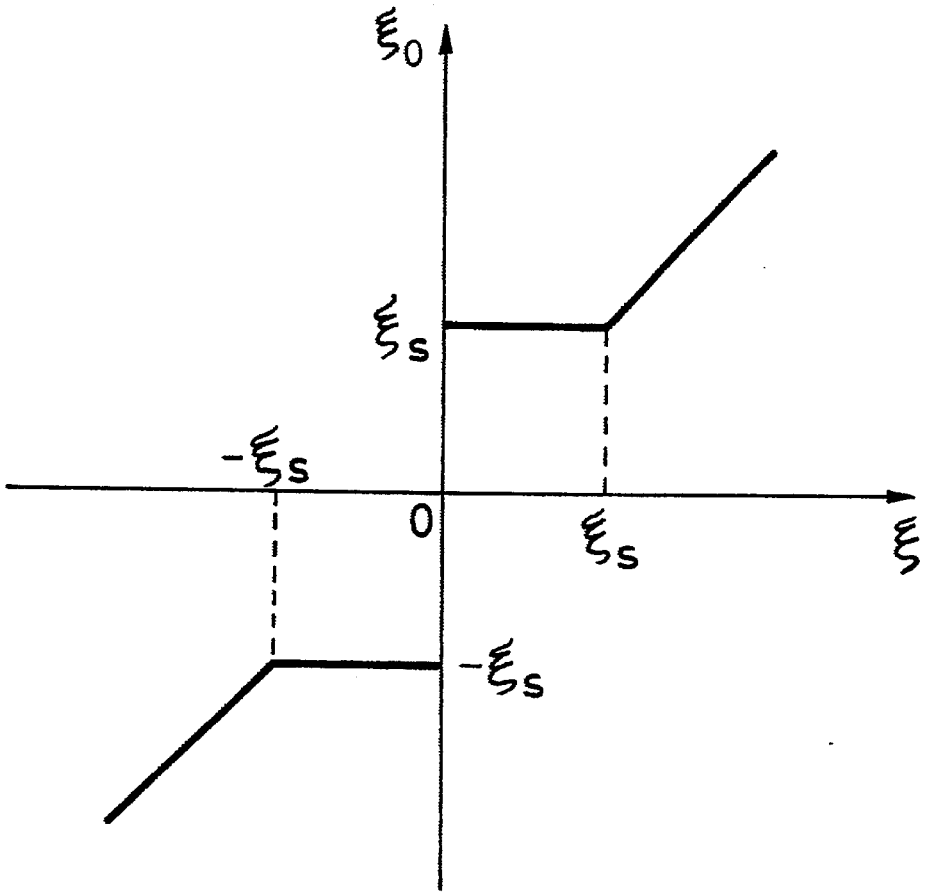
FIG. 21 is a diagram showing a structure of an angle limiter according to the present invention.

Other example of the azimuth of inclination axis calculator of the present invention will hereinafter be described with references to FIGS. 20 to 22. In FIG. 20, like parts corresponding to those of FIG. 16 are marked with the same references and therefore need not be described in detail.

An example of the azimuth of inclination axis calculator 85 shown in FIG. 20 is different from the example of the azimuth of inclination axis calculator 85 shown in FIG. 16 in that it includes an angle limiter 90. More specifically, the calculator 85 shown in FIG. 20 includes the divider 86, the adder 87, the comparator 88 and the angle limiter 90.

In this example, the output signal from the elevation axis inclination calculator 80, i.e., the signal representing the inclination angle $\eta$ of the elevation axis Y—Y relative to the horizontal plane is supplied through the input terminal 85*a* to the divider 86. On the other hand, the output signal of the elevation transmitter 34, i.e., the signal that represents the rotation angle $\xi$ of the ship body around the elevation axis Y—Y is supplied through the input terminal 85*b* to the angle limiter 90. That is, the signal representative of the rotation angle $\xi$ of the ship body around the elevation axis Y—Y is supplied to the angle limiter 90 before being supplied to the divider 86.

Operation of the angle limiter 90 will be described with reference to FIG. 21. FIG. 21 shows a relationship between the rotation angle $\xi$ of the ship body around the elevation axis Y—Y input to the angle limiter 90 and the rotation angle $\xi_0$ output from the angle limiter 90. This graph expresses the following equation (24):

$$\xi_0=\xi(|\xi|>\xi_S) \text{ or } =\xi_S\times sgn(\xi)(|\xi|\leqq\xi_S) \quad (24)$$

where symbol sgn represents positive or negative sign of $\xi$. When the absolute value of the input rotation angel $\xi$ is larger than a predetermined setting value $\xi_S$, the input rotation angle $\xi$ is output as it is. When the absolute value of the input rotation angle $\xi$ is equal to or smaller than the predetermined setting value $\xi_S$, the setting value $\xi_S$ having the same sign as that of the input rotation angle $\xi$ is output. Such setting value $\xi_S$ is set to be a proper value, e.g., 5°.

As described above, the absolute value of the output $\xi_0$ from the angle limiter 90 can be prevented from becoming smaller than the setting value $\xi_S$. The output signal from the angle limiter 90 is supplied to the divider 86. The divider 86 carries out the division expressed as $\Delta\phi_T=\eta/\xi_0$ to obtain the inclination axis azimuth deviation $\Delta\phi_T$. Since the absolute value of the value of the denominator $\xi_0$ of this equation is equal to or larger than the setting value $\xi_S$, the inclination axis azimuth deviation $\Delta\phi_T$ can be prevented from becoming infinite.

Referring to FIG. 20, the adder 87 accumulates the inclination axis azimuth deviation $\Delta\phi_T$ to obtain the inclination axis azimuth $\phi_T$ of the inclination axis, and the signal representative of the inclination axis azimuth $\phi_T$ is supplied to the comparator 88.

On the other hand, the comparator 88 is supplied with the signal representative of the antenna rotation angle $\phi$ obtained from the azimuth transmitter 24 through the input terminal 85*c*. The comparator 88 compares the inclination axis azimuth $\phi_T$ and the antenna rotation angle $\phi$ to obtain the deviation $\Delta\phi$ therebetween. The signal representative of the above deviation $\Delta\phi$ is supplied through the output terminal 85*d* to the amplifier 59 (see FIG. 18).

As described above, the azimuth of the azimuth gimbal 40 is controlled so that the deviation $\Delta\phi$ becomes zero, i.e., the rotation angle $\phi$ of the azimuth angle 45 becomes equal to the inclination axis azimuth $\phi_T$. Consequently, when the inclination angle $\eta$ of the elevation axis Y—Y relative to the horizontal plane becomes zero, the azimuth gimbal 40 is settled. In other words, the azimuth of the azimuth gimbal 40 is controlled by the azimuth control loop so that the elevation angle axis Y—Y is matched with the azimuth of the inclination axis of the ship's body.

Figure 22A:
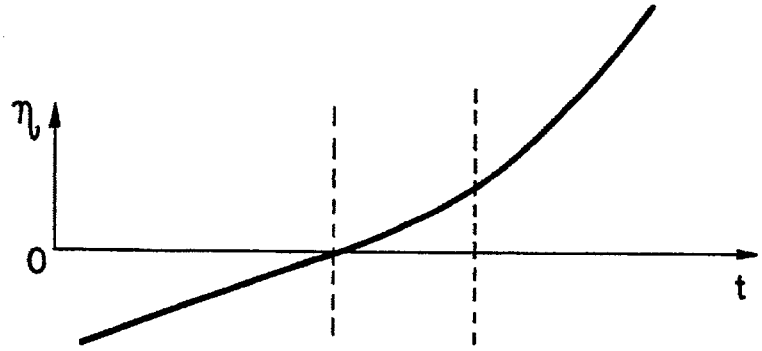
FIGS. 22A through 22C are diagrams used to explain operation of the inclination axis azimuth calculator according to the present invention, respectively.
Figure 22B:
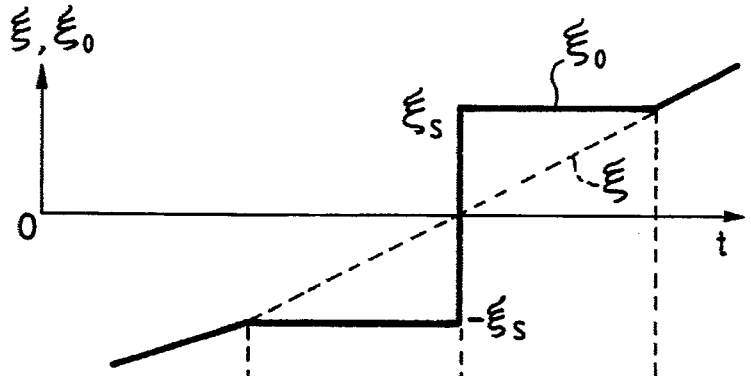
Figure 22C:
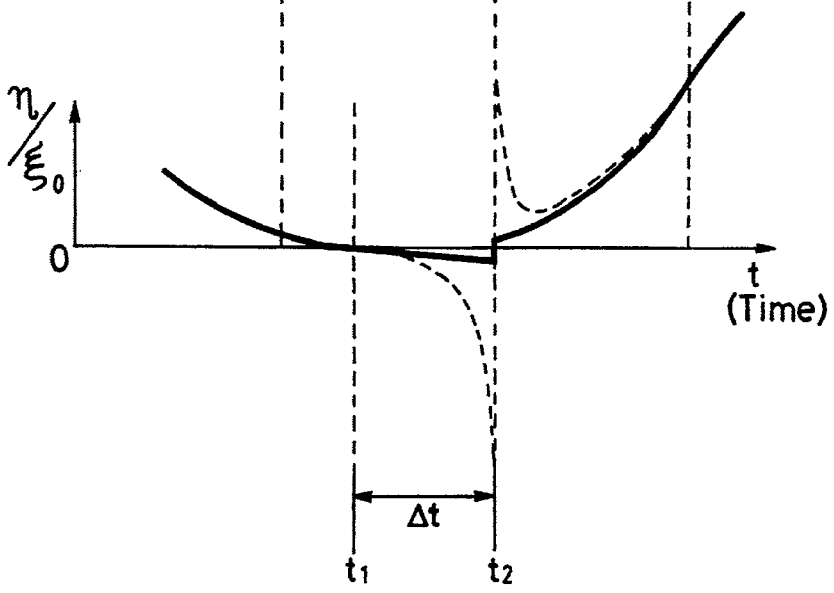

Operation of the azimuth of inclination axis calculator 85 shown in FIG. 20 will be described with reference to FIGS. 22A to 22*c*. FIG. 22A is a graph showing the condition that the value of the inclination angle $\eta$ of the elevation angle axis Y—Y relative to the horizontal plane input to the divider 86 is changed with time. FIG. 22B is a graph showing the condition that the value of the rotation angle $\xi_0$ of the ship body around the elevation axis Y—Y input to the divider 86 is changed with time. FIG. 22C is a graph showing the condition where the deviation value $\Delta\phi_T$ output from the divider 86 is changed with time. Dashed curves in FIGS. 22B and 22C show operation of the inclination axis azimuth calculator 85 shown in FIG. 16.

In this embodiment, as shown in FIGS. 22A to 22C, the inclination of the elevation axis Y—Y relative to the horizontal plane is changed progressively. The absolute value of the negative inclination angle $\eta$ is decreased and the value of the inclination angle $\eta$ becomes zero at timing point $t_1$. Thereafter, the absolute value of the positive inclination angle $\eta$ is increased. The rotation angle $\xi$ becomes zero at timing point $t_2$ that is behind the timing point $t_1$ by a time $\Delta t$.

The azimuth of inclination axis calculator 85 shown in FIG. 16 is not provided with the angle limiter 90, so that, as shown in FIG. 22C, the deviation value $\Delta\phi_T$ becomes discontinuous at timing point $t_2$ and also the absolute value is increased and the polarity is inverted. More specifically, while the azimuth gimbal 40 is rotated in the forward direction until the timing point $t_1$, the azimuth gimbal 40 is rotated much in the opposite direction from timing point $t_1$ to timing point $t_2$. Immediately after the timing point $t_2$, the azimuth gimbal 40 is inverted and rotated much in the forward direction and is rotated such that a rotation angle thereof is increased progressively. A torque generated by the azimuth servo motor 23 is limited and therefore in actual practice the azimuth gimbal 40 is never rotated with a rotation angle shown by the dashed line in FIG. 22C. However, the azimuth gimbal 40 is rotated with large rotation angle before and after the timing point $t_2$ so that a transient deviation error occurs.

According to the embodiment shown in FIG. 20, the azimuth gimbal 40 is rotated in the forward direction until the timing point $t_1$, substantially stopped in rotation from the timing point $t_1$ to the timing point $t_2$ and then rotated again in the forward direction after the timing point $t_2$ so that the rotation angle thereof is increased progressively. Accordingly, before and after the timing point $t_2$, the azimuth gimbal 40 can be prevented from being rotated with a large rotation angle and therefore the transient deviation error can be prevented from being generated.

Further, since a large fluctuating torque can be prevented from acting on the azimuth servo motor 23, the life of the azimuth servo motor 23 can be extended.

Figure 23:
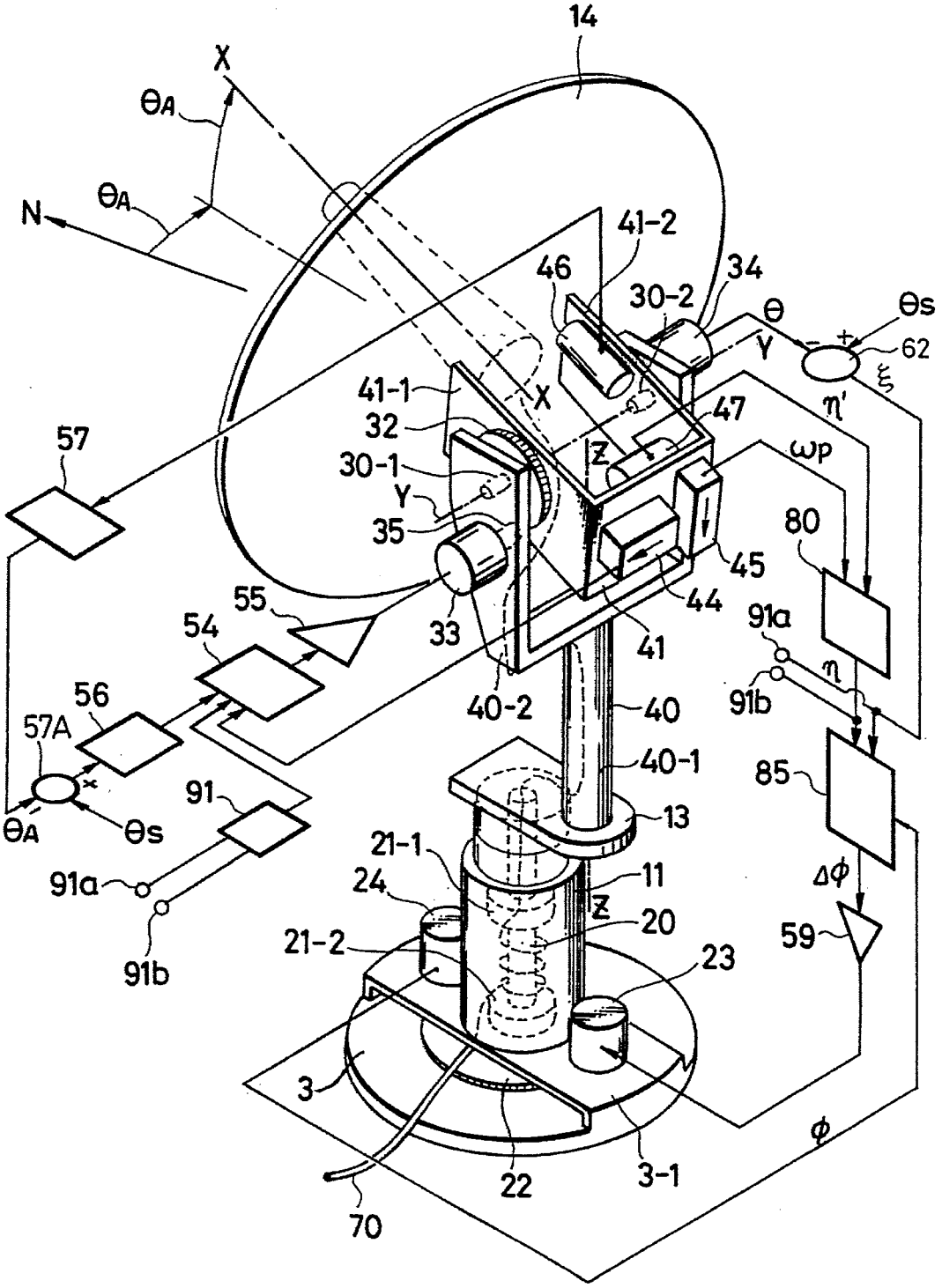
FIG. 23 is a perspective view showing an eighth embodiment of the present invention.

An eighth embodiment of the present invention will hereinafter be described with reference to FIG. 23 providing inclination calculator 91 to calculate the elevation angle deviation $\theta_E$, expressed by the following equation (25) and correct the same. A rest of the arrangement in FIG. 23 is substantially similar to that of the embodiment shown in FIG. 14.

The inclination calculator 91 according to the eighth embodiment of the present invention is supplied with the signal representative of the inclination angle $\eta$ of the elevation axis Y—Y relative to the horizontal plane output from the elevation axis inclination calculator 80 and the signal representative of the rotation angle $\xi$ of the ship body around the elevation axis Y—Y output from the elevation transmitter 34 through input terminals 91*b* and 91*a*. The inclination calculator 91 calculates the equation (25) to obtain the elevation angle deviation $\theta_E$ to the integrator 54.

$$\theta_E = \sqrt{(\xi^2 + \eta^2)} - |\xi| \quad (25)$$

Since the elevation angle deviation $\theta_E$ is the rotation angle deviation error of the antenna 14 around the elevation axis Y—Y thereof,.the elevation angle deviation $\theta_E$ can be reduced to zero by supplying the value of the elevation angle deviation $\theta_E$ to the integrator 54 that is operated as substantially a torquer of the elevation gyro 44. As described above, by the elevation control loop, the antenna 14 is rotated around the elevation axis Y—Y the rotation angle corresponding to the elevation angle deviation $\theta_E$, thereby correcting the directing error of the antenna 14 caused by the elevation angle deviation $\theta_E$.

According to the eighth embodiment of the present invention, when the rotation angle $\xi$ of the ship's body around the elevation axis Y—Y, rotated relative to the horizontal plane, is decreased and becomes zero ($\xi$=0) and is increased one more time, the directing accuracy of the antenna 14 can be improved. There is then the advantage that the life of servo motor, gears or the like can be extended.

Furthermore, according to the eighth embodiment of the present invention, since the antenna directing apparatus includes the inclination calculator 91 and the value of the elevation angle deviation $\theta_E$ output from the inclination calculator 91 is input to the integrator 54 of the elevation control loop so that, even when a sudden angular velocity occurs around the axis perpendicular to both the elevation axis Y—Y and the azimuth axis Z—Z, the directing error produced in the antenna 14 due to the sudden angular velocity can be completely corrected. There is then the advantage that the antenna directing apparatus of high directing accuracy can be obtained.

Figure 24A:
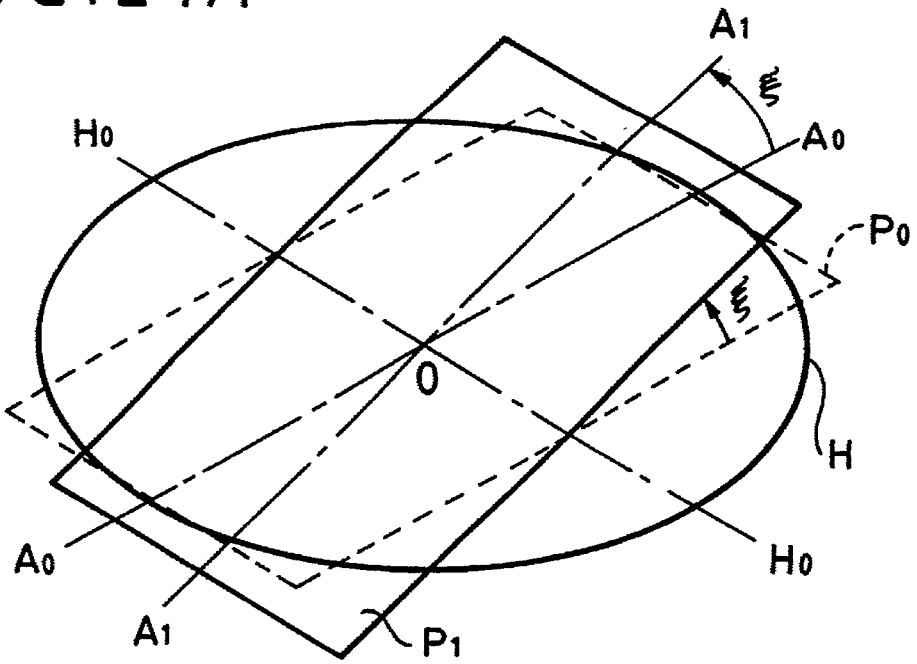
FIGS. 24A and 24B are diagrams showing changes of a ship's inclination axis, respectively.

A principle that the above deviation error occurs will be described with reference to FIGS. 24A, 24B and FIGS. 25A, 25B. As shown in FIG. 24A, let it be assumed that a ship's body plane $P_0$ parallel to a horizontal plane H is inclined the inclination angle $\xi$ around a horizontal line $OH_0$ so as to become the ship's body plane $P_1$. An intersection line of the ship's body plane $P_1$ and the horizontal plane H becomes the ship's body inclination axis. When the ship's body plane $P_0$ is inclined and becomes the ship's body plane $P_1$, a horizontal line $OA_0$ perpendicular to the horizontal line $OH_0$ becomes a maximum inclination axis $OA_1$ that is perpendicular to the inclination axis $OH_0$.

Figure 24B:
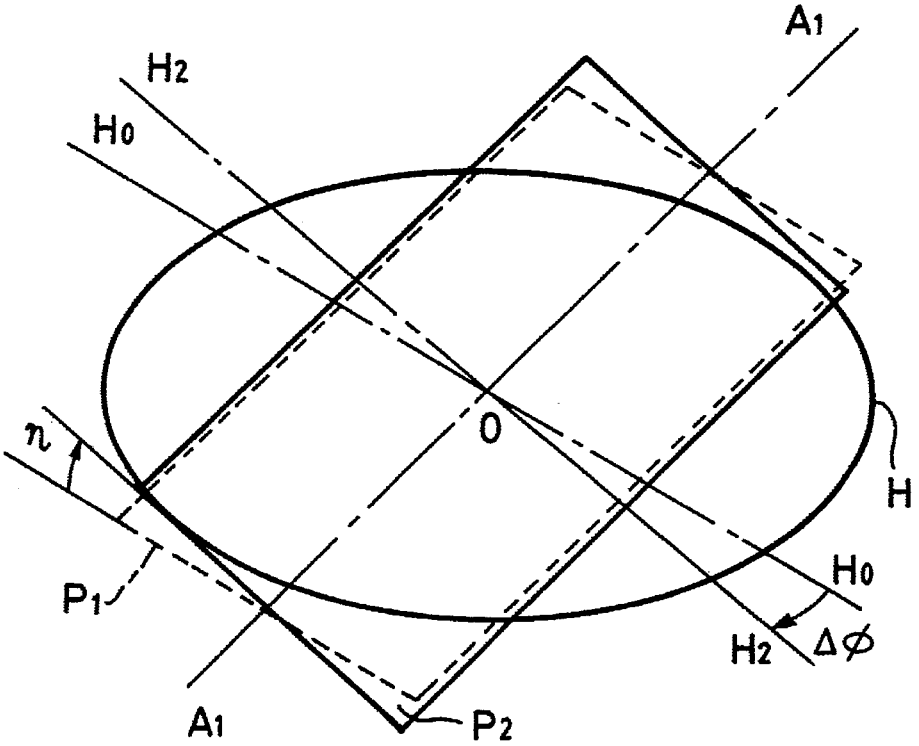

As shown in FIG. 24B, let it be assumed that the ship's body plane $P_1$ is inclined by the inclination angle $\eta$ around the maximum inclination axis $OA_1$ and becomes the ship's body plane $P_2$. The ship's body inclination axis $OH_0$ is rotated $\Delta\phi$ and displaced to the inclination axis $OH_2$. Such deviation angle $\Delta\phi$ is expressed by the following equation (26):

$$\angle H_0OH_2=\Delta\phi=\tan^{-1}(\eta/\xi) \tag{26}$$

Figure 25A:
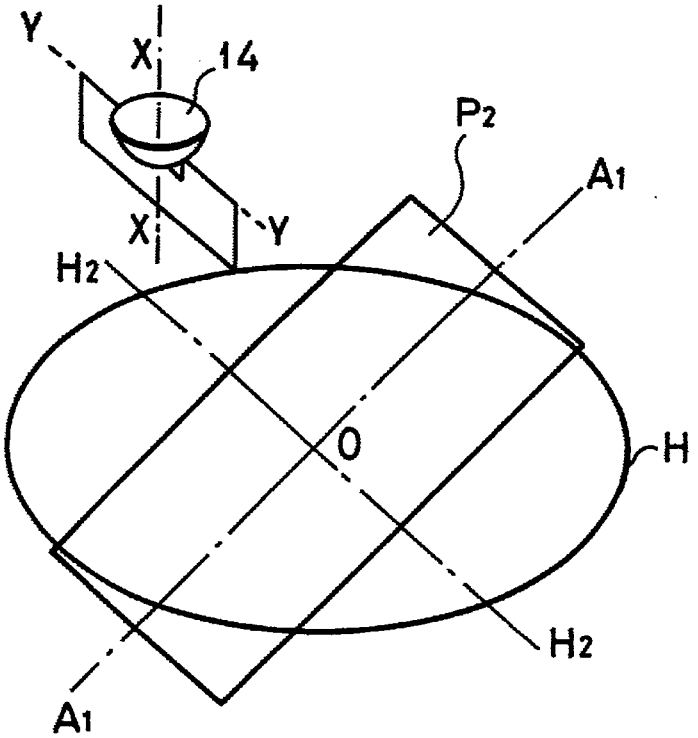
FIGS. 25A and 25B are diagrams showing the condition by which the central axis of the antenna is changed when the ship's body inclination is changed, respectively.

The trajectory of the central axis X—X of the antenna 14 will be described with reference to FIGS. 25A, 25B. As shown in FIG. 25A, when the satellite altitude angle is large, the elevation axis Y—Y is disposed so as to become parallel to the ship incline axis $OH_2$ by the above-mentioned control loop. Also, the central axis X—X of the antenna 14 is directed in the zenith direction.

Figure 25B:
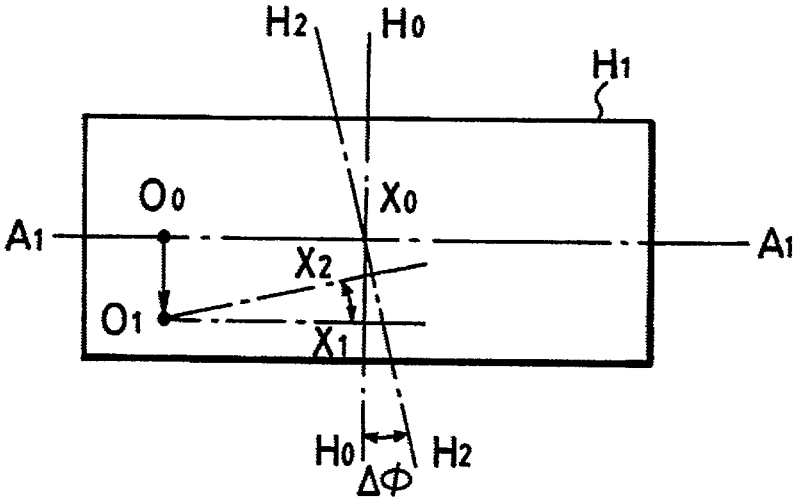

FIG. 25B shows a horizontal plane $H_l$ that is disposed above the antenna 14 with a unit distance from the antenna 14. Reference symbol $\mathbf{0}_0$ designates a point at which the central axis of the azimuth axis 20 intersects the horizontal plane $H_1$ and $X_0$ designates a point at which the central axis X—X of the antenna 14 intersects the horizontal plane $H_1$.

Further, let it be assumed that the ship body plane $P_1$ is inclined by the inclination angle $\eta$ around the maximum inclination axis $OA_1$ to become the ship's body plane $P_2$ and that the inclination axis $OH_0$ is rotated by the deviation angle $\Delta\phi$ to become an inclination axis $OH_2$. When the change of the inclination of the ship's body plane is rapid, the central point $\mathbf{0}_0$ of the azimuth axis 20 and the point $X_0$ of the central axis X—X of the antenna 14 are respectively moved to points $\mathbf{0}_1$ and $X_1$.

The azimuth axis 20 is rotated about the rotation axis $\mathbf{0}_1$ by the control loop so that the elevation axis Y—Y becomes parallel to the ship inclination axis $OH_2$. Therefore, the point $X_1$ of the central axis X—X of the antenna 14 is moved to a point $X_2$, where $\mathbf{0}_1X_1=O_1X_2$. As described above, the central axis X—X of the antenna 14 is deviated from the zenith direction so that an error in direction of a small rotation angle $\theta_E$ occurs around the elevation axis Y—Y.

As will be clear from FIG. 25B, the elevation angle error $\theta_E$ of the antenna 14 is obtained by the following equation (27):

$$\theta_E = \sqrt{(\xi^2 + \eta^2)} - |\xi| \tag{27}$$

In view of the above-mentioned aspect, according to the eighth embodiment of the present invention, when the satellite altitude angle is near 90° and the control operation is carried out such that the elevation axis Y—Y is matched with the inclination axis of the ship body, even if the inclination angle $\xi$ of the antenna 14 around the elevation axis Y—Y is near zero, the calculation of $\Delta\phi_T=\eta/\xi$ is carried out by the divider 86 of the azimuth of inclination axis calculator 85, whereby the elevation axis Y—Y can be matched with the inclination axis of the ship's body.

According to the eighth embodiment of the present invention, when an angular velocity is suddenly applied to the antenna 14 around the axis perpendicular to both the azimuth axis Z—Z and the elevation angle axis Y—Y, the azimuth gimbal 40 is rotated around the azimuth axis Z—Z so that, until the input axis of the angular velocity and the elevation axis Y—Y become substantially parallel to each other, the directing error caused by the direct application of the angular velocity to the antenna can be removed.

Figure 3:
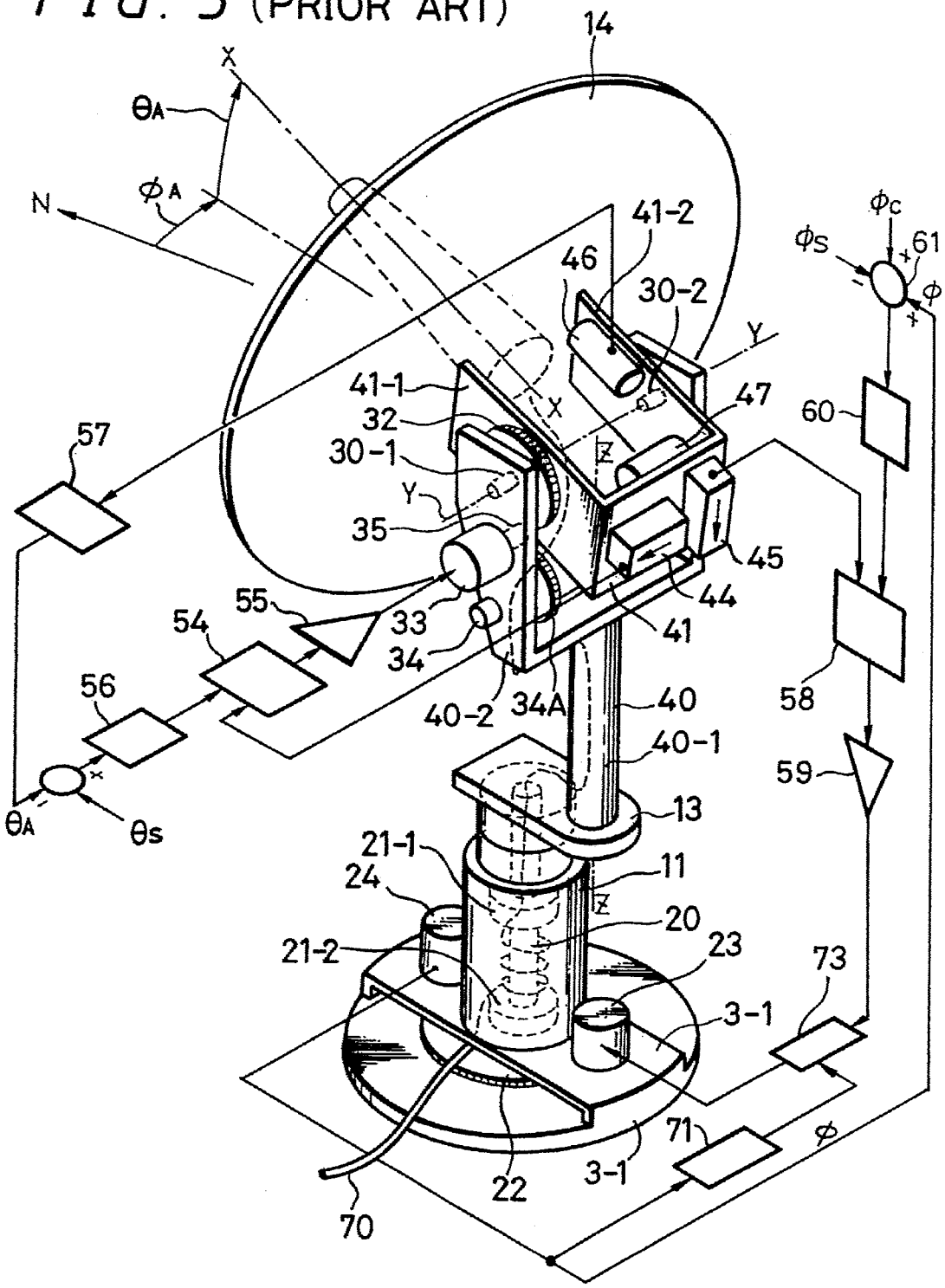
FIG. 3 (PRIOR ART)
FIG. 3 is a perspective view showing another example of the conventional antenna directing apparatus.
Figure 4:
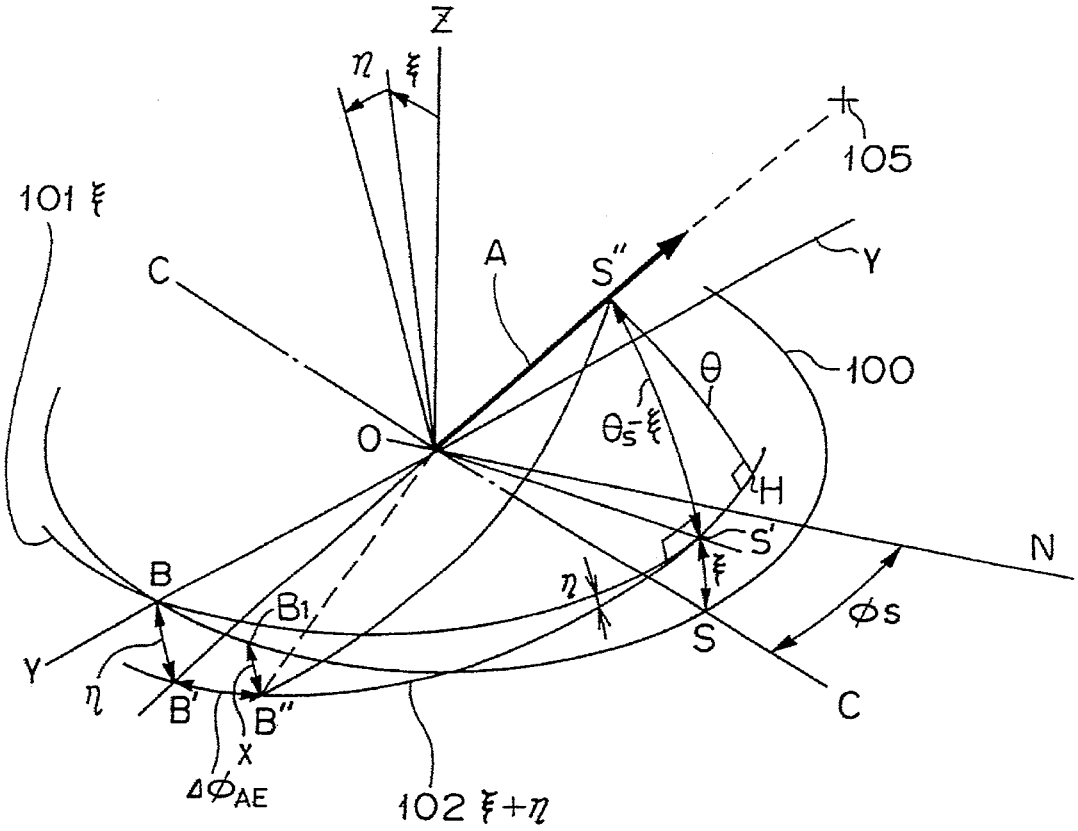
FIG. 4 (PRIOR ART)
FIG. 4 is a diagram used to illustrate an azimuth angle error generating mechanism.

A ninth embodiment of the antenna directing apparatus according to the present invention will be described with reference to FIG. 26 where like parts corresponding to those of FIG. 3 are marked with the same references and therefore need not be described in detail.

In the ninth embodiment of the present invention, the coaxial cable 70 for supplying the transmission signal to the antenna 14 or for receiving the reception signal from the antenna 14 is led from the outside of the antenna apparatus to the antenna 14 through the azimuth shaft 20 and the arm 13 of the azimuth gimbal 40. The coaxial cable 70 is made of a flexible material and is provided with a coil portion 70-1 around the azimuth shaft 20 so that no trouble occurs even when the coaxial cable 70 is twisted by a small rotation of the azimuth shaft 20.

In the ninth embodiment of the present invention, the output signal from the azimuth transmitter 24 is supplied to the rewind controller 71. This rewind controller 74 determines whether or not the rotation of the azimuth shaft 20, i.e., the twisted amount of the coaxial cable 70 exceeds a predetermined angle, e.g., ±270°. When the twisted amount of the coaxial cable 70 exceeds ±270°, the rewind controller 71 generates a $2\pi$ signal or $-2\pi$ signal so that the azimuth gimbal 40 is rotated once in the direction in which the twisted condition of the coaxial cable 70 is untied.

The $2\pi$ signal or $-2\pi$ signal obtained at the output side of the rewind controller 71 is supplied to the adder 61 and the $2\pi$ signal or $-2\pi$ signal that rotates the azimuth gimbal 40 once is added to a signal that results from calculating a signal corresponding to the ship's azimuth angle $\phi_C$ from the magnet compass or gimbal compass and the satellite azimuth angle $\phi_S$ provided by the manual setting or the like from the output signal $\phi$ of the azimuth transmitter 24.

Further, in this embodiment, the $2\pi$ or $-2\pi$ signal obtained at the output side of the rewind controller 71 is supplied to a gain switching circuit 73. When supplied with the $2\pi$ signal or $-2\pi$ signal, the gain switching circuit 73 sets a gain in the amplifier 60 or the attenuator, e.g., several 10s to 1000 times as large as the original gain.

The gain switching circuit 73 determines the output signal of the adder 61. When the output signal of the adder 61 is reduced to be less than a predetermined value, e.g., substantially zero, the gain switching circuit 73 returns the gain of the amplifier 60 to the original gain.

Since the ninth embodiment of the antenna directing apparatus according to the present invention is arranged as described above, the azimuth gimbal 40 is settled at an angle under the control of the azimuth servo system so that the signal which results from calculating the signal corresponding to the ship's azimuth angle $\phi_C$ from the magnet compass or gyro compass and the satellite azimuth angle $\phi_S$ from the output signal $\phi$ of the azimuth transmitter 24 becomes zero, i.e., the difference between the azimuth angle $\phi_A$ (sum of the rotation angle $\phi$ of the azimuth gimbal 40 and the ship's heading angle $\phi_C$) and the satellite azimuth angle $\phi_S$ becomes zero.

That is, $$\phi+\phi_C-\phi_S=0$$

$$\therefore \phi=\phi_S-\phi_C$$

Under this condition, when the coaxial cable 70 is twisted more than ±270°, the rewind controller 71 obtains at its output side the $2\pi$ signal or $-2\pi$ signal causing the azimuth gimbal 40 to rotate once in the opposite direction to that of the twisted direction. This $2\pi$ signal or $-2\pi$ signal is supplied to the adder 61.

Thus, the azimuth servo system is operated so that the output signal from the adder 61 becomes zero.

$$\phi+\phi_C-\phi_S\pm 2\ \pi=0$$

$$\therefore \phi=\phi_S-\phi_C\pm 2\pi=0$$

That is, the azimuth gimbal 40 starts rotating at the same time when it is supplied with the $2\pi$ signal or $-2\pi$ signal and rotated at the angle corresponding to the $2\pi$ signal or $-2\pi$ signal, namely once, thereby the rewind operation is completed.

According to this embodiment, since the gain in the amplifier 60 in this azimuth servo system is set to be several 10s to 1000 times the original gain by the gain switching circuit 73, the time required for the azimuth gimbal 40 to be rotated once can be reduced.

As described above, according to this embodiment, since the azimuth gimbal 40 is to be rotated once in the rewind direction when the coaxial cable 70 is rewound the servo loop is connected as the azimuth servo system. The antenna azimuth angle $\phi_A$, provided after the azimuth gimbal 40 was rotated once, is set in the stable directing state without the transient phenomenon and an azimuth servo system of high reliability is obtained.

Further, according to this embodiment, when the coaxial cable 70 is twisted more than ±270°, the $2\pi$ signal or $-2\pi$ signal, that rotates the azimuth gimbal 40 once, is supplied from the rewind controller 71 to the adder 61. Therefore, after the azimuth gimbal 40 is rotated once, an error is prevented from being produced in the antenna 14 and the antenna 14 is directed again in the satellite direction.

Further, according to this embodiment, since the gain of the amplifier 60 in the azimuth servo system is set to be several 10s to 1000 times the original gain when the azimuth gimbal 40 is rewound, the time required when the azimuth gimbal 40 is rotated once can be reduced.

Furthermore, according to this embodiment, when the azimuth gimbal 40 is rewound, the $2\pi$ signal or $-2\pi$ signal is supplied to the adder 61 and the gain of the amplifier 60 is increased. There is then the advantage that a correct rewind operation can be carried out by a simple arrangement.

Figure 27:
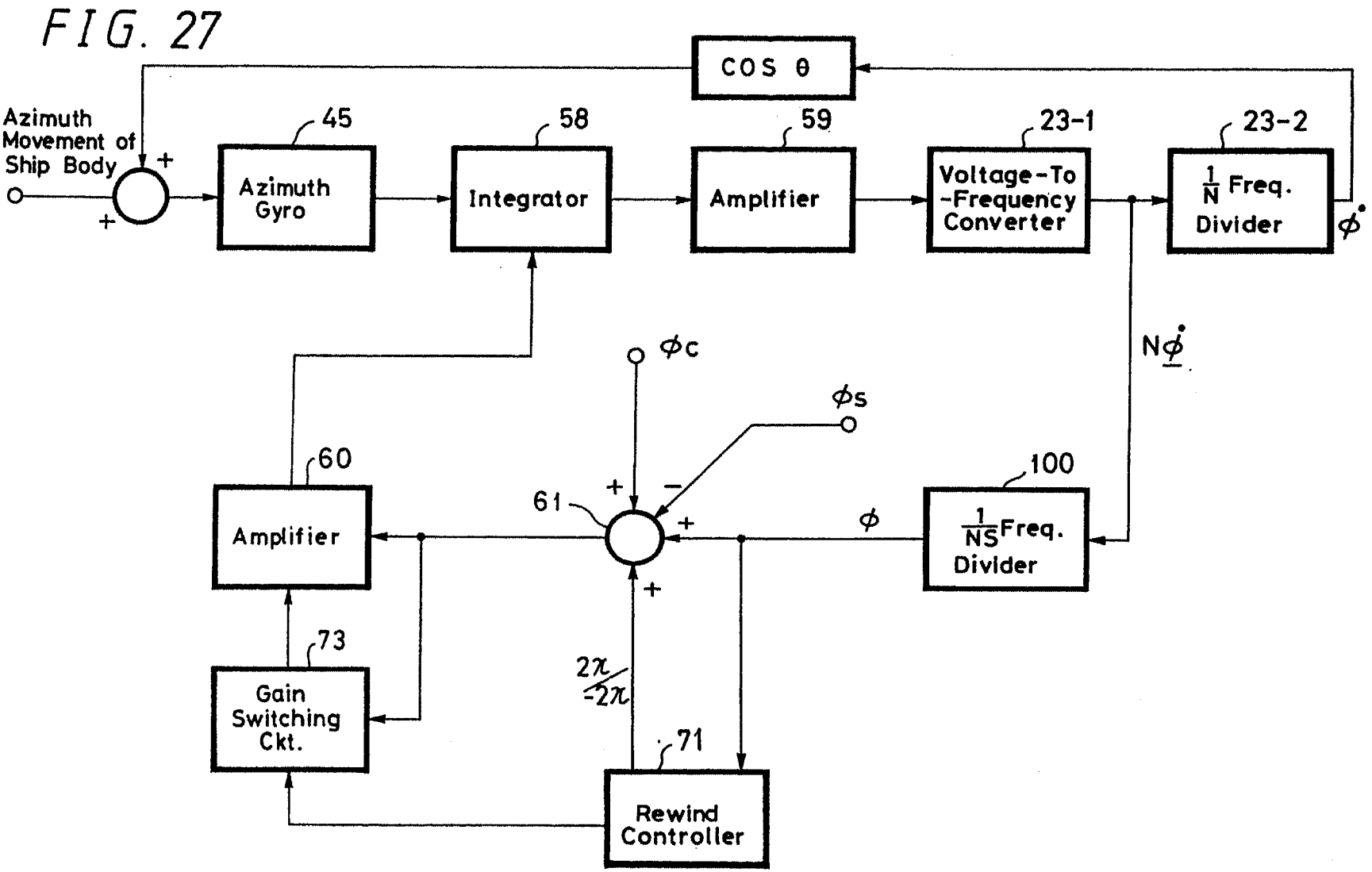
FIG. 27 is a block diagram showing the tenth embodiment of the present invention.
Figure 28:
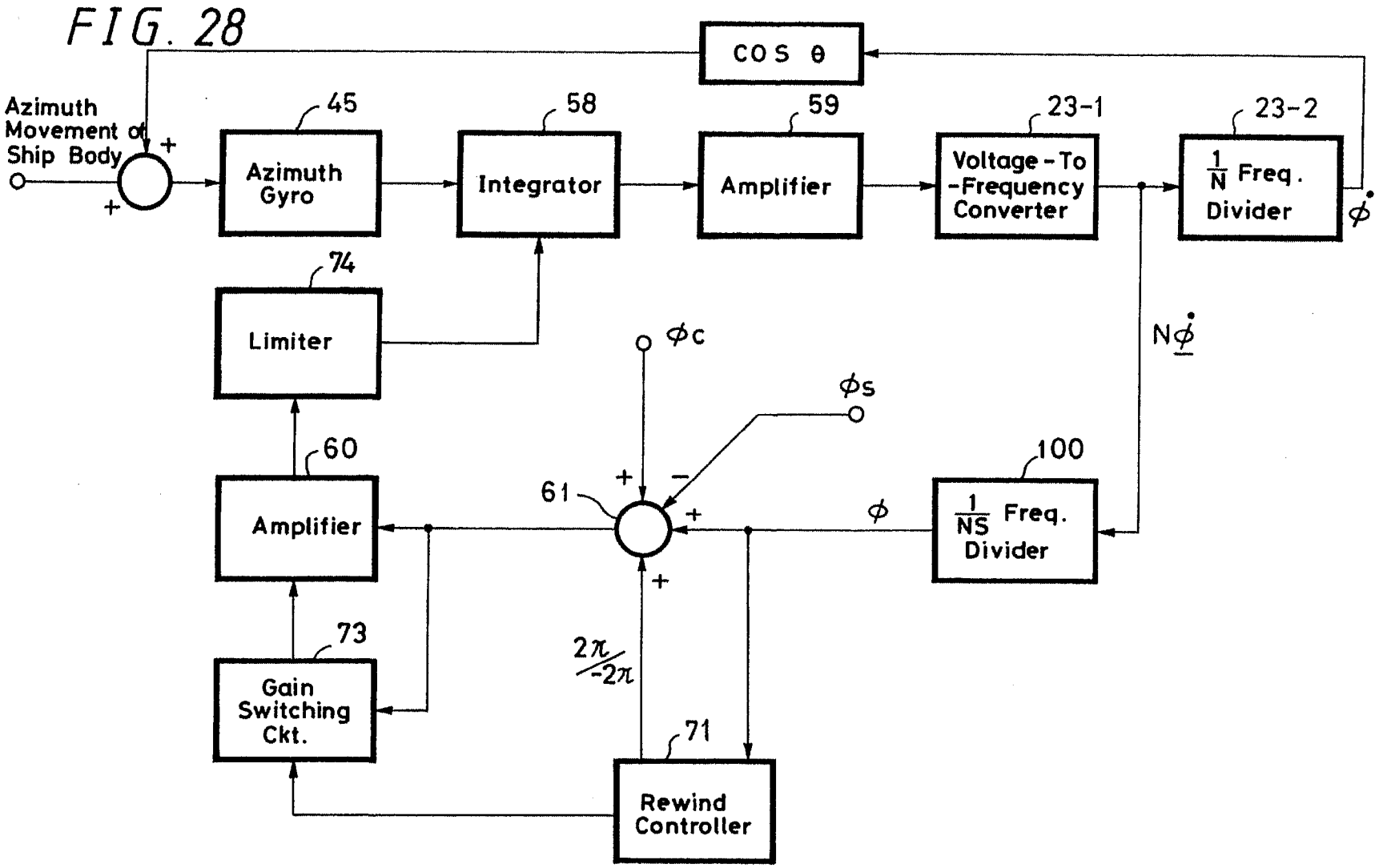
FIG. 28 is a block diagram showing the eleventh embodiment of the present invention.

FIGS. 27 and 28 show block diagrams of main portions of tenth and eleventh embodiments of the antenna directing apparatus according to the present invention.

The main portion of FIG. 27 will be described first. FIG. 27 shows another example of the azimuth servo system shown in FIG. 26. In the example of FIG. 27, the servo motor 23 of FIG. 26 is formed by a stepping motor. In FIG. 27, a voltage-to-frequency converter 23-1 and a 1/N frequency divider 23-2 representing the stepping motor and a pulse rate $N\phi$ for rotating the stepping motor is obtained at the output side of the voltage-to-frequency converter 23-1. A speed $d\phi$ of the stepping motor is obtained at the output side of the 1/N frequency divider 23-2.

The pulse rate $N\phi$ obtained at the output side of the frequency-to-voltage converter 23-1 is supplied to a 1/NS frequency divider 99 (S depicts a Laplace operator) formed of a counter and a rotation angle $\phi$ of the azimuth gimbal is obtained at the output side of the 1/NS frequency divider 100. In this case, the 1/NS frequency divider 99 constitutes the azimuth transmitter 24.

On the other hand, at the output side of the azimuth gyro 45, there is generated a voltage corresponding to the azimuth movement of the ship body and a COS component of the angular velocity of the stepping motor. This voltage, that is the output signal of the azimuth gyro 45, is fed through the integrator 58 and the amplifier 59 back to the stepping motors 23-1, 23-2, whereby the antenna 14 is stabilized around an axis perpendicular to both the antenna axis X—X and the elevation angle axis Y—Y.

A signal corresponding to the output signal $\phi$ of the azimuth transmitter 24 and which is obtained at the output side of the frequency divider 99 corresponding to the azimuth of the antenna 14 is supplied to the adder 61. Then, the adder 61 calculates the signals corresponding to the ship's heading azimuth angle $\phi_C$ from the magnet compass or from the gyro compass and the satellite azimuth angle $\phi_S$ from the signal corresponding to the output signal $\phi$, and an output signal of the adder 61 is supplied through the amplifier 60 to the integrator 58.

The above loop has a predetermined time constant by which the antenna azimuth angle $\phi_A$ coincides with the satellite azimuth angle $\phi_S$.

In the example of FIG. 27, the signal corresponding to the output signal $\phi$ of the azimuth transmitter 24 and which is obtained at the output side of the frequency divider 99 is supplied to the rewind controller 71. This rewind controller 71 determines whether or not the rotation of the azimuth shaft 20, i.e., the twisting of the coaxial cable 70 exceeds a predetermined angle, e.g., ±270°. When the twisting exceeds ±270°, the rewind controller 71 generates the $2\pi$ signal or $-2\pi$ signal that rotates the azimuth gimbal 40 once in the direction in which the twisting of the coaxial cable 70 is untied.

The $2\pi$ signal or $-2\pi$ signal, obtained at the output side of the rewind controller 71, is supplied to the adder 61. Then, the adder 61 adds the $2\pi$ signal or $-2\pi$ signal to the signal which results from calculating the signal corresponding to the ship's azimuth angle $\phi_C$ and the satellite azimuth angle $\phi_S$ from the signal corresponding to the output signal $\phi$ of the azimuth transmitter 24 obtained at the output side of the frequency divider 99.

In this embodiment, the $2\pi$ signal or $-2\pi$ signal obtained at the output side of the rewind controller 71 is supplied to the gain switching circuit 73. When supplied with the $2\pi$ signal or $-2\pi$ signal, the gain switching circuit 73 sets the gain of the amplifier 60 to be several 10s to 1000 times the original gain.

The gain switching circuit 73 judges the output signal from the adder 61. When the output signal from the adder 61 becomes smaller than a predetermined value, e.g., substantially zero, the gain switching circuit 73 returns the gain of the amplifier 60 to the original one. The rest of arrangements in FIG. 27 is formed similarly to that of FIG. 26.

Since the tenth embodiment of the antenna directing apparatus according to the present invention is arranged as described above, the azimuth gimbal 40 is settled at an angle under the control of the azimuth servo system so that the signal which results from calculating the signal corresponding to the ship's azimuth angle $\phi_C$ from the magnet compass or gyro compass and the satellite azimuth angle $\phi_C$ from the output signal $\phi$ of the frequency divider 100 becomes zero, i.e., the difference between the azimuth angle $\phi_A$ (sum of the rotation angle $\phi$ of the azimuth gimbal and the ship's heading angle $\phi_C$) and the satellite azimuth angle $\phi_C$ becomes zero.

That is, $$\phi+\phi_C-\phi_S=0$$

$$\therefore \phi=\phi_S-\phi_C$$

Under this condition, when the coaxial cable 70 is twisted more than ±270°, the rewind controller 71 outputs the $2\pi$ signal or $-2\pi$ signal to cause the azimuth gimbal to rotate once in the opposite direction of the twisted direction. This $2\pi$ signal or $-2\pi$ signal is supplied to the adder 61. Thus, the azimuth servo system is operated so that the output signal from the adder 61 becomes zero.

$$\phi+\phi_C-\phi_S\pm 2\pi=0$$

$$\therefore \phi=\phi_S-\phi_C\pm 2\pi$$

That is, the azimuth gimbal 40 starts rotating at the same time when it is supplied with the $2\pi$ signal or $-2\pi$ signal and rotated at the angle corresponding to the $2\pi$ signal or $-2\pi$ signal, namely once, thereby the rewind signal is completed.

According to this embodiment, since the gain of the amplifier 60 in this azimuth servo system is set to be, for example, several 10s to 1000 times the original gain by the gain switching circuit 73, a time required for the azimuth gimbal 40 to be rotated once can be reduced.

Figure 26:
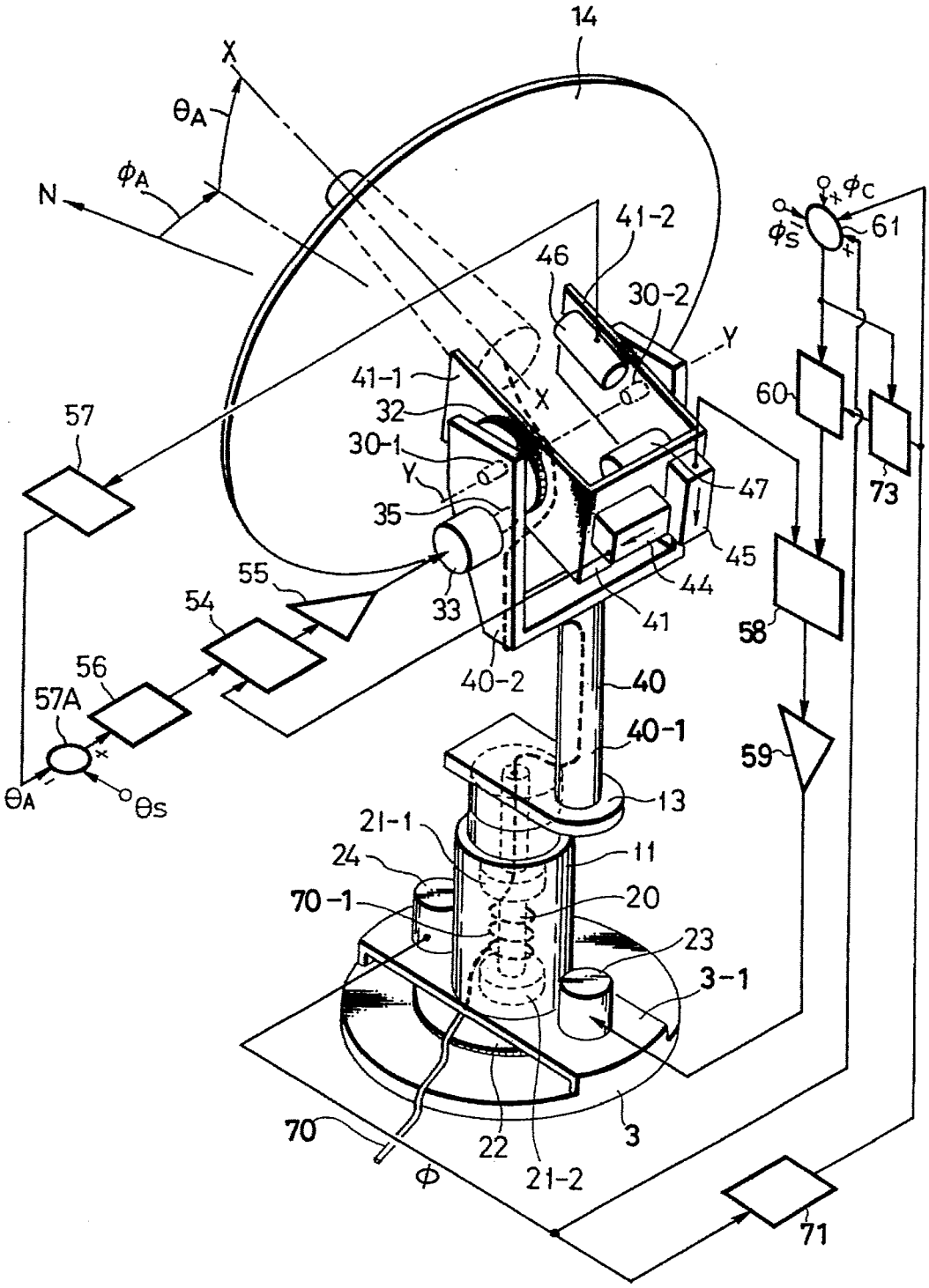
FIG. 26 is a perspective view showing a ninth embodiment of the present invention.

Therefore, it is needless to say that the azimuth servo system of the example shown in FIG. 27 can be applied to the azimuth servo system of the example shown in FIG. 26 with similar action and effect to those of FIG. 26 with similar action and effect to those of FIG. 26 achieved.

An eleventh embodiment of the present invention will hereinafter be described with reference to FIG. 28. FIG. 28 shows another example of the azimuth servo system shown in FIG. 26. In the example of FIG. 28, like parts corresponding to those of the example of FIG. 27 are marked with the same references and therefore need not be described in detail.

FIG. 28 shows the case where in the embodiment shown in FIG. 27, the output signal of the amplifier 60 is supplied to the integrator 58 through a limiter circuit 74 that limits a voltage higher than a predetermined voltage. The rest of the arrangement is formed similarly to that of the embodiment shown in FIG. 27.

Therefore, it is needless to say that when the azimuth servo system of the embodiment shown in FIG. 28 is applied to the azimuth servo system of the embodiment shown in FIG. 26, similar action and effects to those of the embodiment shown in FIG. 26 can be achieved.

In the embodiment shown in FIG. 27, when the $2\pi$ signal or $-2\pi$ signal is supplied to the adder 61 from the rewind controller 71, the gain of the amplifier 60 is increased and a very large output signal is supplied to the integrator 58 from the amplifier 60. It is frequently observed that this large output signal exceeds the dynamic range of the azimuth gyro 45 or the stepping motors 23-1, 23-2. In this case, a kind of saturated phenomenon occurs in the azimuth servo loop and the azimuth servo loop loses its azimuth stabilizing function for the azimuthal movement of ship's body. There is then the disadvantage that the azimuth gimbal 40 is merely rotated at a constant speed in response to the ship's body. In the embodiment of FIG. 28, there is provided a limiter circuit 74 that limits the output signal of the amplifier 60 by a predetermined value. Therefore, the output signal of the amplifier 60 can be prevented from exceeding the dynamic range of the azimuth gyro 45 or the stepping motors 23-1, 23-2. Thus, the above-mentioned disadvantages are improved.

As described above, according to the ninth to tenth embodiments of the present invention, since the azimuth gimbal 40 is rotated once in the rewind direction when the coaxial cable 70 is rewound under the condition that the servo loop is connected as the azimuth servo system, the antenna azimuth angle $\phi_A$ provided after the azimuth gimbal 40 had been rotated once can be set in the stable directing state without the transient phenomenon and an azimuth servo system of high reliability is obtained.

Further, according to the ninth to tenth embodiments of the present invention, when the coaxial cable 70 is twisted more than ±270°, the $2\pi$ signal or $-2\pi$ signal causing rotation of the azimuth gimbal 40 once is supplied from the rewind controller 71 to the adder 61, thereby the azimuth gimbal 40 is rotated once. Therefore, after the azimuth gimbal 40 has been rotated once, an error can be prevented from being produced in the antenna 14 and the antenna 14 can be directed again to the satellite direction.

Further, according to the ninth and tenth embodiments of the present invention, since the gain of the amplifier 60 in the azimuth servo system is set to be, for example, several 10s to 1000 times the original gain when the azimuth gimbal 40 is rewound, the time required for the azimuth gimbal 40 to be rotated once can be reduced.

Further, according to the ninth to tenth embodiments of the present invention, when the antenna directing apparatus is rewound, the $2\pi$ signal or $-2\pi$ signal is supplied to the adder 61 and the gain of the amplifier 60 is increased. Therefore, the correct rewind operation can be carried out by a simple arrangement.

Furthermore, according to the eleventh embodiment of the present invention, since there is provided the limiter circuit 74, there is then the advantage that the output signal of the amplifier 60 can be prevented from exceeding the dynamic range of the azimuth gyro 45 or servo motors.

Figure 29:
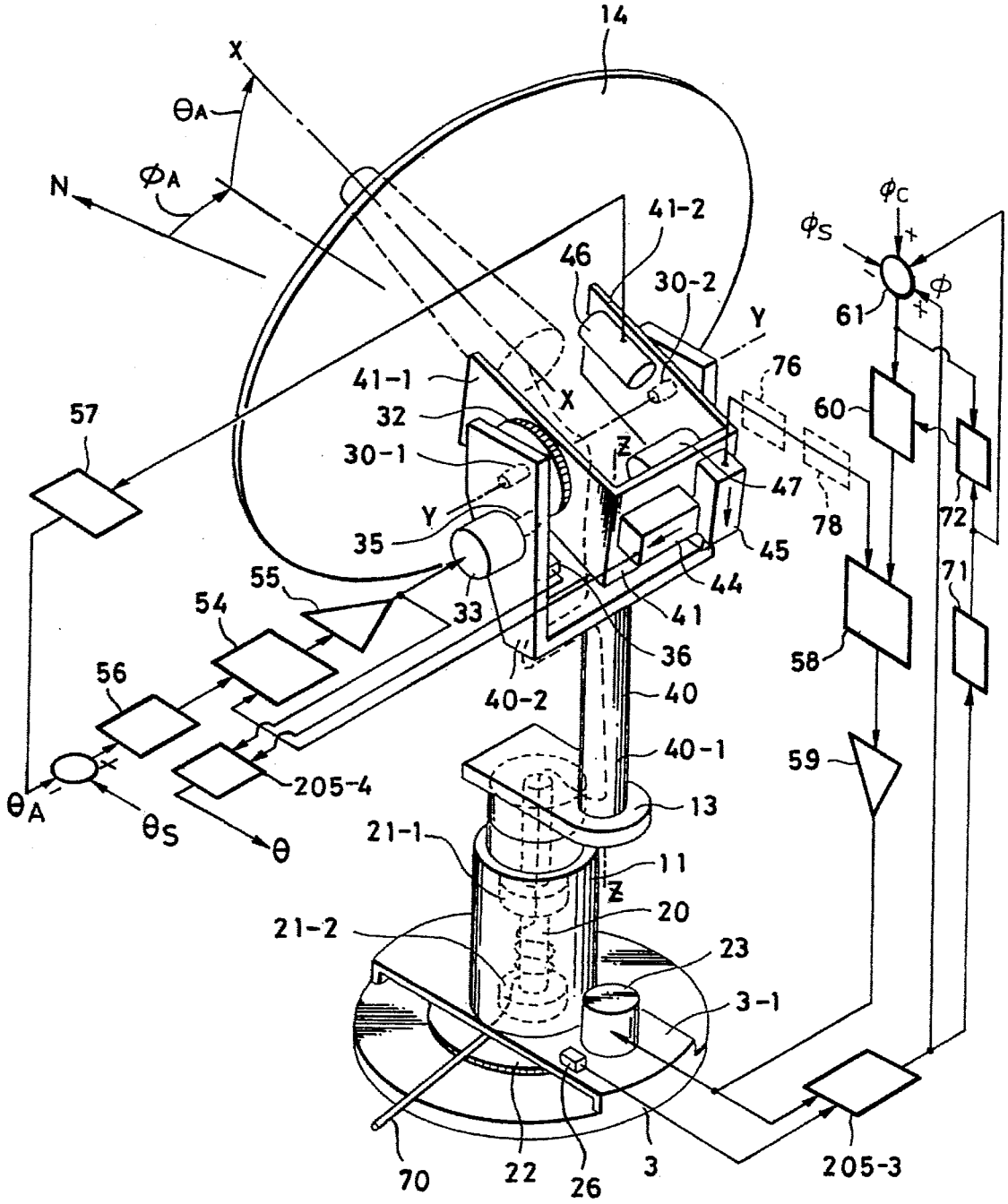
FIG. 29 is a perspective view showing a twelfth embodiment of the present invention.

FIG. 29 shows a twelfth embodiment of the antenna directing apparatus, i.e., the mechanical portion 100 according to the present invention.

In the twelfth embodiment of the present invention, stepping motors are utilized as the azimuth servo motor 23 and the elevation servo motor 33. When the stepping motor is utilized, an elevation zero-cross pickup 36 is mounted on one leg portion of the U-shaped portion 40-2 of the azimuth gimbal 40, and an azimuth zero-cross pickup 26 is mounted on the bridge portion 3-1 of the base 3. An output signal of the azimuth zero-cross pickup 26 is input to an azimuth transmitting unit 205-3 and an output signal of the elevation zero-cross pickup 36 is input to an elevation transmitting unit 205-4.

Then, the azimuth transmitting unit 205-3 outputs a signal that represents the rotation angle $\phi$ of the azimuth gimbal 40 around the azimuth axis Z—Z, and the elevation angle transmitting unit 205-4 outputs a signal that represents the rotation angle $\theta$ of the antenna 14 around the elevation angle axis Y—Y. According to this embodiment, the azimuth transmitter 24 and the elevation angle transmitter 34 used in the example of the prior art shown in FIG. 3 can be omitted.

The antenna directing apparatus according to this embodiment includes an elevation control loop and an azimuth control loop similar to those of the example of the prior art shown in FIG. 3. The angle formed by the central axis X—X of the antenna 14 with the horizontal plane is assumed to be an elevation angle $\phi_A$ of the antenna, and the angle formed by the central axis X—X of the antenna 14 with the meridian N on the horizontal plane is assumed to be an antenna azimuth angle $\phi_A$.

The elevation control loop is constructed so as to rotate the antenna 14 around the elevation axis Y—Y such that the antenna elevation angle $\theta_A$ coincides with the satellite altitude angle $\theta_S$. The elevation control loop includes first and second loops. In the first loop, the output of the elevation gyro 44 is fed through the integrator 54 and the amplifier 55 back to the elevation servo motor 33. Therefore, even when the ship's body rolls and pitches, the angular velocity of the antenna 14 around the elevation angle axis Y—Y relative to the inertial space can constantly be kept zero.

In the second loop, the output signal from the first accelerometer 46 is supplied through the arc sine calculator 57, subtracted by the signal representative of the satellite altitude angle $\theta_S$ manually set and then input through the attenuator 56 to the integrator 54 and the amplifier 55. The second loop has a suitable time constant so that the elevation angle $\theta_S$ of the antenna 14 coincides with the satellite altitude angle $\theta_S$. The attenuator 56 may have an integrating characteristic compensating for the drift fluctuation of the elevation gyro 44.

The azimuth control loop has four functions. The first function is to control the azimuth of the azimuth gimbal 40 so that the azimuth angle $\phi_A$ of the antenna 14 coincides with the satellite azimuth angle $\phi_S$ at a low altitude or middle altitude mode. This function is the ordinary function of the azimuth angle control loop and is effective at the low altitude or middle altitude mode where there is the small possibility that the gimbal lock phenomenon will occur.

An elevation angle error generating mechanism and a method for correcting such elevation angle error in a 180°-rewind system will be described with reference to FIGS. 30A, 30B.

Figure 30A:
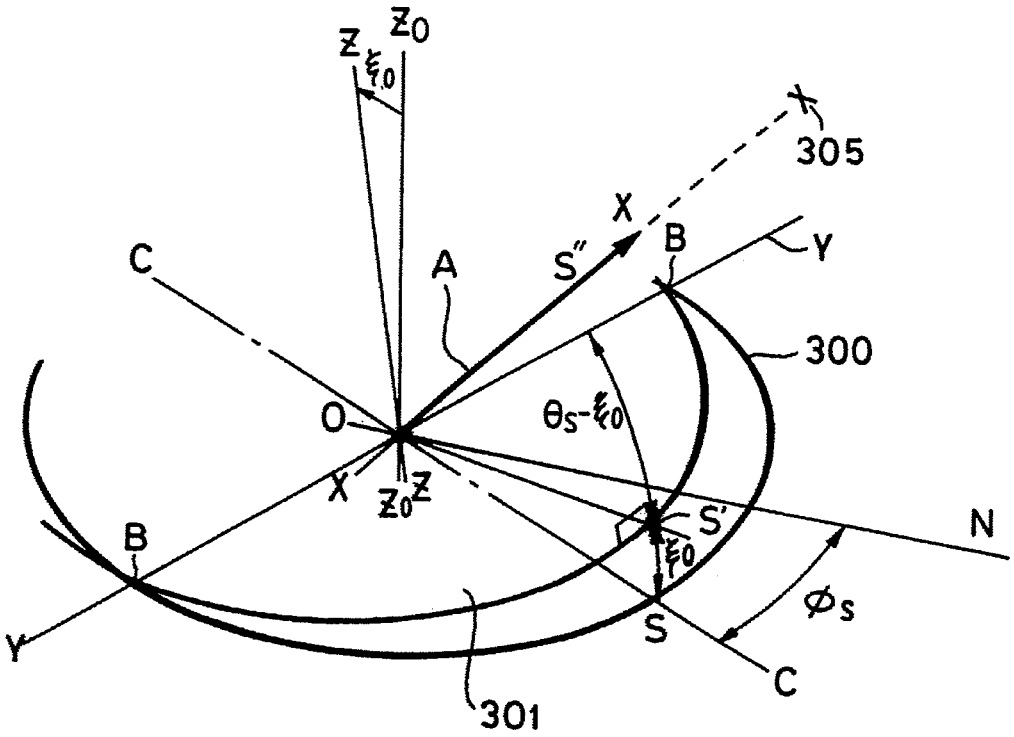
FIGS. 30A and 30B diagrammatically explain the elevation angle error generating mechanism in 180° rewind.

FIG. 30*a* shows a relationship between the azimuth axis Z—Z perpendicular to a ship's body plane 301 and the elevation axis Y—Y perpendicular to the azimuth axis Z—Z. Let it be assumed that the central axis X—X of the antenna 14 is directed to the satellite and that the ship's body plane 301 is rotated by the rotation angle $\xi_0$ around the elevation angle axis Y—Y relative to the horizontal plane from the state where it is parallel to the horizontal plane. Also, let it be assumed that the elevation axis Y—Y is located on the horizontal plane for simplicity. Then, the azimuth axis Z—Z, perpendicular to the ship body plane 301, is also rotated by the rotation angle $\xi_0$ around the elevation angle axis Y—Y.

Figure 30B:
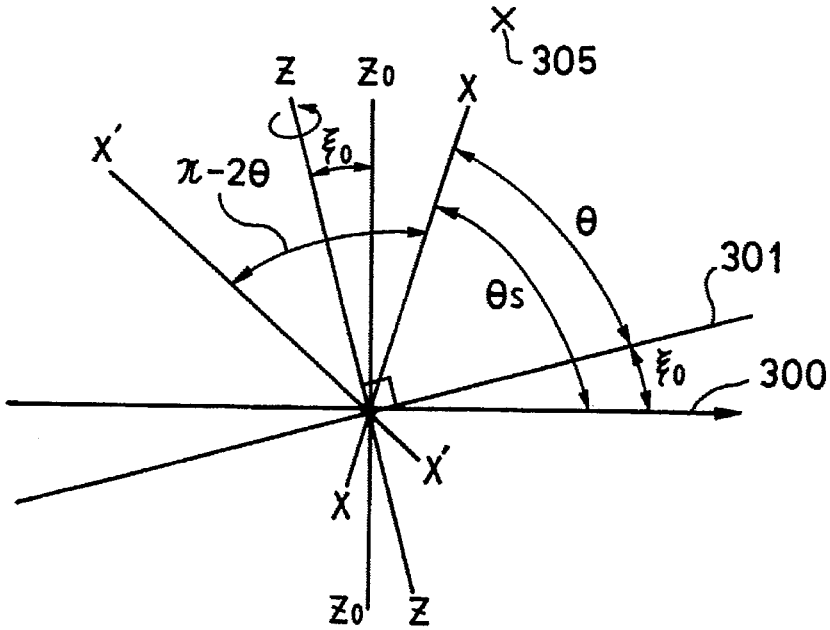

FIG. 30B is a cross-sectional view of the state of FIG. 30A taken along the plane that includes the azimuth axis Z—Z and perpendicular to the ship's body plane 301. In FIG. 30B, the azimuth axis Z—Z, perpendicular to the ship body plane 301, is a rewind axis. When the antenna 14 is rotated 180° around the rewind axis, the central axis X—X of the antenna 14 is moved to X'—X'. In this case, the elevation error $\theta_E$ is the angle that is formed by the central axis X—X of the antenna 14 before the rewind operation while the central axis X'—X' of the antenna 14 is provided after the rewind operation. The elevation error $\theta_E$ can be obtained with ease from FIG. 30B and is expressed by the following equation (28):

$$\theta_E=\{\pi/2-(\theta_S-\xi_0)\}=2(\pi/2-\theta)=\pi-2\theta \quad (28)$$

where $\theta_S$ represents the satellite altitude angle, $\xi_0$ represents the ship's body rotation angle around the elevation axis Y—Y and $\theta$ represents the rotation angle of the antenna 14 around the elevation axis Y—Y relative to the ship's body plane 301.

When the satellite altitude angle $\theta_S$ is 90°, by substituting $\theta_S=\pi/2$ into the equation (28), the elevation error is calculated as $\theta_E=2\xi_0$.

The rewind mechanism includes a function for correcting the elevation angle error $\theta_E$ so that the antenna 14 is rotated by the angle corresponding to the elevation error $\theta_E$ in the opposite direction around the elevation axis Y—Y. It is preferred that the rotation of the antenna 14 around the elevation angle axis Y—Y be carried out during the rewinding operation. If the rewind time is taken as TR and the rotation angular velocity of the antenna 14 around the elevation angle axis Y—Y is taken as $(\pi-2\theta)/TR$, then the elevation error $\theta_E$ is corrected at the completion of the rewind operation.

A command signal for correcting the elevation error $\theta_E$ and a signal that represents the rotation angular velocity $(\pi-2\theta)/TR$ are supplied from the rewind mechanism to the elevation angle control loop, though not shown. Alternatively, the command signal and the rotation angular velocity signal may be input to the integrator 54.

As described above, according to this embodiment, since the elevation angle error $\theta_E$ produced in the 180°-rewind operation is corrected during the rewind operation, the error in direction of the antenna 14 can be prevented from being produced at the completion of the rewind operation.

While, as illustrated, the rotation angular velocity of the antenna 14 is set to $(\pi-2\theta)/TR$ so that the elevation angle error $\theta_E$ is corrected at the completion of the rewind operation, the present invention is not limited thereto. The rotation angle of the antenna 14 relative to the rewind angle may be controlled instead of the rotation angular velocity. In this case, a correction rotation angle of the antenna 14 around the elevation angle axis Y—Y relative to the rewind operation may be selected to be $(\pi-2\theta)$.

As in FIG. 27, the 180°-rewind system azimuth servo motor (stepping motor) 23 for the embodiment in FIG. 29 corresponds to a voltage-to-frequency converter 23-1 and a 1/N gear train 23-2, and the azimuth angle transmitting unit 205-3 in FIG. 29 corresponds to a 1/NS frequency divider 24-1.

The voltage-to-frequency converter 23-1 provides a pulse at a rate $Nd\phi/dt$ that rotates the azimuth servo motor (stepping motor) 23 and the 1/N gear train 23-2 provides a rotation velocity $d\phi/dt$ of the azimuth servo motor (stepping motor) 23. The pulse rate $Nd\phi/dt$ output from the voltage-to-frequency converter 23-1 is supplied to the 1/NS frequency divider 24-1 and the rotation angle $\phi$ of the azimuth gimbal 40 is obtained from the 1/NS frequency divider 24-1. The 1/NS frequency divider (S represents a Laplace operator) 24-1 is formed by a counter.

The azimuth gyro 45 is supplied with a cos component of the rotation angular velocity $d\phi/dt$ obtained by the azimuth servo motor (stepping motor) 23 and an angular velocity component provided by the ship's body azimuth movement. The output signal from the azimuth gyro 45 is fed through the integrator 58 and the amplifier 59 to the azimuth servo motor (stepping motor) 23. As described above, the antenna 14 is stabilized against the ship's body angular movement around the axis that is perpendicular to both the central axis X—X of the antenna 14 and the elevation axis Y—Y.

There is shown an azimuth control loop that makes the azimuth angle $\phi_A$ of the antenna 14 coincident with the satellite azimuth angle $\phi_S$. Such azimuth control loop comprises the 1/NS frequency divider 24-1, the adder 61, the attenuator 60 and the integrator 58, and has a predetermined time constant. In the adder 61, the satellite azimuth $\phi_S$ is subtracted from a sum of the ship's azimuth $\phi_C$ and the rotation angle $\phi$ of the azimuth gimbal 40 relative to the ship's heading. The azimuth gimbal 40 is controlled to be continuously rotated until such value becomes zero.

$$\phi+\phi_C-\phi_S=0$$

$$\therefore \phi=\phi_S-\phi_C \tag{29}$$

When the left side member of the first equation of the equation (29) becomes zero, the azimuth gimbal 40 is settled and the central axis X—X of the antenna 14 at that time is directed to the satellite azimuth $\phi_S$.

In association with the azimuth control loop, there is provided the rewind mechanism. The rewind mechanism includes the rewind controller 71 and the gain switching circuit 72. The rotation angle $\phi$ of the azimuth gimbal 40 obtained from the 1/NS frequency divider 24-1 is input to the rewind controller 71 and the rewind controller 71 determines whether or not the rotation angle $\phi$ of the azimuth gimbal 40 exceeds, for example, ±270° from the reference azimuth. If the rotation angle of the azimuth gimbal 40 exceeds ±270° from the reference azimuth, then the rewind controller 71 supplies a $+\pi$ signal or $-\pi$ signal to the adder 61.

The adder 61 adds the rotation angle $\phi$ of the azimuth gimbal 40 obtained from the 1/NS frequency divider 24-1, the $+\pi$ signal or $-\pi$ signal obtained from the rewind controller 71, the ship's heading azimuth $\phi_C$ and the satellite azimuth $\phi_S$. The $+\pi$ signal or $-\pi$ signal output from the rewind controller 71 is supplied to the azimuth control loop, whereby the antenna 14 is rotated ±180° around the azimuth axis Z—Z to thereby untie the twisted cable 70.

At that time, the adder 61 calculates the following equation (3) similarly to the equation (29):

$$\phi+\phi_C-\phi_S\pm\pi=0$$

$$\therefore \phi=\phi_S-\phi_{C\pm\pi}$$

The gain switching circuit 72 is supplied with the $+\pi$ signal or $-\pi$ signal output from the rewind controller 71 and the rotation angular signal output from the adder 61. When supplied with the $+\pi$ signal or $-\pi$ signal from the rewind controller 71, the gain switching circuit 72 supplies a command signal that changes the gain of the attenuator 60. The attenuator 60 increases the gain to several 10s to several 1000s that of the original gain on the basis of the command signal supplied thereto from the gain switching circuit 72. Accordingly, during the rewind operation, the azimuth gimbal 40 is rotated around the azimuth axis Z—Z at a rotation speed higher than that of the ordinary control state.

The gain switching circuit 72 supplies a command signal that changes the gain to the original gain value to the attenuator 60 when the rotation angular signal from the adder 61 becomes smaller than a predetermined value. Then, the attenuator 60 returns the gain to the original gain value on the basis of the command signal supplied from the gain switching circuit 72.

Figure 31:
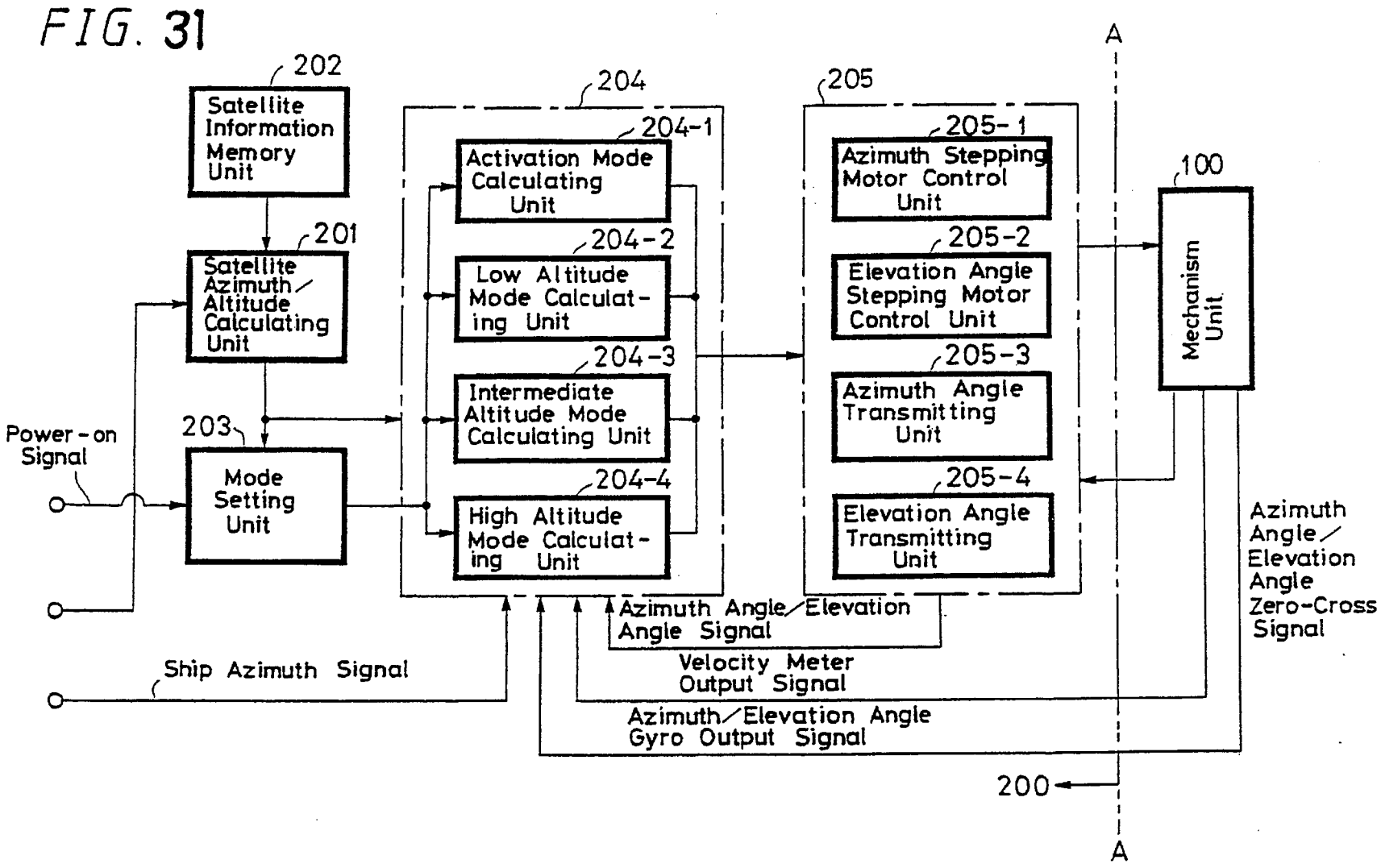
FIG. 31 is a diagram collectively showing examples of the antenna directing apparatus of the present invention.

Operation of the twelfth embodiment of the antenna directing apparatus according to the present invention will hereinafter be described with reference to FIG. 31. The antenna directing apparatus is operated in four modes, and the four modes are an activation mode in which the antenna directing apparatus is activated, a low altitude mode where the satellite altitude angle is at low altitude, an intermediate altitude mode where the satellite altitude angle is at the intermediate altitude and a high altitude mode where the satellite altitude angle is at high altitude.

A satellite azimuth/altitude calculating unit 201 calculates an altitude and an azimuth of a satellite observed from a ship on the basis of the altitude and position information of a directed satellite supplied from a satellite information memory unit 202 and position information of the ship, and outputs the signal representative of the satellite altitude and azimuth of the satellite measured by the ship to a mode setting unit 204 and a mode calculating unit 204.

On the basis of a power-on signal and the signal supplied thereto from the satellite information memory unit 202, the mode setting unit 203 provides a mode selection signal that selects one mode from the above four modes to the mode calculating unit 204. The mode calculating unit 204 operates one mode calculating unit selected from the four mode calculating units 204-1 to 204-4 on the basis of the mode selecting signal. The above-mentioned four modes will be described.

(A) Activation mode:

The activation mode is the mode under which the antenna directing apparatus is activated. In the activation mode, the activation mode calculating unit 204-1 is operated by the power-on signal during a predetermined period of time, whereby the azimuth servo motor 23 and the elevation servo motor 33 shown in FIG. 29 are controlled to adjust the azimuth $\phi$ of the azimuth gimbal 40 and the elevation angle $\theta$ of the antenna 14. According to this embodiment, the azimuth servo motor 23 and the elevation servo motor 33 are respectively stepping motors.

At this time, pulse signals are provided from the elevation zero-cross pickup 36 and the azimuth zero-cross pickup 26 to thereby reset the output signals from the azimuth transmitting unit 205-3 and the elevation transmitting unit 205-4. After a predetermined time has passed, one of the mode calculating units selected from the other three mode calculating units 204-2 to 204-4 is actuated by a mode selection signal.

(B) Low altitude mode:

The low altitude mode is the mode where the satellite altitude angle lies in a range of from 0° to about 60° and the first function and the fourth function, i.e., rewind function of the azimuth control loop is operated. The first function, i.e., the ordinary azimuth angle control loop has already been described with reference to FIG. 3. In this mode, even when the ship body rolls at maximum rolling angle (generally in a range of from 20° to 30° ), the gimbal lock phenomenon where the central axis X—X of the antenna becomes parallel to the azimuth axis Z—Z is avoided (see Japanese patent application No. 60-153044 filed by the assignee of the present application).

The output of the elevation gyro 44 is fed through the integrator 54 and the amplifier 55 back to the elevation servo motor 33 so that even when the ship's body rolls, the angular velocity of the antenna 14 around the elevation angle axis Y—Y relative to the inertial space can be constantly held at zero.

The output signal of the azimuth gyro 45 is fed through the integrator 58 (see FIGS. 3 and 29) and the amplifier 59 back to the azimuth servo motor 23 so that even when the ship's body is rotated around the axis perpendicular to both the central axis X—X of the antenna 14 and the elevation angle axis Y—Y, the angular velocity of the antenna 14 around such the axis relative to the inertial space can constantly be kept to zero.

The fourth function of the azimuth control loop, i.e., the rewind function will be described. The rewind function can be realized by the azimuth transmitting unit 205-3 of the azimuth control loop, the rewind controller 71 and the gain switching circuit 72.

When the azimuth transmitting unit 205-3 detects a rotation angle of the antenna 14 around the azimuth axis Z—Z exceeding a predetermined rotation angle, i.e., rotated more than ±270° relative to the ship's azimuth, then the rewind mechanism is actuated. Such rewind mechanism comprises a 360°-rewind system so that the antenna 14 is rotated 360° around the azimuth axis Y—Y in the opposite direction of winding. Accordingly, the antenna 14 is relocated at the same azimuth it had just before the antenna 14 was rewound.

(C) Intermediate altitude mode:

The intermediate altitude mode is the mode where the satellite altitude θ lies in a range of from about 60° to about 85°. In this intermediate altitude mode, the second function and the fourth function of the azimuth control loop, i.e., rewind function are actuated. The second function will be described initially.

The second function is effected to prevent the antenna directing accuracy from being lowered when the rotation angle θ (inclination angle of the antenna 14 around the elevation axis Y—Y relative to the ship's body plane) is large. Such function can be obtained by the 1/cosθ calculator 76 and the ON/OFF device 78 provided at the output side of the elevation angle transmitting unit 205-4. The 1/cosθ calculator 76 and the ON/OFF device 78 are shown by phantom blocks in FIG. 29.

The transfer function that represents the rotation angle ϕ of antenna after Laplace transform includes a term Kcosθ as a coefficient at its denominator. Therefore, when the rotation angle θ of antenna is large, the frequency characteristic of the azimuth control loop is deteriorated and the antenna directing accuracy is lowered. Therefore, the 1/cosθ calculating unit 76 is provided at the output side of the elevation angle transmitting unit 205-4, wherein the antenna inclination angle θ around the elevation axis Y—Y supplied from the elevation angle transmitting unit 205-4 is used to calculate the 1/cosθ value and the 1/cosθ value is multiplied to (dϕ/dt) ·cosθ supplied from the azimuth gyro 45.

The transfer function that represents the rotation angle ϕ of the antenna after the Laplace transform does not include a term having cosθ as a coefficient in the denominator so that even when the rotation angle θ of the antenna is large, the frequency characteristic of the azimuth control loop can be prevented from being deteriorated.

Even when the satellite altitude angle $\theta_S$ is not at a high altitude but at an intermediate altitude, it is frequently observed that the gimbal lock phenomenon will occur. The gimbal lock phenomenon is such that the central axis X—X of the antenna 14 becomes parallel to the azimuth axis Z—Z. Therefore, when the rolling of the ship's body is large and the antenna 14 is rotated, a large amount around the elevation angle axis Y—Y relative to the ship body although the satellite altitude angle $\theta_S$ is the intermediate altitude, it is frequently observed that the central axis X—X of the antenna 14 becomes parallel to the azimuth axis Z—Z momentarily.

The angular velocity occurring around the axis perpendicular to both the central axis X—X and the elevation angle axis Y—Y of the antenna 14 at that moment is detected by the azimuth gyro 45 and a command signal is transmitted to the azimuth servo motor 23. In this way, the antenna 14 is rotated around the azimuth axis Z—Z. By the azimuth control loop, the rotation angular velocity of the azimuth servo motor 23 is fed back to the azimuth gyro 45 so that the angular velocity around the axis perpendicular to both the central axis X—X and the elevation angle axis Y—Y of the antenna 14 becomes zero.

However, under the above condition, the axis that is perpendicular to both the central axis X—X and the elevation angle axis Y—Y of the antenna 14 is substantially perpendicular to the azimuth axis Z—Z so that even when the antenna 14 is rotated around the azimuth axis Z—Z, the angular velocity around the axis perpendicular to both the central axis X—X and the elevation angle axis Y—Y of the antenna 14 is not made zero. Therefore, the azimuth control loop will be continuously operated and the command signal will be continuously supplied from the azimuth gyro 45 to the azimuth servo motor 23. In this way, the gimbal lock phenomenon will occur and the azimuth servo motor 23 is set in the kind of reckless driving state.

Accordingly, the ON/OFF device 78 is provided at the output side of the azimuth gyro 45. When there is the large possibility that the gimbal lock phenomenon will occur, the ON/OFF device 78 is actuated to temporarily stop the supply of the command signal from the azimuth gyro 45 to the azimuth servo motor 23. As described above, since the command signal from the azimuth gyro 45 is interrupted, even when the central axis X—X of the antenna 14 becomes parallel to the azimuth axis Z—Z, the azimuth servo motor 23 can be prevented from being set in the reckless driving state.

The fourth function of the azimuth control loop, i.e., the rewind function will be described next. While in the low altitude mode the antenna 14 is rotated 360° around the azimuth axis Z—Z by the rewind mechanism in the opposite direction while in the intermediate altitude mode, the antenna 14 is rotated 180° around the azimuth axis Z—Z by the rewind mechanism in the opposite direction. As compared with the 360°-rewind system, the 180°-rewind system has the advantage such that the rewind time thereof is short and the stop time of the control loop during the rewind operation is reduced. However, the 180°-rewind system has the disadvantage that an elevation angle error occurs due to the rewind operation, and requires a function to correct such elevation angle error.

The second function is provided in order to prevent the gimbal lock phenomenon from occurring in the intermediate altitude mode when the rolling angle of the ship's body is large. The third function is adapted to control the azimuth of the azimuth gimbal 40 so that the elevation angle axis Y—Y of the antenna 14 is matched with the inclination axis azimuth of the ship's body when the satellite altitude angle $\theta_S$ is near 90°. The fourth function is the rewind function that rotates the azimuth gimbal 40 180° or 360° in the opposite direction when the azimuth gimbal 40 is initially rotated in excess of a predetermined azimuth.

As described, above, the central axis X—X of the antenna 14 can be directed to the satellite by the elevation angle control loop and the azimuth angle control loop.

(D) High altitude mode:

The high altitude mode is the mode where the satellite altitude $\theta_S$ lies in a range of from about 85° to 90°. In the high altitude mode, the third function and the fourth function of the azimuth control loop, i.e., the rewind function is actuated. The third function will be described below in brief.

When the satellite altitude $\theta_S$ is in a range of from about 85° to 90°, there is the possibility that, regardless of the magnitude of the ship's rolling and pitching, the gimbal lock phenomenon in which the central axis X—X of the antenna 14 becomes parallel to the azimuth axis Z—Z will occur. Therefore, according to this embodiment, when the satellite altitude angle $\theta_S$ is in a range of from about 85° to 90°, the gimbal lock phenomenon is to be avoided.

The third function is based on the following principle. That is, the ship's rolling and pitching can always be considered as a rotational movement around one of the rotation axis (inclination axis of ship body) within the horizontal plane. Accordingly, if the azimuth of the azimuth gimbal 40 is controlled so that the elevation axis Y—Y constantly coincides with the azimuth $\phi_T$ of this rotation axis, then even when the satellite altitude angle is high, the central axis X—X of the antenna 14 can constantly be directed to the zenith direction.

The third function is effected by the azimuth gyro 45, the second accelerometer 47, the elevation angle transmitter 205-4, the elevation axis inclination calculator 80, the azimuth of inclination axis calculator 85 and the amplifier 59 of the azimuth control loop.

The signal representative of the rotation angular velocity $\omega_P$ of the antenna 14 around the axis perpendicular to both the elevation axis Y—Y and the central axis X—X of the antenna 14 output from the azimuth gyro 45 and the signal representative of the inclination angle $\eta'$ of the elevation axis Y—Y relative to the horizontal plane output from the second accelerometer 47 are input to the elevation axis inclination calculator 80 (see FIG. 18), and the inclination angle $\eta$ of the elevation axis Y—Y relative to the horizontal plane is calculated by the elevation axis inclination calculator 80.

The elevation angle transmitting unit 205-4 provides the rotation angle $\theta$ of the antenna 14 around the elevation axis Y—Y. The rotation angle $\theta$ and the satellite altitude angle $\theta_S$ are compared with each other by a suitable comparator to thereby calculate the rotation angle $\xi$ ($=\theta_S-\theta$) of the ship's body around the elevation axis Y—Y relative to the horizontal plane. The rotation angle $\xi$ of the ship body around the elevation axis Y—Y relative to the horizontal plane may be calculated by comparing ($=\theta_A-\theta$) the rotation angle $\theta$ of the antenna 14 around the elevation axis Y—Y and the elevation angle $\theta_A$ of the antenna 14.

The azimuth of inclination axis calculator 85 (see FIG. 18) is supplied with the signals representative of the inclination angle $\xi$ of the elevation axis Y—Y relative to the horizontal plane output from the elevation axis inclination calculator 80, the rotation angle $\xi$ of the ship body around the elevation axis Y—Y relative to the horizontal plane output from the elevation angle transmitting unit 205-4 and the rotation angle $\phi$ of the antenna 14 obtained from the azimuth transmitting unit 205-3.

The azimuth of inclination axis calculator 85 calculates the inclination axis azimuth $\phi_T$ from the inclination angle $\eta$ of the elevation axis Y—Y and the rotation angle $\xi$ of the ship's body. The azimuth angle $\phi_T$ of the inclination axis is compared with the rotation angle $\phi$ of the antenna 14 obtained from the azimuth angle transmitting unit 205-3 to thereby calculate the azimuth deviation signal $\Delta\phi_T$.

The azimuth deviation signal $\Delta\phi_T$ representative of the difference between the azimuth angle $\phi_T$ of the inclination axis and the antenna rotation angle $\phi$ is output from the azimuth of the inclination axis calculator 85 to the amplifier 59 and is further supplied from the amplifier 59 to the azimuth servo motor 23. As described above, the azimuth gimbal 40 is controlled such that the azimuth deviation $\Delta\phi_T$ becomes zero, i.e., the azimuth of the elevation axis Y—Y coincides with the azimuth angle $\phi_T$ of the inclination axis.

The fourth function, i.e., the rewind function will be described below. In the high altitude mode, the rewind function is effected by the 180°-rewind system similarly to the intermediate altitude mode.

The rewind mechanism is actuated when the antenna 14 is rotated a great deal around the azimuth axis Z—Z. In this case, rotation of the antenna 14 can be considered as two cases first where the ship's body is turned and second where the ship's body is rolled and pitched and then the azimuth of the inclination axis thereof is changed. When the altitude angle of the satellite (an antenna 14) is increased, the rewind mechanism is frequently actuated because of simultaneous rolling and pitching of the ship's body.

Even when the ship is not turned and sails along the straight line, if the rolling of the ship is accompanied with not only the rolling but also the pitching, the inclination axis of the ship body is rotated around the vertical axis. Therefore, if the antenna 14 is constructed such that the elevation axis Y—Y coincides with the inclination axis azimuth, each time the ship's body is rolled and the inclination axis azimuth is changed, the antenna 14 is rotated around the azimuth axis Z—Z.

In the high altitude mode, the rewind mechanism is operated very frequently and a reduction in the rewind time is especially required in order to secure the communication time of antenna. According to this embodiment of the present invention, the rewind time can be reduced by the 180°-rewind system.

According to the present invention, in the antenna directing apparatus of the gimbal system of azimuth-elevation system, when the altitude angle of the satellite is any one of the low altitude, the intermediate altitude and the high altitude, the central axis of the antenna can be directed to the satellite. There is then the advantage such that a high directing accuracy can be obtained regardless of the ship's position on the sea anywhere on Earth.

According to the present invention, since the gimbal including the two rotation axes of the azimuth axis and the elevation axis is utilized as the antenna supporting mechanism, the conventional supporting mechanism of four gimbals or five gimbals is not utilized and an external sensor such as of the horizon need not be provided, the antenna directing apparatus of the present invention can be miniaturized, reduced in weight and can be produced inexpensively.

According to the present invention, since the stepping motors are used as the azimuth servo motor and the elevation servo motor and the azimuth angle output value from the azimuth angle transmitting unit and the elevation angle output value from the elevation angle transmitting unit are reset by the zero-cross signals from the zero-cross pickups, respectively, as compared with the arrangement in which the ordinary azimuth servo motor and elevation servo motor are combined with the transmitter such as a syncro or resolver, there can be provided the antenna directing apparatus of simple arrangement that is long in life and is made inexpensive.

According to the present invention, there can be provided the antenna directing apparatus of high directing accuracy in which when the rolling of ship body is large in the intermediate altitude ode, the occurrence of gimbal lock phenomenon can be avoided.

According to the present invention, in the intermediate altitude mode and in the high altitude mode, the antenna is rewound 180° around the azimuth axis by the 180°-rewind system. Therefore, the rewind time can be reduced.

Further, according to the present invention, the antenna directing apparatus includes a function for correcting the elevation angle error in the 180°-rewind system in the intermediate altitude mode and in the high altitude mode so that the elevation angle error can be corrected during the rewind operation. Therefore, the rewind time can be reduced and the communication disabled time by the antenna can be reduced.

Furthermore, according to the present invention, since the elevation axis Y—Y coincides with the ship body inclination axis in the high altitude mode, the occurrence of gimbal lock phenomenon can be avoided. Further, since the antenna directing apparatus of the present invention utilizes the 180°-rewind system, the rewind time can be reduced.

Having described preferred embodiments of the invention with reference to the accompanying drawings, it is to be understood that the invention is not limited to those precise embodiments and that various changes and modifications could be effected therein by one skilled in the art without departing from the spirit or scope of the novel concepts of the invention as defined in the appended claims.

What is claimed is:

1. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation angle axis and being secured to said supporting member;

an accelerometer for outputting a signal representative of an inclination angle of said central axis relative to a horizontal plane; and an azimuth transmitter for outputting a signal representative of a rotation angle of said azimuth gimbal around said azimuth axis, wherein a signal which results from subtracting a value corresponding to a satellite altitude angle from said output signal of said accelerometer is fed back to a substantial torquer of said first gyro, the output signal of said azimuth transmitter and signals corresponding to a ship's azimuth angle and a satellite's azimuth angle are added by an adder and an output signal of said adder is fed back to a substantial torquer of said second gyro to thereby direct said central axis of said antenna to said satellite, said antenna directing apparatus further comprising:

an elevation angle transmitter for outputting a rotation angle signal representative of a rotation angle θ of said antenna around said elevation axis relative to said azimuth gimbal; and a 1/cosθ calculating unit for calculating a value of 1/cosθ from the rotation angle signal output from said elevation angle transmitter, wherein the output signal of said second gyro and an output signal from said 1/cosθ calculating unit are multiplied with each other and a multiplied value is input to an integrator, thereby a frequency characteristic of a servo system being made invariable in all elevation angles θ.

2. In an antenna directing apparatus comprising:

an antenna having a central axis and being supported to a supporting member;

an azimuth gimbal for supporting said antenna and said supporting member so that said antenna and said supporting member become rotatable around an elevation axis perpendicular to said central axis;

a base for supporting said azimuth gimbal so that said azimuth gimbal becomes rotatable around an azimuth axis perpendicular to said elevation axis;

a first gyro having an input axis parallel to said elevation angle axis and being secured to said supporting member;

a second gyro having an input axis perpendicular to both said central axis and said elevation angle axis and being secured to said supporting member;

an accelerometer for outputting a signal representative of an inclination angle of said central axis relative to a horizontal plane; and an azimuth transmitter for outputting a signal representative of a rotation angle of said azimuth gimbal around said azimuth axis, wherein a signal which results from subtracting a value corresponding to a satellite altitude angle from said output signal of said accelerometer is fed back to a substantial torquer of said first gyro, the output signal of said azimuth transmitter and signals corresponding to a ship's heading azimuth and a satellite azimuth angle are added by an adder and an output signal of said adder is fed back to a substantial torquer of said second gyro to thereby direct said central axis of said antenna to said satellite, said antenna directing apparatus further comprising:

an elevation angle transmitter for outputting a rotation angle signal representative of a rotation angle θ of said antenna around said elevation axis relative to said azimuth gimbal; and an ON/OFF device for interrupting an output signal from said second gyro, wherein the output signal of said second gyro is interrupted by said ON/OFF device when a central value provided when said central axis of said antenna and said azimuth axis become parallel to each other falls within a predetermined angle range.

3. The antenna directing apparatus according to claim 2, wherein a width of said predetermined angle range falls in a range of 0.2° to 5°.

4. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation axis and being secured to said supporting member;

an accelerometer for outputting a signal representative of an inclination angle of said central axis relative to a horizontal plane;

an azimuth transmitter for outputting a signal representative of a rotation angle of said azimuth gimbal around said azimuth axis, wherein a signal which results from subtracting a value corresponding to a satellite altitude angle from said output signal of said accelerometer is fed through an attenuator back to a substantial torquer of said first gyro, the output signal of said azimuth transmitter and signals corresponding to a ship's heading azimuth and a satellite azimuth angle are calculated by an adder to produce an azimuth deviation signal which is fed through an attenuator back to a substantial torquer of said second gyro to thereby direct said central axis of said antenna to said satellite;

an elevation angle transmitter for outputting a rotation angle signal representative of a rotation angle θ of said antenna around said elevation angle axis relative to said azimuth gimbal; and a 1/cosθ calculating unit for calculating a value of 1/cosθ from the rotation angle signal output from said elevation angle transmitter, wherein the output signal of said second gyro and an output signal from said 1/cosθ calculating unit are multiplied with each other and a multiplied value is input to an integrator, thereby a frequency characteristic of a servo system being made invariable in all elevation angles θ;

said antenna directing apparatus further comprising:

a cosθ calculating unit for calculating a value of cosθ from the rotation angle signal output from said elevation angle transmitter, wherein said azimuth deviation signal and an output signal from said cosθ calculating unit are multiplied with each other, a multiplied result is input to a gyro drift compensating integrator and an output signal of said integrator is fed back to an input of said 1/cosθ calculating unit.

5. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation axis and being secured to said supporting member;

a first accelerometer for outputting a signal representative of an inclination angle of said central axis relative to a horizontal plane;

a second accelerometer for outputting a signal representative of an inclination angle of said elevation angle axis relative to said horizontal plane;

an azimuth transmitter for outputting a signal representative of a rotation angle of said azimuth gimbal around said azimuth axis;

an elevation angle transmitter for outputting a rotation angle of said antenna around said elevation angle axis relative to said azimuth gimbal to thereby direct said central axis of said antenna to said satellite;

said antenna directing apparatus further comprising:

a third accelerometer having an input axis perpendicular to both said central axis and said elevation angle axis of said antenna; and an antenna elevation angle calculating unit supplied with output signals of said first, second and third accelerometers, wherein said antenna elevation angle calculating unit calculates an elevation angle of said antenna from the output signals of said first, second and third accelerometers.

6. The antenna directing apparatus according to claim 5, wherein $g_1$ assumes an output of said first accelerometer, $g_2$ assumes an output of said second accelerometer and $g_3$ assumes an output of said third accelerometer and said antenna elevation angle calculating unit performs an arc tangent calculation expressed by the following equation:

$$\tan \theta_A = -g_1/(g_2 \sin \epsilon + g_3 \cos \epsilon)$$

where $\tan\epsilon = g_2/g_3$.

7. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation angle axis and being secured to said supporting member;

a first accelerometer for outputting a signal representative of an inclination angle of said central axis relative to a horizontal plane;

a second accelerometer for outputting a signal representative of an inclination angle of said elevation angle axis relative to said horizontal plane;

a third accelerometer having an input axis perpendicular to both said central axis and said elevation angle axis of said antenna;

an azimuth transmitter for outputting a signal representative of a rotation angle of said azimuth gimbal around said azimuth axis; and an elevation angle transmitter for outputting a signal indicative of a rotation angle θ of said antenna around said elevation angle axis relative to said azimuth gimbal, wherein a signal which results from subtracting a value corresponding to a satellite altitude angle from said output signal of said accelerometer is fed back to a substantial torquer of said first gyro, the output signal of said azimuth transmitter and signals corresponding to a ship's heading azimuth and a satellite azimuth angle are calculated by an adder and an output signal of said adder is fed back to a substantial torquer of said second gyro to thereby direct said central axis of said antenna to said satellite;

said antenna directing apparatus further comprising:

an inclination correction calculating unit supplied with an output signal from said second accelerometer, an output signal from said third accelerometer and an output signal of said elevation angle transmitter and said inclination correction calculating unit calculates an inclination correction value $\Delta\phi_A$ by the following equation and outputs a signal representative of said inclination correction value $\Delta\phi_A$ to said adder:

$$\Delta\phi_A=\tan^{-1}(\sin\theta\cdot\sin x/\sin\theta_P)$$

where θ is the rotation angle of said antenna around said elevation angle axis relative to said azimuth gimbal, x is the inclination angle of said elevation angle axis relative to said horizontal plane and $\theta_P$ is the inclination angle of an axis perpendicular to said central axis and said elevation angle axis of said antenna relative to said horizontal plane.

8. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation axis and being secured to said supporting member;

a first accelerometer for outputting a signal representative of an inclination angle of said central axis relative to a horizontal plane; and an azimuth transmitter for outputting a signal representative of a rotation angle of said azimuth gimbal around said azimuth axis, wherein a signal which results from subtracting a value corresponding to a satellite altitude angle from said output signal of said first accelerometer is fed back to a substantial torquer of said first gyro, the output signal of said azimuth transmitter and signals corresponding to a ship's heading azimuth and a satellite azimuth angle are calculated by an adder and an output signal of said adder is fed back to a substantial torquer of said second gyro to thereby direct said central axis of said antenna to said satellite;

said antenna directing apparatus further comprising:

a second accelerometer for outputting a signal representative of an inclination angle x of said elevation axis relative to said horizontal plane;

an elevation angle transmitter for outputting a signal θ representative of a rotation angle of said antenna around said elevation axis relative to said azimuth gimbal; and an azimuth error calculator supplied with an output of said second accelerometer and an output of said elevation angle transmitter, wherein a signal representative of an azimuth angle error $\Delta\phi_{AE}$ calculated by the azimuth error calculator according to the following equation is input to said adder;

$$\Delta\phi_{AE}=\sin^{-1}\{\sin\theta\cdot\sin x\cdot(\cos^2\theta_S-\sin^2 x\cdot\cos^2\theta)^{1/2}\}$$

where θ is the rotation angle of said antenna around said elevation angle axis of said antenna relative to said azimuth gimbal, x is the inclination angle of said elevation axis relative to said horizontal plane and $\theta_S$ is the altitude angle of said satellite.

9. The antenna directing apparatus according to claim 8, wherein said second accelerometer is disposed so as to have an input axis parallel to said elevation axis.

10. In an antenna directing apparatus comprising:

an antenna having a central axis;

a supporting member attached to said antenna;

an azimuth gimbal having an elevation axis perpendicular to said central axis and supporting said antenna attached to said supporting member so that said antenna becomes rotatable around said elevation angle axis; and a base for supporting said azimuth gimbal such that said azimuth gimbal becomes rotatable around an azimuth axis perpendicular to said elevation angle axis, wherein said supporting member has attached thereon a first gyro having an input axis parallel to said elevation angle axis, a second gyro having an input axis perpendicular to both said central axis and said elevation angle axis, a first accelerometer for outputting a signal representative of an inclination angle of said central axis relative to a horizontal plane and a second accelerometer for outputting a signal representative of an inclination angle of said elevation angle axis relative to said horizontal plane, and said base has attached thereon an azimuth transmitter for outputting a signal representative of a rotation angle of said azimuth gimbal around said azimuth axis and an elevation angle transmitter for outputting a signal representative of a rotation angle of said antenna around said elevation angle axis, wherein an azimuth angle and an altitude angle of said satellite are detected to thereby direct said central axis of said antenna to said satellite, said antenna directing apparatus further comprising:

means for controlling an azimuth of said azimuth gimbal such that when an altitude angle of said satellite is in the vicinity of 90°, said elevation angle axis coincides with an inclination axis azimuth of a ship body.

11. The antenna directing apparatus according to claim 10, further comprising an elevation angle axis inclination calculator which is supplied with the signal representative of the inclination angle of said central axis relative to said horizontal plane output from said second gyro and the signal representative of the inclination angle of said elevation angle axis relative to said horizontal plane output from said second accelerometer and calculates an inclination angle of said elevation angle axis relative to said horizontal plane, and an elevation angle axis azimuth calculator for calculating an azimuth of said ship body inclination axis from said inclination angle of said elevation angle axis output from said elevation angle axis inclination calculator and the rotation angle of said antenna output from said elevation angle transmitter, wherein when a satellite altitude angle is near 90°, an azimuth of said azimuth gimbal is controlled so that the azimuth of said azimuth gimbal is matched with the azimuth of said inclination axis of said ship body.

12. In an antenna directing apparatus comprising:

an antenna having a central axis;

a supporting member attached to said antenna;

an azimuth gimbal having an elevation angle axis perpendicular to said central axis and supporting said antenna attached to said supporting member so that said antenna become rotatable around said elevation angle axis perpendicular;

a base for supporting said azimuth gimbal so that said azimuth gimbal becomes rotatable around an azimuth axis perpendicular to said elevation axis;

a flexible cable for feeding and transmission and reception;

a first gyro having an input axis parallel to said elevation axis and being secured to said supporting member;

a second gyro having an input axis perpendicular to both said central axis and said elevation axis and being secured to said supporting member;

a first accelerometer for outputting a signal representative of an inclination angle of said antenna around said elevation axis;

a second accelerometer for outputting a signal representative of an inclination angle of said elevation axis;

an azimuth transmitter for outputting a signal representative of a rotation angle of said azimuth gimbal around said azimuth axis;

an elevation angle transmitter for outputting a signal representative of a rotation angle of said antenna around said elevation axis relative to said azimuth gimbal;

a rewind controller being supplied with a signal output from said azimuth transmitter and rotating said azimuth gimbal a predetermined rotation angle in the opposite direction to untie a twisting of said flexible cable when said azimuth gimbal is rotated more than said predetermined rotation angle around said azimuth axis to thereby direct said central axis of said antenna to said satellite in response to an azimuth angle and an altitude angle of said satellite;

said antenna directing apparatus further comprising:

a ship's rolling and pitching decision device for judging a magnitude of a ship'body rolling and pitching and controlling the azimuth of said azimuth gimbal so that said elevation axis coincides with a ship's fore and aft datum line when a satellite altitude angle is near 90° and it is determined by said ship's rolling and pitching decision device that the ship's body rolling and pitching is small.

13. The antenna directing apparatus according to claim 12, wherein said ship's rolling and pitching decision device is supplied with signals representative of an inclination angle $\eta$ of said elevation axis Y—Y relative to said horizontal plane and rotation angle $\xi$ of ship's body around said elevation axis Y—Y relative to said horizontal plane and generates a signal representing that the ship's body rolling and pitching is small when said inclination angle $\eta$ and rotation angle $\xi$ are respectively smaller than predetermined values $\eta_0$ and $\xi_0$.

14. In an antenna directing apparatus comprising:

an antenna having a central axis and being supported to a supporting member;

an azimuth gimbal having an elevation axis perpendicular to said central axis and for supporting said antenna attached to said supporting member so that said antenna become rotatable around said axis;

a base for supporting said azimuth gimbal so that said azimuth gimbal becomes rotatable around an azimuth axis perpendicular to said elevation axis;

a first gyro having an input axis parallel to said elevation axis and being secured to said supporting member;

a second gyro having an input axis perpendicular to both said central axis and said elevation axis and being secured to said supporting member;

a first accelerometer for outputting a signal representative of an inclination angle of said antenna around said elevation axis;

a second accelerometer for outputting a signal representative of an inclination angle of said elevation axis;

an azimuth transmitter for outputting a signal representative of a rotation angle of said azimuth gimbal around said azimuth axis relative to said base;

an elevation angle transmitter for outputting a signal representative of a rotation angle of said antenna around said elevation axis relative to said base;

an elevation axis inclination calculator being supplied with a signal representative of the inclination angle of said antenna around an axis perpendicular to both said central axis and said elevation axis output from said second gyro and a signal representative of the inclination angle of said elevation axis output from said second accelerometer and calculating an inclination angle of said elevation axis relative to said horizontal plane;

an azimuth elevation axis of calculator for calculating an azimuth of a ship's body inclination axis from said inclination angle of said elevation angle axis output from said elevation angle axis inclination calculator and the rotation angle of a ship's body around said elevation angle axis output from said elevation angle transmitter, wherein when a satellite altitude angle is near 90°, an azimuth of said azimuth gimbal is controlled so that the azimuth of said elevation angle axis is matched with the azimuth of said inclination axis of said ship's body, whereby the central axis of said antenna is directed to said satellite direction;

said antenna directing apparatus further comprising:

an angle limiter being supplied with a signal representative of a rotation angle $\xi$ of said ship's body around said elevation angle axis output from said elevation angle transmitter, wherein said angle limiter outputs a signal representative of a setting value $\xi_S$ having the same sign of said rotation angle $\xi$ when an absolute value of said rotation angle $\xi$ around said elevation angle axis is smaller than said setting value $\xi_S$ and a signal representative of said rotation angle $\xi$ when the absolute value of said rotation angle $\xi$ around said elevation angle axis is smaller than said setting value $\xi_S$.

15. The antenna directing apparatus according to claim 14, further comprising an inclination calculator supplied with a signal representative of an inclination angle $\eta$ of an elevation angle axis relative to a horizontal plane output from said elevation angle axis inclination calculator and a signal representative of a rotation angle $\xi$ of a ship body around the elevation angle axis output from said elevation angle transmitter and calculates an elevation angle error $\theta_E$ on the basis of the following equation:

$$\theta_E = \sqrt{(\xi^2 + \eta^2)} - |\xi|$$

and said elevation angle error $\theta_E$ is input to an integrator connected to the output side of said first gyro.

16. An antenna directing apparatus formed of a base, a supporting mechanism and a feeding coaxial cable comprising:

an azimuth gimbal supporting said supporting mechanism so that said supporting mechanism becomes rotatable around an azimuth shaft perpendicular to said base and having on its upper portion a fork-shaped member having a bearing for an elevation angle shaft perpendicular to said azimuth shaft;

an antenna supporting member having an elevation angle shaft rotatably engaged with said elevation angle shaft bearing and an antenna shaft perpendicular to said elevation angle shaft;

a first gyro secured to said antenna supporting member and having an input axis parallel to said elevational angle shaft;

a second gyro secured to said antenna supporting member and having an input axis perpendicular to both said antenna shaft and said elevation angle shaft;

an accelerometer secured to said antenna supporting member and generating an output signal corresponding to an inclination of said antenna shaft relative to a horizontal plane;

an azimuth transmitter for transmitting a rotation angle of said azimuth gimbal around said azimuth shaft relative to said base;

an amplifier for feeding a signal which results from subtracting a value corresponding to a satellite altitude from an output signal of said accelerometer back to a substantial torquer of said first gyro and feeding a signal which results from calculating an output signal of said azimuth transmitter and signals corresponding to a ship's heading azimuth angle and a satellite azimuth angle back to a substantial torquer of said second gyro;

a rewind controller supplied with the output signal of said azimuth transmitter; and a gain switching circuit operable by an output signal of said rewind controller to switch a gain of said amplifier, wherein when said coaxial cable is twisted over a predetermined angle, said rewind controller adds a $2\pi$ signal or $-2\pi$ signal to a signal which results from calculating the output signal of said azimuth transmitter and the signals corresponding to the ship's heading azimuth angle and the satellite azimuth angle and said gain switching circuit switches a gain of said amplifier to a large value.

17. The antenna directing apparatus according to claim 16, wherein a limiter circuit is connected to the output side of said amplifier.

18. In an antenna directing apparatus comprising:

an antenna having a central axis and being supported to a supporting member;

an azimuth gimbal for supporting said antenna and said supporting member so that said antenna and said supporting member become rotatable around an elevation angle axis perpendicular to said central axis;

a base for supporting said azimuth gimbal so that said azimuth gimbal becomes rotatable around an azimuth axis perpendicular to said elevation angle axis;

a first gyro having an input axis parallel to said elevation angle axis and being secured to said supporting member;

a second gyro having an input axis perpendicular to both said central axis and said elevation angle axis and being secured to said supporting member;

a first accelerometer for outputting a signal representative of an inclination angle of said central axis relative to said horizontal plane;

a second accelerometer for outputting a signal representative of an inclination angle of said elevation angle axis relative to said horizontal plane;

an azimuth transmitter for outputting a signal representative of a rotation angle of said azimuth gimbal around said azimuth axis;

an elevation angle transmitter for outputting a signal representative of a rotation angle of said antenna around said elevation angle axis relative to said azimuth gimbal;

an azimuth servo motor attached to said base and rotating said azimuth gimbal in response to an input axis;

an elevation angle servo motor attached to said azimuth gimbal and rotating said antenna around said elevation angle axis in response to an input axis;

a rewind apparatus for rotating said azimuth gimbal in the opposite direction when said azimuth gimbal is rotated over a predetermined rotation angle relative to said base to thereby direct the central axis of said antenna to said satellite;

said antenna directing apparatus further comprising:

a mode calculating unit including a low altitude mode calculating unit, an intermediate altitude mode calculating unit and a high altitude mode calculating unit; and a mode setting unit for outputting a mode selection signal to said mode calculating unit, wherein said low altitude mode calculating unit is operated in a low altitude mode where a satellite altitude is low, said intermediate altitude mode calculating unit is operated in an intermediate altitude mode where the satellite altitude is intermediate and said high altitude mode calculating unit is operated in a high altitude mode where the satellite altitude is near zenith.

19. The antenna directing apparatus according to claim 18, wherein in said low altitude mode the output of said first gyro is supplied to said elevation angle servo motor and the output of said second gyro is supplied to said azimuth servo motor so that said rewind apparatus executes a rewind operation at a rewind angle of 360°.

20. The antenna directing apparatus according to claim 18, wherein in said intermediate altitude mode the output of said first gyro is supplied to said elevation angle servo motor and the output of said second gyro is supplied to said azimuth servo motor so that said rewind apparatus executes a rewind operation at a rewind angle of 180°.

21. The antenna directing apparatus according to claim 18, wherein in said high altitude mode an azimuth of said azimuth gimbal is controlled so that said elevation angle axis is matched with an inclination axis azimuth of a ship body and said rewind apparatus executes a rewind operation at a rewind angle of 180°.

22. The antenna directing apparatus according to claim 18, wherein said mode calculating unit further includes an activation mode calculating unit that is actuated when said antenna apparatus is activated.

* * * * *